US009928786B2

(12) United States Patent
Miyazaki et al.

(10) Patent No.: US 9,928,786 B2
(45) Date of Patent: Mar. 27, 2018

(54) DISPLAY DEVICE AND SIGNAL CONVERTING DEVICE

(75) Inventors: Akiko Miyazaki, Osaka (JP); Kazunari Tomizawa, Osaka (JP); Kozo Nakamura, Osaka (JP); Shun Ueki, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 2052 days.

(21) Appl. No.: 12/445,242

(22) PCT Filed: Oct. 12, 2007

(86) PCT No.: PCT/JP2007/069994

§ 371 (c)(1),
(2), (4) Date: Apr. 10, 2009

(87) PCT Pub. No.: WO2008/047725

PCT Pub. Date: Apr. 24, 2008

(65) Prior Publication Data

US 2010/0026728 A1 Feb. 4, 2010

(30) Foreign Application Priority Data

Oct. 13, 2006 (JP) ..... 2006-280136
Sep. 12, 2007 (JP) ..... 2007-236776

(51) Int. Cl.
*G09G 3/36* (2006.01)
*G09G 3/20* (2006.01)

(52) U.S. Cl.
CPC ..... *G09G 3/36* (2013.01); *G09G 3/3614* (2013.01); *G09G 3/2003* (2013.01);
(Continued)

(58) Field of Classification Search
CPC ..... G09G 3/2074; G09G 3/36; G09G 3/2003
(Continued)

(56) References Cited

U.S. PATENT DOCUMENTS 4,800,375 A 1/1989 Silverstein et al.
6,252,613 B1 6/2001 Borel et al.
(Continued)

FOREIGN PATENT DOCUMENTS

JP 62-143575 A 6/1987
JP 64-081996 A 3/1989
(Continued)

OTHER PUBLICATIONS

English translation of the official communication issued in International Application No. PCT/JP2007/069994, dated Apr. 23, 2009.
(Continued)

*Primary Examiner* — Jeff Piziali
(74) *Attorney, Agent, or Firm* — Keating & Bennett, LLP

(57) ABSTRACT

A display device includes a multi-primary-color display panel with subpixels arranged in a matrix pattern of columns and rows; and a signal converter arranged to convert a video signal, having values that represent the colors of pixels with a matrix pattern, into a multi-primary-color signal for use in the multi-primary-color display panel. The signal converter associates a value of the video signal representing the color of at least one of pixels on a $p^{th}$ row with values of the multi-primary-color signal corresponding to the luminances of subpixels on $(s-1)^{th}$ and $s^{th}$ rows, and also associates a value of the video signal representing the color of at least one of the pixels on a $(p+1)^{th}$ row with values of the multi-primary-color signal corresponding to the luminances of subpixels on $s^{th}$ and $(s+1)^{th}$ rows.

26 Claims, 22 Drawing Sheets

(52) U.S. Cl.
CPC ..... *G09G 2300/0452* (2013.01); *G09G 2340/0457* (2013.01); *G09G 2340/06* (2013.01)

(58) Field of Classification Search
USPC ..... 345/88, 95, 96, 98, 100, 103, 690
See application file for complete search history.

(56) References Cited

U.S. PATENT DOCUMENTS

| | | | | |
|---|---|---|---|---|
| 7,317,502 | B2 * | 1/2008 | Hu et al. | 349/114 |
| 7,450,190 | B2 * | 11/2008 | Roh et al. | 349/43 |
| 7,483,095 | B2 * | 1/2009 | Roth et al. | 349/106 |
| 7,542,110 | B2 * | 6/2009 | Maeda et al. | 349/106 |
| 7,697,012 | B2 * | 4/2010 | Lee et al. | 345/613 |
| 7,999,823 | B2 * | 8/2011 | Roth et al. | 345/590 |
| 2003/0227429 | A1 | 12/2003 | Shimoshikiryo | |
| 2004/0001167 | A1 | 1/2004 | Takeuchi et al. | |
| 2004/0174389 | A1 * | 9/2004 | Ben-David et al. | 345/694 |
| 2005/0122294 | A1 | 6/2005 | Ben-David et al. | |
| 2007/0063946 | A1 | 3/2007 | Nakamura et al. | |
| 2007/0230813 | A1 * | 10/2007 | Yamamoto et al. | 382/252 |

FOREIGN PATENT DOCUMENTS

| | | | |
|---|---|---|---|
| JP | 03-018894 | A | 1/1991 |
| JP | 09-251160 | A | 9/1997 |
| JP | 2001-209047 | A | 8/2001 |
| JP | 2001-306023 | A | 11/2001 |
| JP | 2004-357253 | A | 12/2004 |
| JP | 2006-221007 | A | 8/2006 |
| JP | 2007-102005 | A | 4/2007 |

OTHER PUBLICATIONS

Official Communication issued in International Patent Application No. PCT/JP2007/069994, dated Nov. 6, 2007.
Young-Chol Yang et al., SID 05 Digest, "Development of Six Primary-Color LCD", pp. 1210-1213, May 25-27, 2005.
Chino et al., SID 06 Digest, "Invited Paper: Development of Wide-Color-Gamut Mobile Displays with Four-primary-color LCDs", pp. 1221-1224, Jun. 7-9, 2006.
Moshe Ben-Chorin, FPD International 2005 Forum, "Improving LCD TV Color using Multi-Primary Technology", Oct. 19, 2005.
Nakamura et al.; "Display Device and Color Filter Substrate"; U.S. Appl. No. 11/533,392, filed Sep. 20, 2006.

* cited by examiner

VIDEO SIGNAL
100
200
310
320
R G R G
B Ye B Ye
$r_{1,1}g_{1,1}b_{1,1}, r_{1,2}g_{1,2}b_{1,2}, r_{1,3}g_{1,3}b_{1,3},\cdots$
$r_{3,1}g_{3,1}b_{3,1}, r_{3,2}g_{3,2}b_{3,2}, r_{3,3}g_{3,3}b_{3,3},\cdots$
$r_{2M-1,1}, g_{2M-1,1}, b_{2M-1,1}, r_{2M-1,2}, g_{2M-1,2}, b_{2M-1,2}, r_{2M-1,3}, g_{2M-1,3}, b_{2M-1,3},\cdots$
$R_{1,1}G_{1,1}$, $B_{1,1}Ye_{1,1}$, $R_{1,2}G_{1,2}$, $B_{1,2}Ye_{1,2}$, $R_{1,3}G_{1,3}$, $B_{1,3}Ye_{1,3},\cdots$
$R_{3,1}G_{3,1}$, $B_{3,1}Ye_{3,1}$, $R_{3,2}G_{3,2}$, $B_{3,2}Ye_{3,2}$, $R_{3,3}G_{3,3}$, $B_{3,3}Ye_{3,3},\cdots$
$R_{2M-1,1}G_{2M-1,1}$, $B_{2M-1,1}Ye_{2M-1,1}$, $R_{2M-1,2}G_{2M-1,2}$, $B_{2M-1,2}Ye_{2M-1,2}$, $R_{2M-1,3}G_{2M-1,3}$, $B_{2M-1,3}Ye_{2M-1,3},\cdots$
$R_{1,1}, R_{1,2}, R_{1,3}, G_{1,1}, G_{1,2}, G_{1,3},\cdots$
$B_{1,1}, B_{1,2}, B_{1,3}, Ye_{1,1}, Ye_{1,2}, Ye_{1,3},\cdots$
$R_{3,1}, R_{3,2}, R_{3,3}, G_{3,1}, G_{3,2}, G_{3,3},\cdots$
$B_{3,1}, B_{3,2}, B_{3,3}, Ye_{3,1}, Ye_{3,2}, Ye_{3,3},\cdots$
$R_{2M-1,1}, R_{2M-1,2}, R_{2M-1,3}, G_{2M-1,1}, G_{2M-1,2}, G_{2M-1,3},$
$B_{2M-1,1}, B_{2M-1,2}, B_{2M-1,3}, Ye_{2M-1,1}, Ye_{2M-1,2}, Ye_{2M-1,3},\cdots$ 23 67 10

*FIG.31A*

| COMBINATION | RR | GY | CB | RR | GC | YB | RR | GB | CY | RG | RB | CY | RG | RC | YB | RG | RY | CB | RY | RB | CG | RY | RC | BG | RB | RC | YG |
|---|---|---|---|---|---|---|---|---|---|---|---|---|---|---|---|---|---|---|---|---|---|---|---|---|---|---|---|
| LUMINANCE RATIO | 17 | 66.5 | 16.5 | 17 | 34.5 | 48.5 | 17 | 31 | 52 | 33 | 15 | 52 | 33 | 18.5 | 48.5 | 33 | 50.5 | 16.5 | 50.5 | 15 | 34.5 | 50.5 | 18.5 | 31 | 15 | 18.5 | 66.5 |
| BIGGEST DIFFERENCE | 50 | | | 31.5 | | | 35 | | | 37 | | | 30 | | | 34 | | | 35.5 | | | 32 | | | 51.5 | | |

*FIG.31B*

| COMBINATION | R | G | B |
|---|---|---|---|
| LUMINANCE RATIO | 23 | 67 | 10 |
| BIGGEST DIFFERENCE | 57 | | |

*FIG.32A*
Prior Art
| | | | | | |
|---|---|---|---|---|---|
| R | G | B | C | M | Ye |
*FIG.32B*
Prior Art
| | | |
|---|---|---|
| R | G | B |
| C | M | Ye |
*FIG.33A*
Prior Art
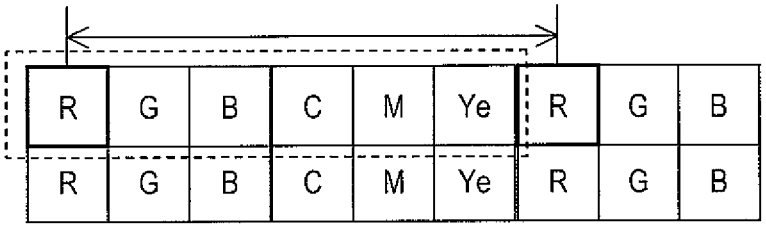
*FIG.33B*
Prior Art
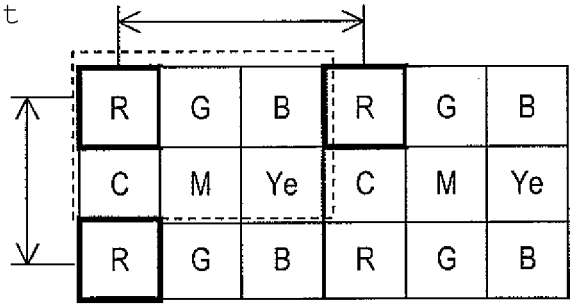

DISPLAY DEVICE AND SIGNAL CONVERTING DEVICE

BACKGROUND OF THE INVENTION

1. Field of the Invention

The present invention relates to a display device and more particularly relates to a display device for conducting a display operation in multiple primary colors.

2. Description of the Related Art

A color display device such as a color TV monitor or a color display monitor represents colors usually by adding together the three primary colors of red (R), green (G) and blue (b). Thus, each pixel in a color display device has red, green and blue subpixels for these three primary colors of RGB. YCrCb (YCC) signals, which can be converted into RGB signals, are input to such a display device and the red, green and blue subpixels change their luminances in response to the YCrCb signals, thereby representing various colors.

However, the color reproduction range of a normal display device is narrower than the range of the reproduced colors that can be perceived by human beings. That is why to expand the color reproduction range of a display device, various measures have been taken. For example, sometimes the color purity is increased by thickening color filters and sometimes LEDs with high color purity are used. According to these methods, however, either the brightness or the efficiency of the light source will decrease.

To overcome such problems, display devices that add together four or more primary colors, not just the three primary colors in display devices, have been proposed recently. Such a display device conducts a display operation using not just the three primary colors of RGB but also other additional primary colors, thereby expanding the color reproduction range. In such a display device, the luminances of respective subpixels are determined in response to video signals such as YCrCb signals and RGB signals. As a result, various colors can be represented (see PCT International Application Japanese National Phase Publication No. 2004-529396 and PCT International Application Japanese National Phase Publication No. 2005-523465, for example). In the six-primary-color display panel (which is an exemplary multi-primary-color display panel) disclosed in PCT International Application Japanese National Phase Publication No. 2004-529396 and PCT International Application Japanese National Phase Publication No. 2005-523465, a single pixel consists of six types of subpixels (namely, red, green, blue, yellow, cyan, and magenta subpixels), which are arranged either in line as shown in FIG. 32A or in two lines as shown in FIG. 32B.

Comparing the two arrangements of subpixels shown in FIGS. 32A and 32B, according to the arrangement of subpixels shown in FIG. 32A, subpixels of the same color are arranged far away from each other in the row direction as can be seen from FIG. 33A. That is why if the color red were displayed over the entire screen of such a display device, then red and black stripes would be quite visible in the column direction. On the other hand, according to the arrangement of subpixels shown in FIG. 32B, subpixels of the same color are arranged at short intervals in both the column and row directions as can be seen from FIG. 33B. Consequently, no stripes can be seen and the display quality does not deteriorate, either. For that reason, the subpixels are preferably arranged in multiple rows as shown in FIG. 32B.

However, if a multi-primary-color display panel with such an arrangement of pixels were fabricated at the same resolution as a three-primary-color display panel, then twice as many subpixels should be arranged vertically, thus increasing the cost and decreasing the aperture ratio. To overcome such problems, it has been proposed that a multi-primary-color display panel be fabricated as shown in FIG. 34B just by changing the color filters without changing the arrangement of current three-primary-color display panels as shown in FIG. 34A. Nevertheless, if such a multi-primary-color display panel is just used as it is, its vertical resolution will be only a half of that of a three-primary-color display panel and a high-definition display cannot be realized.

SUMMARY OF THE INVENTION

Preferred embodiments of the present invention provide a display device that can substantially increase the vertical resolution of a multi-primary-color display panel.

A display device according to a preferred embodiment of the present invention includes a multi-primary-color display panel with multiple subpixels that are arranged in a matrix pattern of columns and rows, wherein if a series of L columns (where L is a natural number that is equal to or greater than two) of subpixels, belonging to those subpixels, are viewed in the column direction, multiple sets of subpixels in first and second different combinations, each set including L subpixels that are arranged in the row direction, are arranged alternately; and a signal converter arranged to convert a video signal, having values that represent the colors of pixels with a matrix pattern, into a multi-primary-color signal for use in the multi-primary-color display panel. The signal converter associates a value of the video signal representing the color of at least one of the pixels on a $p^{th}$ row with values of the multi-primary-color signal corresponding to the luminances of subpixels on $(s-1)^{th}$ and $s^{th}$ rows, and also associates a value of the video signal representing the color of at least one of the pixels on a $(p+1)^{th}$ row with values of the multi-primary-color signal corresponding to the luminances of subpixels on $s^{th}$ and $(s+1)^{th}$ rows.

In one preferred embodiment, the multi-primary-color display panel has a different vertical resolution from the video signal, and the signal converter performs multi-primary-color conversion and vertical resolution conversion on the values of the video signal representing the colors of the pixels such that the values are adapted to the multi-primary-color display panel.

In one preferred embodiment, the video signal has a vertical resolution of 2M that is equal to the number of the rows of pixels. The multi-primary-color display panel has M sets of subpixels in the first combination and M sets of subpixels in the second combination that are arranged alternately in the column direction and also has a nominal vertical resolution of M. And the signal converter converts the video signal with the vertical resolution of 2M into a multi-primary-color signal for use in the multi-primary-color display panel with the nominal vertical resolution of M.

In one preferred embodiment, on a certain column of subpixels belonging to the multiple subpixels of the multi-primary-color display panel, one of the L subpixels included in a set of subpixels in the first combination and one of the L subpixels included in a set of subpixels in the second combination are arranged alternately in the column direction.

In one another preferred embodiment, on a certain row of subpixels belonging to the multiple subpixels of the multi-primary-color display panel, a set of subpixels in either the first or second combination is arranged in the row direction.

In one preferred embodiment, on a certain row of subpixels belonging to the multiple subpixels of the multi-primary-color display panel, the L subpixels, each of which belongs to a set of subpixels in either the first or second combination, are arranged periodically in the row direction.

In one preferred embodiment, the video signal has a horizontal resolution of 2H corresponding with the number of columns of pixels. In a certain row of subpixels belonging to the multiple subpixels of the multi-primary-color display panel, a set of 2H subpixels in either the first or second combination is arranged in the row direction. A value of the video signal representing the colors of a column of pixels is associated with values of the multi-primary-color signal corresponding to the luminances of the L columns of subpixels.

In one preferred embodiment, a value of the video signal representing the color of a pixel at an intersection between a $p^{th}$ row and a $q^{th}$ column is associated with values of the multi-primary-color signal corresponding to the luminances of a series of L subpixels on an $(s-1)^{th}$ row, including a one at an intersection between the $(s-1)^{th}$ row and a $t^{th}$ column, and another series of L subpixels on an $s^{th}$ row, including a one at an intersection between the $s^{th}$ row and the $t^{th}$ column.

In one preferred embodiment, the value of the video signal representing the color of the pixel at the intersection between the $p^{th}$ row and the $q^{th}$ column is associated with values of the multi-primary-color signal corresponding to the luminances of subpixels on $(p-1)^{th}$ and $p^{th}$ rows and on $\{L\times(q-1)+1\}^{th}$ through $(L\times q)^{th}$ columns. And a value of the video signal representing the color of a pixel at an intersection between the $(p+1)^{th}$ row and the $q^{th}$ column is associated with values of the multi-primary-color signal corresponding to the luminances of subpixels on the $p^{th}$ and $(p+1)^{th}$ rows and on the $\{L\times(q-1)+1\}^{th}$ through $(L\times q)^{th}$ columns.

In one preferred embodiment, at least one of subpixels included in each set of subpixels in the first combination displays the same color as at least one of subpixels included in each the set of subpixels in the second combination.

In one preferred embodiment, L=3, each set of subpixels in the first combination includes a first red subpixel, a yellow subpixel and a blue subpixel, and each set of subpixels in the second combination includes a second red subpixel, a green subpixel and a cyan subpixel.

In one preferred embodiment, the video signal has a horizontal resolution of 2H corresponding with the number of columns of pixels. In a certain row of subpixels belonging to the multiple subpixels of the multi-primary-color display panel, a set of H subpixels in either the first or second combination is arranged in the row direction. The multi-primary-color display panel has a nominal horizontal resolution of H. And the signal converter converts the video signal with the horizontal resolution of 2H into a multi-primary-color signal for use in the multi-primary-color display panel with the nominal horizontal resolution of H.

In one preferred embodiment, a value of the video signal representing the color of a pixel at an intersection between a $p^{th}$ row and a $q^{th}$ column is associated with values of the multi-primary-color signal corresponding to the luminances of subpixels on an $(s-1)^{th}$ row, including a one at an intersection between the $(s-1)^{th}$ row and a $t^{th}$ column, and subpixels on an $s^{th}$ row, including a one at an intersection between the $s^{th}$ row and the $t^{th}$ column. A value of the video signal representing the color of a pixel at an intersection between a $(p+1)^{th}$ row and the $q^{th}$ column is associated with values of the multi-primary-color signal corresponding to the luminances of subpixels on the $s^{th}$ row, including one at an intersection between the $s^{th}$ row and the $t^{th}$ column, and subpixels on an $(S+1)^{th}$ row, including one at an intersection between the $(s+1)^{th}$ row and the $t^{th}$ column.

In one preferred embodiment, a value of the video signal representing the color of a pixel at an intersection between a $p^{th}$ row and a $q^{th}$ column is associated with values of the multi-primary-color signal corresponding to the luminances of a series of L subpixels on an $(s-1)^{th}$ row and another series of L subpixels on an $s^{th}$ row. A value of the video signal representing the color of a pixel at an intersection between a $(p+1)^{th}$ row and the $q^{th}$ column is associated with values of the multi-primary-color signal corresponding to the luminances of the series of L subpixels on the $s^{th}$ row and another series of L subpixels on an $(s+1)^{th}$ row.

In one preferred embodiment, a value of the video signal representing the color of a pixel at an intersection between a $p^{th}$ row and a $q^{th}$ column is associated with values of the multi-primary-color signal corresponding to the luminances of less than L subpixels on an $(s-1)^{th}$ row and less than L subpixels on an $s^{th}$ row. A value of the video signal representing the color of a pixel at an intersection between a $(p+1)^{th}$ row and the $q^{th}$ column is associated with values of the multi-primary-color signal corresponding to the luminances of the less than L subpixels on the $s^{th}$ row and less than L subpixels on an $(s+1)^{th}$ row.

In one preferred embodiment, a value of the video signal representing the color of a pixel at an intersection between a $p^{th}$ row and a $q^{th}$ column is associated with values of the multi-primary-color signal corresponding to the luminances of more than L subpixels on an $(s-1)^{th}$ row and more than L subpixels on an $s^{th}$ row. And a value of the video signal representing the color of a pixel at an intersection between a $(p+1)^{th}$ row and the $q^{th}$ column is associated with values of the multi-primary-color signal corresponding to the luminances of the more than L subpixels on the $s^{th}$ row and more than L subpixels on an $(s+1)^{th}$ row.

In one preferred embodiment, the subpixels included in each set of subpixels in the first combination represent a different color from the subpixels included in each set of subpixels in the second combination.

In one preferred embodiment, L=2, each set of subpixels in the first combination includes a red subpixel and a yellow subpixel, and each set of subpixels in the second combination includes a green subpixel and a blue subpixel.

In one preferred embodiment, the video signal is an interlaced signal. In odd-numbered fields, $(s-1)^{th}$ and $s^{th}$ rows of subpixels of the multi-primary-color display panel have luminances that are associated with values of the video signal representing the colors of pixels on a $p^{th}$ row. But in even-numbered fields, the $s^{th}$ and $(s+1)^{th}$ rows of subpixels of the multi-primary-color display panel have luminances that are associated with values of the video signal representing the colors of pixels on a $(p+1)^{th}$ row.

In one preferred embodiment, in each of the odd-numbered and even-numbered fields, $(2w-1)^{th}$ and $2w^{th}$ rows of subpixels have the same polarity but $2w^{th}$ and $(2w+1)^{th}$ rows of subpixels have mutually different polarities. In each of the odd-numbered and even-numbered fields, subpixels that are adjacent to each other in the row direction have mutually different polarities.

In one preferred embodiment, each of the multiple subpixels of the multi-primary-color display panel has its polarity inverted every field.

In one preferred embodiment, the video signal is a progressive signal. The $s^{th}$ row of subpixels of the multi-primary-color display panel exhibit luminances that have been obtained based on values of the video signal representing the colors of pixels on $p^{th}$ and $(p+1)^{th}$ rows.

In one particular preferred embodiment, the signal converter determines the values of the multi-primary-color signal corresponding to the luminances of the $s^{th}$ row of subpixels based on a result of a multi-primary-color conversion that has been performed on the values of the video signal representing the colors of the pixels on the $p^{th}$ and $(p+1)^{th}$ rows.

In one preferred embodiment, at least one of the subpixels included in each set of subpixels in the first combination displays the same color as at least one of the subpixels included in each set of subpixels in the second combination, and the signal converter determines a value corresponding to the luminance of that subpixel that displays the same color among subpixels on an $x^{th}$ row based on a result of a multi-primary-color conversion that has been performed on a value of the video signal representing the colors of pixels on the $x^{th}$ row.

In one preferred embodiment, the signal converter obtains a value representing the colors of a single row of pixels, comprised of two rows of subpixels in the multi-primary-color display panel, based on values of the video signal representing the colors of at least two rows of pixels that are adjacent to each other in the column direction, and subjects the value representing the colors of the single row of pixels to a multi-primary-color conversion, thereby determining the values of the multi-primary-color signal corresponding to the luminances of the two rows of subpixels.

In one preferred embodiment, the signal converter obtains a value representing the colors of a single row of pixels, comprised of $(2w-1)^{th}$ and $2w^{th}$ rows of subpixels in the multi-primary-color display panel, based on values of the video signal representing the colors of $(2w-2)^{th}$, $(2w-1)^{th}$ and $2w^{th}$ rows of pixels, and subjects the value representing the colors of the single row of pixels to a multi-primary-color conversion, thereby determining the values of the multi-primary-color signal corresponding to the luminances of the $(2w-1)^{th}$ and $2w^{th}$ rows of subpixels.

A signal converter according to a preferred embodiment of the present invention is designed to generate a multi-primary-color signal for use in a multi-primary-color display panel having multiple subpixels that are arranged in a matrix pattern of columns and rows, based on a video signal having values representing the colors of pixels that are arranged in a matrix pattern. If a series of L columns of subpixels, belonging to those subpixels, are viewed in the column direction, multiple sets of subpixels in first and second different combinations, each set including L subpixels that are arranged in the row direction, are arranged alternately. The signal converter associates a value of the video signal representing the color of at least one of the pixels on a $p^{th}$ row with values of the multi-primary-color signal corresponding to the luminances of subpixels on $(s-1)^{th}$ and $s^{th}$ rows, and also associates a value of the video signal representing the color of at least one of the pixels on a $(p+1)^{th}$ row with values of the multi-primary-color signal corresponding to the luminances of subpixels on $s^{th}$ and $(s+1)^{th}$ rows.

Preferred embodiments of the present invention provide a display device that can substantially increase the vertical resolution of a multi-primary-color display panel.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIGS. 10A-10C schematically shows how respective subpixels of the multi-primary-color display panel change their polarities in the display device of the first preferred embodiment, wherein FIG. 10A is a schematic representation showing the polarities of respective subpixels in an odd-numbered field, FIG. 10B is a schematic representation showing the polarities of respective subpixels in a situation where two rows of subpixels, corresponding to a single pixel on which a write operation is going to be performed, have the same polarity in an even-numbered field, and FIG. 10C is a schematic representation showing the polarities of respective subpixels in a situation where two rows of subpixels, corresponding to a single pixel on which a write operation is going to be performed, have mutually different polarities in an even-numbered field.

FIG. 31A is a table showing various arrangements of subpixels, their luminance ratios and the biggest differences between them in the display device of the eighth preferred embodiment, and FIG. 31B is a table showing the luminance ratios and the biggest difference between them in three-primary-color display devices including the comparative display device.

FIGS. 32A and 32B are schematic representations illustrating arrangements of subpixels in conventional multi-primary-color display panels.

FIGS. 33A and 33B are schematic representations illustrating multiple pixels in conventional multi-primary-color display panels.

DETAILED DESCRIPTION OF THE PREFERRED EMBODIMENTS

Preferred Embodiment 1

Hereinafter, a first preferred embodiment of a display device according to the present invention will be described.

Figure 1:
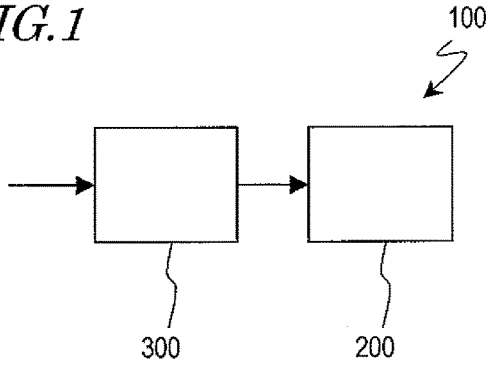
FIG. 1 is a schematic representation illustrating a first preferred embodiment of a display device according to the present invention.

FIG. 1 schematically illustrates a display device 100 as a preferred embodiment of the present invention. The display device 100 includes a multi-primary-color display panel 200, in which N types of subpixels (where N=2×L and L is a natural number that is equal to or greater than two) are arranged in a matrix pattern, and a signal converter 300 for converting a video signal into a multi-primary-color signal for use in the multi-primary-color display panel 200. In this example, the multi-primary-color display panel 200 may be an LCD panel and the display device (multi-primary-color display device) 100 may be an LCD, for example.

Figure 2:
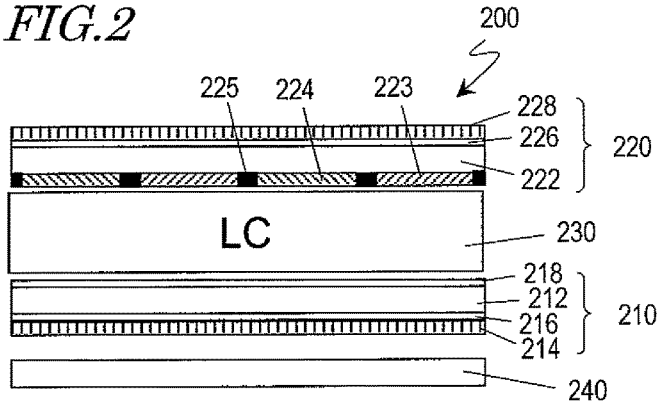
FIG. 2 is a schematic cross-sectional view illustrating the structure of a multi-primary-color display panel in the display device of the first preferred embodiment of the present invention.

FIG. 2 is a cross-sectional view schematically illustrating the structure of the multi-primary-color display panel 200, which includes an active-matrix substrate 210, a counter substrate 220, a liquid crystal layer 230 sandwiched between these two substrates 210 and 220, and a backlight 240 (such as an LED light source, for example).

The active-matrix substrate 210 includes a glass substrate 212, a polarizer 214 arranged outside of the glass substrate 212, a phase plate 216, and a transparent electrode 218 arranged inside of the glass substrate 212. The transparent electrode 218 is made of a transparent conductor such as ITO.

The counter substrate 220 includes a glass substrate 222, a color filter layer 223 arranged inside of the glass substrate 222, and a phase plate 226 and a polarizer 228 that are arranged outside of the glass substrate 222. The color filter layer 223 includes color filters 224, which are provided for the respective subpixels, and a black matrix (BM) 225, which is arranged to fill the gaps between adjacent color filters 224. Each of the color filters 224 transmits light with a particular wavelength and cuts off light with any other wavelength. The phase plates 216 and 226 adjust the polarization state of the light. And each of the polarizers 214 and 228 transmits light with predetermined polarization components.

Figure 3:
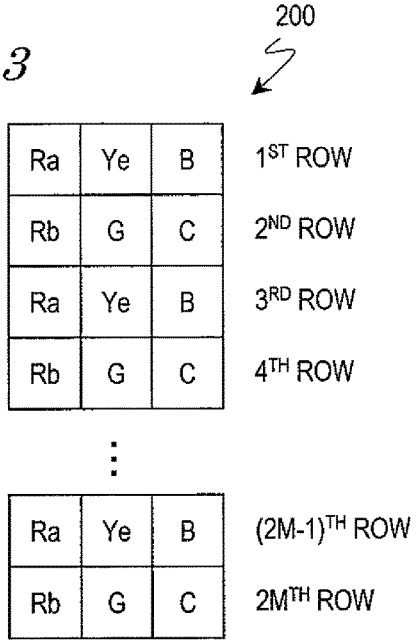
FIG. 3 is a schematic representation illustrating the arrangement of subpixels in the multi-primary-color display panel that are associated with a single column of pixels in a video signal in the display device of the first preferred embodiment of the present invention.

FIG. 3 illustrates the arrangement of multiple subpixels in the multi-primary-color display panel 200. Specifically, the arrangement of subpixels shown in FIG. 3 corresponds to a single column of pixels. The multi-primary-color display panel 200 has six different types of subpixels, namely, red subpixels Ra, green subpixels G, blue subpixels B, yellow subpixels Ye, cyan subpixels C and another red subpixels Rb. In the following description, each of the red subpixels Ra will be referred to herein as "a first red subpixel" and each of the red subpixels Rb "a second red subpixel", respectively.

In this preferred embodiment, the second red subpixels Rb are fabricated in the same way, and have the same hue and same chroma, as the first red subpixels Ra. That is why the number of primary colors for use in this multi-primary-color display panel 200 can be said to be five. However, the second red subpixels Rb are connected to different scan lines (not shown) from the first red subpixels Ra, and the first and second red subpixels Ra and Rb are controlled independently of each other. For that reason, it can also be said that this multi-primary-color display panel 200 has six different types of subpixels, and therefore, N=6 and L=3.

Red, green and blue are generally called the "three primary colors of light", while yellow, cyan and magenta the "three primary colors of colors". A normal multi-primary-color display panel with the pixel structure shown in FIG. 32A or 32B has six different types of subpixels corresponding to those three primary colors of light and those three primary colors of colors, respectively. On the other hand, this multi-primary-color display panel 200 has a subpixel corresponding to another color red in place of a magenta subpixel, and therefore, has the following advantages as disclosed in Japanese Patent Application No. 2005-274510.

If the number of primary colors for use to conduct a display operation is increased, the number of subpixels per pixel increases. As a result, the area of each subpixel should decrease, so does the lightness of the color represented by that subpixel (which corresponds to the Y value of the XYZ color system). For example, if the number of primary colors for use for display purposes is increased from three to six, the area of each subpixel will decrease to approximately a half, so will the lightness (or Y value) thereof. The "lightness", as well as the "hue" and the "chroma", is one of the three major factors that define the color. By increasing the number of primary colors used, the color reproduction range (defined by the reproducible "hue" and "chroma" ranges) will expand on the xy chromaticity diagram. But if the "lightness" decreases, the actual color reproduction range (i.e., a color reproduction range including the "lightness") cannot be sufficiently broad. If the area of the red subpixel were decreased, among other things, then the color red would have a decreased Y value. Consequently, the multi-primary-color display panel with the pixel structure shown in FIG. 32A or 32B could display only dark colors red and could not represent the red of the object colors well enough.

On the other hand, in the multi-primary-color display panel 200 of the display device 100 of this preferred embodiment, two out of the six types of subpixels (i.e., the first and second red subpixels Ra and Rb) display the color red. That is why compared to the multi-primary-color display panel with the pixel structure shown in FIG. 32A or 32B, the multi-primary-color display panel 100 can increase the lightness (i.e., the Y value) of the color red and can display a lighter color red. As a result, the color reproduction range, including not just the hue and chroma ranges on the xy chromaticity diagram but also the lightness range, can be broadened. Although the multi-primary-color display panel 200 has no magenta subpixels, the color magenta of an object color can be reproduced well enough by mixing together the colors represented by the first and second red subpixels Ra and Rb and the blue subpixel B.

If the subpixels arranged on the multi-primary-color display panel 200 shown in FIG. 3 are viewed in the row direction, it can be seen that three types of subpixels, namely, a first red subpixel Ra, a yellow subpixel Ye and a blue subpixel B, are arranged in the row direction and then the three other types of subpixels, namely, a second red subpixel Rb, a green subpixel G and a cyan subpixel C, are arranged in the row direction so as to be adjacent to the former set of the three subpixels in the column direction. In the following description, the first red subpixel Ra, yellow subpixel Ye and blue subpixel B will be sometimes referred to herein as a "set of subpixels in a first combination" and the second red subpixel Rb, green subpixel G and cyan subpixel C will be sometimes referred to herein as a "set of subpixels in a second combination".

Meanwhile, if the subpixels arranged in the multi-primary-color display panel 200 are viewed in the column direction, it can be seen that M sets of subpixels in the first combination and M sets of subpixels in the second combination are arranged alternately. That is to say, it can be seen that this multi-primary-color display panel 200 has 2M rows of subpixels in total. In this multi-primary-color display panel 200, six subpixels, comprised of the respective types of subpixels that are arranged continuously on two adjacent rows, form a single pixel. That is why the multi-primary-color display panel 200 has a nominal vertical resolution of M. For example, if the multi-primary-color display panel 200 has 1,080 rows of subpixels (i.e., if M=540), then it has a nominal vertical resolution of 540.

On the other hand, if the subpixels arranged in this multi-primary-color display panel 200 are viewed in the row direction, it can be seen that a set of 2H subpixels are arranged in either the first combination or the second combination. Thus, this multi-primary-color display panel 200 has a horizontal resolution of 2H.

It should be noted that these six types of subpixels could be implemented by defining subpixel regions in a matrix pattern on the color filter layer (not shown) of the multi-primary-color display panel 200 and arranging color filters associated with the respective subpixel regions there. Also, these subpixels are defined by subpixel electrodes (not shown), which are arranged so as to face a counter electrode with a liquid crystal layer interposed between them. Furthermore, although not shown in FIG. 3, subpixels on the same column are connected to the same signal line, while subpixels on the same row are connected to the same scan line. When a scan line is selected, a display signal voltage supplied to a signal line is applied to the associated subpixel electrode, thereby controlling the luminance of the subpixel. In FIG. 3, only the arrangement of subpixels for a single column of pixels is illustrated as a typical one. However, the subpixels for any other column of pixels are also arranged just as shown in FIG. 3.

Now look at FIG. 1 again. A video signal has a value representing the colors of the pixels that are arranged in a matrix pattern with arbitrary color coordinates. The signal converter 300 gets signal conversion done such that a value of the video signal representing the color of a single pixel is associated with a value of the multi-primary-color signal corresponding to the luminances of subpixels in two rows and three columns, and such that a value of the video signal representing the colors of a single column of pixels is associated with a value of the multi-primary-color signal corresponding to the luminances of predetermined L columns of subpixels.

Figure 4:
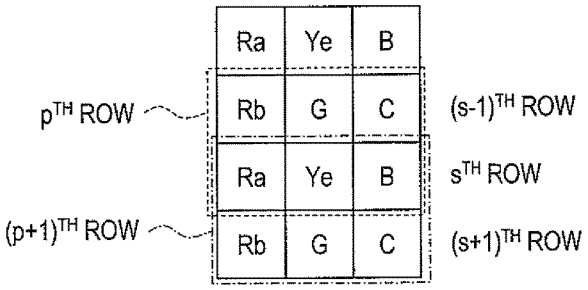
FIG. 4 is a schematic representation showing correspondence between pixels in a video signal and subpixels in a multi-primary-color signal in the display device of the first preferred embodiment of the present invention.

FIG. 4 illustrates a correspondence between pixels of the video signal and subpixels of the multi-primary-color signal in the display device 100 of this preferred embodiment. As shown in FIG. 4, a pixel on a $p^{th}$ row of the video signal is associated with $(s-1)^{th}$ and $s^{th}$ rows of subpixels of the multi-primary-color signal. On the other hand, a pixel on a $(p+1)^{th}$ row of the video signal is associated with $s^{th}$ and $(s+1)^{th}$ rows of subpixels of the multi-primary-color signal. In this manner, the display device 100 of this preferred embodiment performs a display operation using some subpixels in common for multiple pixels of the video signal that are adjacent to each other in the column direction, thereby increasing the substantial vertical resolution of the multi-primary-color display panel 200. It should be noted that in the multi-primary-color display panel 200 of this example, a single pixel is comprised of subpixels in three columns and that the horizontal resolution of the multi-primary-color display panel 200 is equal to that of a display panel for representing the three primary colors by arranging subpixels in one row and three columns.

In the display device 100 shown in FIG. 1, the signal converter 300 associates a value of the video signal representing the color of a pixel on the $p^{th}$ row with values of the multi-primary-color signal corresponding to the luminances of the $(s-1)^{th}$ and $s^{th}$ rows of subpixels and also associates a value of the video signal representing the color of a pixel on the $(p+1)^{th}$ row with values of the multi-primary-color signal corresponding to the luminances of the $s^{th}$ and $(s+1)^{th}$ rows of subpixels.

For example, the signal converter 300 may associate a value of the video signal representing the colors of a pixel on the second row with values of the multi-primary-color signal corresponding to the luminances of the second and third rows of subpixels and also associates a value of the video signal representing the color of a pixel on the third row with values of the multi-primary-color signal corresponding to the luminances of the third and fourth rows of subpixels. In that case, the luminances of the third row of subpixels are set based on the values of the video signal representing the colors of the pixels on the second and third rows. In this manner, the luminances of a single row of subpixels are set based on values of the video signal representing the colors of pixels on two rows that are adjacent to each other in the column direction.

Also, if a given video signal complies with the 1080I standard, the video signal is compatible with a display panel with 1,920×1,080 pixels, i.e., 1,080 rows of pixels. The signal converter 300 converts the 1080I video signal into a multi-primary-color signal for use in the multi-primary-color display panel 200, of which the subpixels are arranged in 1,080 rows (i.e., which has a nominal resolution of 540).

Figure 5:
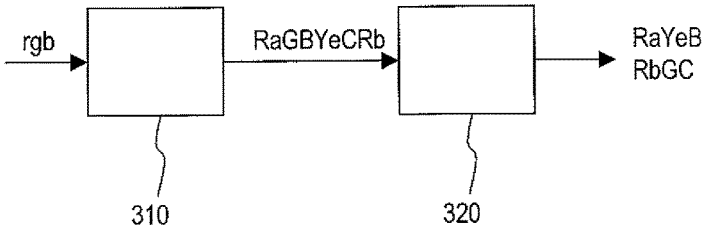
FIG. 5 is a block diagram illustrating a configuration for a signal converter in the display device of the first preferred embodiment of the present invention.

FIG. 5 illustrates a configuration for a signal converter 300 that converts a video signal into a multi-primary-color signal. The signal converter 300 includes a multi-primary-color converter 310 and a resolution converter 320. In this case, the value of the video signal is preferably rgb representing the colors of pixels with color coordinates RGB. Specifically, the value rgb collectively indicates the luminance values (or luminance levels) r, g and b corresponding to the luminances of the three primary colors of red, green and blue that are obtained by subjecting grayscale values to an inverse gamma correction.

The multi-primary-color converter 310 obtains values Ra, G, B, Ye, C and Rb based on the value rgb. In FIG. 5, these values Ra, G, B, Ye, C and Rb are collectively indicated as a single value RaGBYeCRb. The respective values Ra, G, B, Ye, C and Rb are luminance values (or luminance levels) corresponding to the luminances of the six types of subpixels. To conduct a display operation in multiple primary colors, the multi-primary-color converter 310 converts the value rgb, which is represented by the video signal as a three-dimensional value, into the value RaGBYeCRb. Such a conversion will be referred to herein as "multi-primary-color conversion". The colors specified by the value RaGBYeCRb are basically the same as, but could be different if necessary from, the ones specified by the value rgb.

The luminance values r, g and b each fall within the range of the lowest grayscale (e.g., the $0^{th}$ grayscale) to the highest grayscale (e.g., the $255^{th}$ grayscale). If the video signal is compliant with the BT. 709 standard, a luminance value associated with the lowest grayscale is "0.0", a luminance value associated with the highest grayscale is "1.0", and the luminance values r, g and b fall within the range of "0.0" to "1.0". Meanwhile, the values Ra, G, B, Ye, C and Rb also each fall within the range of "0.0" through "1.0".

For example, if the color of a pixel is black, the luminance values r, g and b are all "0.0", so are all of the values Ra, G, B, Ye, C and Rb. Conversely, if the color of a pixel is white, the luminance values r, g and b are all "1.0", so are all of the values Ra, G, B, Ye, C and Rb. It should be noted that nowadays TV sets are often designed to allow the user to adjust the color temperature. In that case, the color temperature is adjusted by finely adjusting the luminances of the respective subpixels. For that reason, in this example, every value after the color temperature has been adjusted into a desired one is preferably "1.0".

The resolution converter 320 converts the resolution adaptively to that of the multi-primary-color display panel 200. In this example, the resolution converter 320 converts the vertical resolution into that of the multi-primary-color display panel 200. The video signal is preferably compatible with a display panel with 2M rows of pixels even without going through any signal conversion. The video signal has a vertical resolution of 2M, while the multi-primary-color display panel 200 has a nominal vertical resolution of M. However, the resolution converter 320 generates a multi-primary-color signal that is adapted to the multi-primary-color display panel 200. When the multi-primary-color signal is supplied to the multi-primary-color display panel 200, the respective subpixels of the multi-primary-color display panel 200 have luminances corresponding to the luminance values specified by the multi-primary-color signal. It should be noted that the video signal has a horizontal resolution of 2H.

In the display device 100 of this preferred embodiment, the video signal is an interlaced signal that is compliant with the interlace driving technique. In this video signal, each single frame is comprised of odd-numbered field periods associated with odd-numbered rows (i.e., the first, third, fifth, . . . and $(2M-1)^{th}$ rows) of pixels and even-numbered field periods associated with even-numbered rows (i.e., the second, fourth, sixth, . . . and $2M^{th}$ rows) of pixels.

Hereinafter, it will be described with reference to FIGS. 6 through 9 how the respective subpixels change their luminances in the display device 100 of this preferred embodiment.

Figure 6:
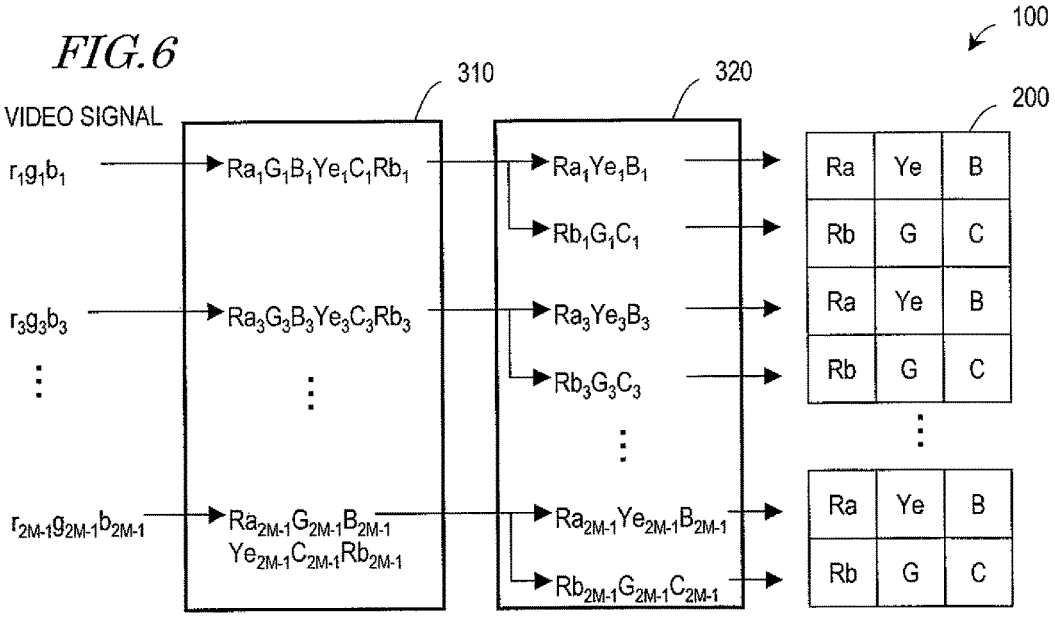
FIG. 6 is a schematic representation showing the luminance values of respective subpixels of a multi-primary-color display panel in an odd-numbered field in the display device of the first preferred embodiment of the present invention.

First of all, it will be described with reference to FIG. 6 what luminances respective subpixels of the multi-primary-color display panel 200 have in odd-numbered fields. In this example, $r_x g_x b_x$ is a value of the video signal representing the color of a pixel on an $x^{th}$ row and the values $r_x$, $g_x$ and $b_x$ respectively represent the red, green and blue luminance values (or luminance levels) of the pixel on the $x^{th}$ row. As shown in FIG. 6, the value $r_1g_1b_1$ of the video signal represents the color of a pixel on the first row, the value $r_3g_3b_3$ represents the color of a pixel on the third row, and the value $r_{2M-1}g_{2M-1}b_{2M-1}$ represents the color of a pixel on the $(2M-1)^{th}$ row. In this manner, a value $r_{2u-1}g_{2u-1}b_{2u-1}$ (where u is a natural number falling within the range of 1 to M) represents the color of a pixel on an odd-numbered row in the video signal.

The multi-primary-color converter 310 obtains a value $Ra_{2u-1}G_{2u-1}B_{2u-1}Ye_{2u-1}C_{2u-1}Rb_{2u-1}$ based on the value $r_{2u-1}g_{2u-1}b_{2u-1}$. To obtain the value $Ra_{2u-1}G_{2u-1}B_{2u-1}Ye_{2u-1}C_{2u-1}Rb_{2u-1}$, the multi-primary-color converter 310 may consult a lookup table, carry out calculations by a predetermined equation, or do both of these in combination.

Among the values $Ra_{2u-1}$, $G_{2u-1}$, $B_{2u-1}$, $Ye_{2u-1}$, $C_{2u-1}$, and $Rb_{2u-1}$, the resolution converter 320 determines the luminance values of the first red, yellow and blue subpixels on the $(2u-1)^{th}$ row of the multi-primary-color signal in odd-numbered fields to be $Ra_{2u-1}$, $Ye_{2u-1}$ and $B_{2u-1}$, respectively, and also determines the luminance values of the second red, green and cyan subpixels on the $2u^{th}$ row to be $Rb_{2u-1}$, $G_{2u-1}$ and $C_{2u-1}$, respectively. In this manner, even though the video signal is an interlaced signal, the signal converter 300 can still determine the luminance values of both odd- and even-numbered rows of subpixels of the multi-primary-color signal within one field.

Specifically, the multi-primary-color converter 310 obtains a value $Ra_1G_1B_1Ye_1C_1Rb_1$ based on the luminance value $r_1g_1b_1$ and the resolution converter 320 determines the luminance values of the first red, yellow and blue subpixels on the first row to be $Ra_1$, $Ye_1$ and $B_1$, respectively, and also determines the luminance values of the second red, green and cyan subpixels on the second row to be $Rb_1$, $G_1$ and $C_1$, respectively. As described above, in this preferred embodiment, the first and second red subpixels have the same property and $Ra_1$ and $Rb_1$ are the same value.

In the same way, the multi-primary-color converter 310 obtains a value $Ra_3G_3B_3Ye_3C_3Rb_3$ based on the luminance value $r_3g_3b_3$ and the resolution converter 320 determines the luminance values of the first red, yellow and blue subpixels on the third row in an odd-numbered field to be $Ra_3$, $Ye_3$ and $B_3$, respectively, and also determines the luminance values of the second red, green and cyan subpixels on the fourth row to be $Rb_3$, $G_3$ and $C_3$, respectively. Similarly, the multi-primary-color converter 310 obtains a value $Ra_{2M-1}G_{2M-1}B_{2M-1}Ye_{2M-1}C_{2M-1}Rb_{2M-1}$ based on a luminance value $r_{2M-1}g_{2M-1}b_{2M-1}$ and the resolution converter 320 determines the luminance values of the first red, yellow and blue subpixels on the $(2M-1)^{th}$ row in an odd-numbered field to be $Ra_{2M-1}$, $Ye_{2M-1}$ and $B_{2M-1}$, respectively, and also determines the luminance values of the second red, green and cyan subpixels on the $2M^{th}$ row to be $Rb_{2M-1}$, $G_{2M-1}$ and $C_{2M-1}$, respectively.

Figure 7:
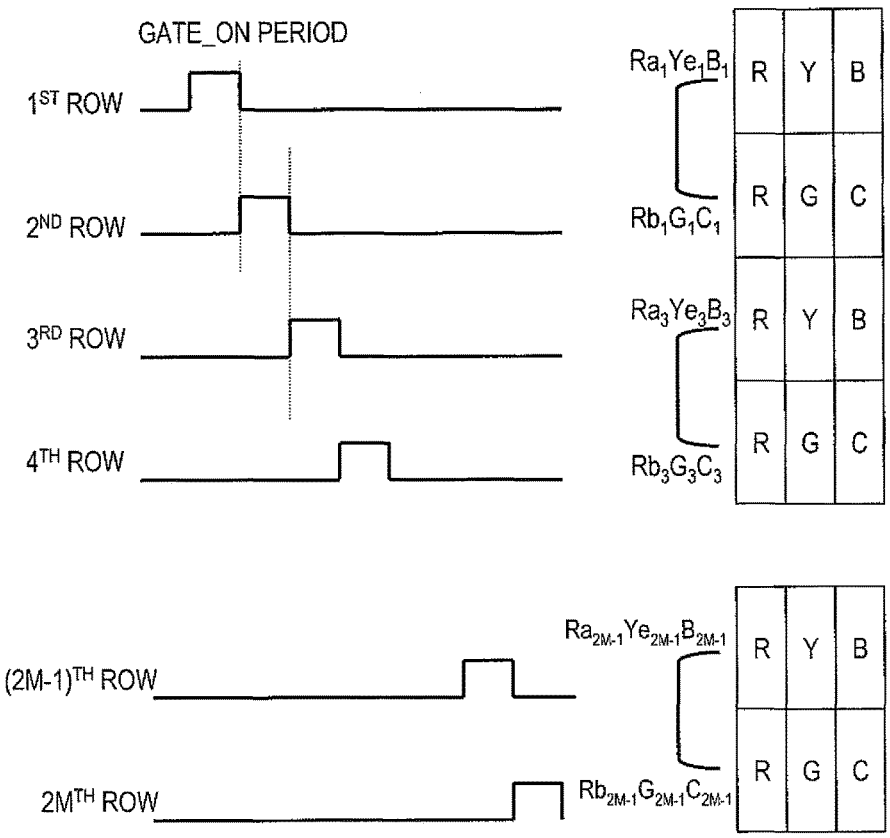
FIG. 7 is a schematic representation showing a relationship between a horizontal sync signal and scan signals in the display device of the first preferred embodiment of the present invention.

FIG. 7 shows relationships between a horizontal synchronizing signal (HS) and scan signals. As shown in FIG. 7, each of the scan signals goes high for a GATE_ON period, which is approximately as long as one horizontal scanning period, once in a field but stays low in the other periods. When a scan signal is high, subpixels that are connected to its associated scan line are charged by way of a signal line. The scan signals sequentially go high from the first row through the $2M^{th}$ row. As a result, the respective pixels of the multi-primary-color display panel 200 are sequentially turned ON from the subpixels on the first row to exhibit luminances represented by the luminance values of the multi-primary-color signal.

Figure 8:
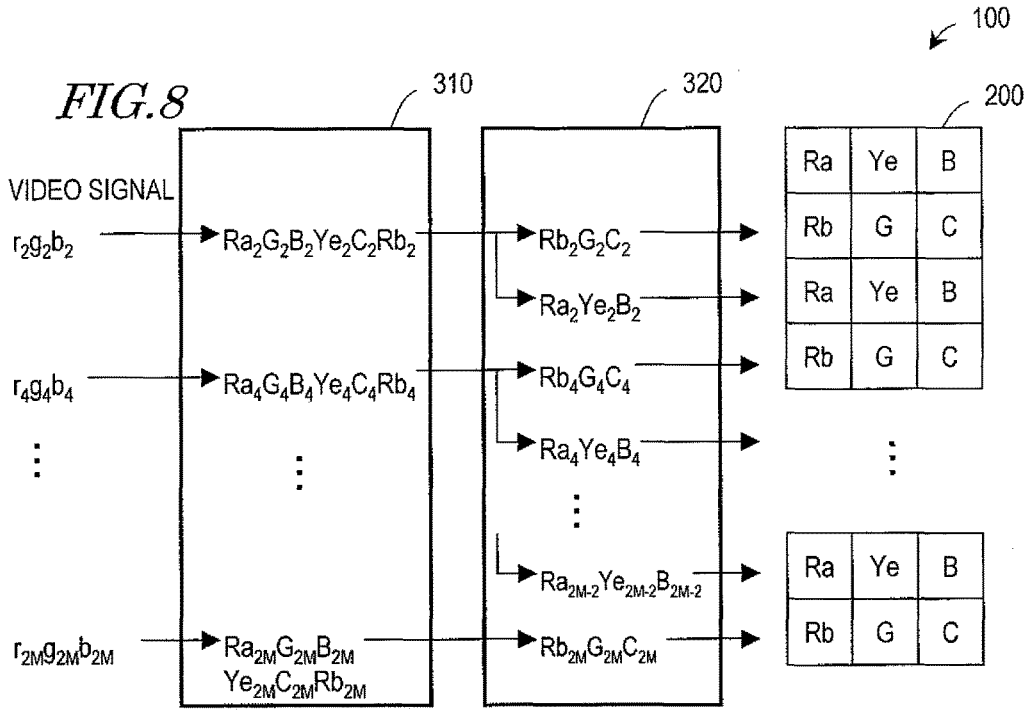
FIG. 8 is a schematic representation showing the luminance values of respective subpixels of the multi-primary-color display panel in an even-numbered field in the display device of the first preferred embodiment of the present invention.

Next, it will be described with reference to FIG. 8 what luminances respective subpixels of the multi-primary-color display panel 200 have in even-numbered fields. In FIG. 8, the value $r_2g_2b_2$ of the video signal represents the color of a pixel on the second row, the value $r_4g_4b_4$ represents the color of a pixel on the fourth row, and the value $r_{2M}g_{2M}b_{2M}$ represents the color of a pixel on the $2M^{th}$ row. In this manner, a value $r_{2v}g_{2v}b_{2v}$ represents the color of a pixel on an even-numbered row in the video signal.

The multi-primary-color converter 310 obtains a value $Ra_{2v}G_{2v}B_{2v}Ye_{2v}C_{2v}Rb_v$ (where v is a natural number falling within the range of one through M−1) based on the value $r_{2v}g_{2v}b_{2v}$. This multi-primary-color conversion can be done in the same way as in an odd-numbered field. Among the values $Ra_{2v}$, $G_{2v}$, $B_{2v}$, $Ye_{2v}$, $C_{2v}$, and $Rb_{2v}$, the resolution converter 320 determines the luminance values of the second red, green and cyan subpixels on the $2v^{th}$ row in even-numbered fields to be $Rb_{2v}$, $G_{2v}$ and $C_{2v}$, respectively, and also determines the luminance values of the first red, yellow and blue subpixels on the $(2v+1)^{th}$ row to be $Ra_2v$, $Ye_{2v}$ and $B_{2v}$, respectively. Specifically, the multi-primary-color converter 310 obtains a value $Ra_2G_2B_2Ye_2C_2Rb_2$ based on the value $r_2g_2b_2$ and the resolution converter 320 determines the luminance values of the second red, green and cyan subpixels on the second row to be $Rb_2$, $G_2$ and $C_2$, respectively, and also determines the luminance values of the first red, yellow and blue subpixels on the third row to be $Ra_2$, $Ye_2$ and $B_2$, respectively. In the same way, the multi-primary-color converter 310 obtains a value $Ra_4G_4B_4Ye_4C_4Rb_4$ based on the value $r_4g_4b_4$ and the resolution converter 320 determines the luminance values of the second red, green and cyan subpixels on the fourth row in an even-numbered field to be $Rb_4$, $G_4$ and $C_4$, respectively, and also determines the luminance values of the first red, yellow and blue subpixels on the fifth row to be $Ra_4$, $Ye_4$ and $B_4$, respectively.

As in the odd-numbered fields shown in FIG. 7, the scan signals also go high sequentially in the even-numbered fields from the first row through the $2M^{th}$ row. In this example, the field frequency is 60 Hz and the frame frequency is 30 Hz.

Figure 9:
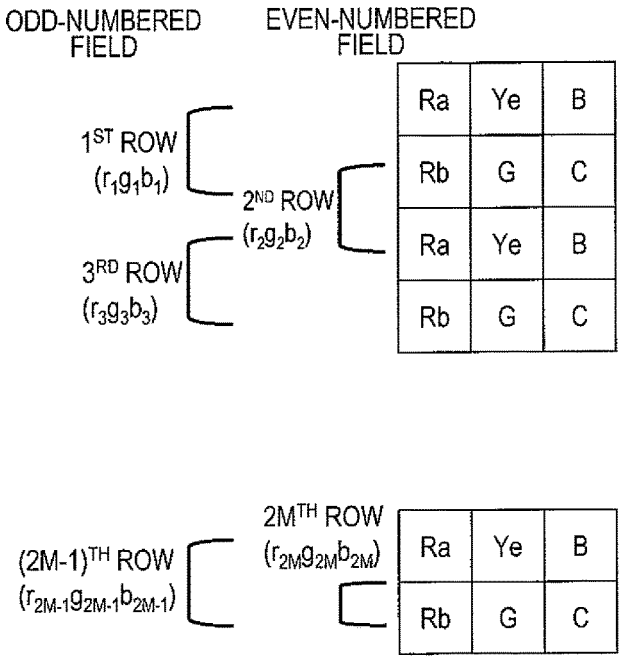
FIG. 9 is a schematic representation showing how respective subpixels of the multi-primary-color display panel change their luminance values within one frame in the display device of the first preferred embodiment of the present invention.

FIG. 9 shows how the respective subpixels change their luminances during one frame. In FIG. 9, the value $r_xg_xb_x$ also represents the color of a pixel on an $x^{th}$ row in the video signal.

As already described with reference to FIG. 6, in odd-numbered fields, the luminance values of the $(2u-1)^{th}$ and $2u^{th}$ rows of subpixels are determined based on a value $r_{2u-1}g_{2u-1}b_{2u-1}$ of the video signal representing the color of a pixel on the $(2u-1)^{th}$ row. Specifically, based on a value $r_1g_1b_1$ of the video signal representing the color of a pixel on the first row, the luminance values of the first red, yellow and blue subpixels on the first row are determined to be $Ra_1$, $Ye_1$ and $B_1$, and those of the second red, green and cyan subpixels on the second row are determined to be $Rb_1$, $G_1$ and $C_1$, respectively. Also, based on a value $r_3g_3b_3$ representing the color of a pixel on the third row, the luminance values of the first red, yellow and blue subpixels on the third row are determined to be $Ra_3$, $Ye_3$ and $B_3$, and those of the second red, green and cyan subpixels on the fourth row are determined to be $Rb_3$, $G_3$ and $C_3$, respectively.

As already described with reference to FIG. 8, in even-numbered fields, the luminance values of the $2v^{th}$ and $(2v+1)^{th}$ rows of subpixels are determined based on a value $r_{2v}g_{2v}b_{2v}$ of the video signal representing the color of a pixel on the $2v^{th}$ row. Specifically, based on a value $r_2g_2b_2$ of the video signal representing the color of a pixel on the second row, the values corresponding to the luminances of the second red, green and cyan subpixels on the second row are determined to be the luminance values $Rb_2$, $G_2$ and $C_2$, and the values corresponding to the luminances of the first red, yellow and blue subpixels on the third row are determined to be the luminance values $Ra_2$, $Ye_2$ and $B_2$, respectively. As a result, the luminance values of the second row of subpixels change from $Rb_1G_1C_1$ into $Rb_2G_2C_2$ and the luminance values of the third row of subpixels change from $Ra_3Ye_3B_3$ into $Ra_2Ye_2B_2$.

Also, based on a value $r_4g_4b_4$ representing the color of a pixel on the fourth row, the values corresponding to the luminances of the second red, green and cyan subpixels on the fourth row are determined to be the luminance values $Rb_4$, $G_4$ and $C_4$, and the values corresponding to the luminances of the first red, yellow and blue subpixels on the fifth row are determined to be the luminance values $Ra_4$, $Ye_4$ and $B_4$, respectively. As a result, the luminance values of the fourth row of subpixels change from $Rb_3G_3C_3$ into $Rb_4G_4C_4$ and the luminance values of the fifth row of subpixels change from $Ra_5Ye_5B_5$ into $Ra_4Ye_4B_4$.

It should be noted that the luminance values of the first row of subpixels remain the same in even-numbered fields as in the odd-numbered fields. Specifically, the luminance values $Ra_1$, $Ye_1$ and $B_1$, obtained by subjecting the value $r_1g_1b_1$ representing the color of a pixel on the first row to a multi-primary-color conversion, do not change. The luminance values of the second red, green and cyan subpixel on a $2M^{th}$ row are determined to be $Rb_{2M}$, $G_{2M}$ and $C_{2M}$, respectively, based on a value $r_{2M}g_{2M}b_{2M}$ representing the color of a pixel on the $2M^{th}$ row in the video signal. As a result, the luminance values of the subpixels on the $2M^{th}$ row change from $Rb_{2M-1}G_{2M-1}C_{2M-1}$ into $Rb_{2M}G_{2M}C_{2M}$.

As described above, the video signal has a vertical resolution of 2M. And in the multi-primary-color display panel 200, the subpixels are arranged in 2M rows and each pixel is comprised of subpixels arranged in two rows. That is why the multi-primary-color display panel 200 has a nominal vertical resolution of M. Consequently, the nominal resolution of the multi-primary-color display panel 200 is a half as high as that of the video signal.

However, the display device 100 of this preferred embodiment conducts a display operation on the basis of each pixel comprised of the $(2u-1)^{th}$ and $2u^{th}$ rows of subpixels (e.g., on the first and second rows of subpixels, on the third and fourth rows of subpixels and so on) in odd-numbered fields. On the other hand, in even-numbered fields, the display device 100 of this preferred embodiment conducts a display operation on the basis of each pixel comprised of the $2v^{th}$ and $(2v+1)^{th}$ rows of subpixels (e.g., on the second and third rows of subpixels, on the fourth and fifth rows of subpixels and so on). That is to say, a pixel that functions as a unit of display in even-numbered fields shares some of the subpixels that form a pixel as a unit of display in odd-numbered fields. As a result, in both of the odd-numbered and even-numbered fields, each pixel is comprised of subpixels of the first and second combinations that are adjacent to each other in the column direction. However, the combination of subpixels that form a pixel in even-numbered fields is different from that of subpixels that form a pixel in odd-numbered fields. Thus, this multi-primary-color display panel 200 uses regions, which are not quite the same spatially, as a unit of display for each pixel of the video signal. As a result, the vertical resolution of the multi-primary-color display panel 200 can be increased substantially and the decrease in vertical resolution that would otherwise be caused by the use of an increased number of primary colors can be minimized.

As described above, the display device 100 of this preferred embodiment conducts a display operation using a pixel that is comprised of the different subpixels on a field-by-field basis, thus increasing the substantial vertical resolution of the multi-primary-color display panel 200 and performing a display operation with even higher resolution. Also, by inputting the multi-primary-color signal to a driver (not shown) that supplies a data signal and a scan signal to the signal lines and scan lines, the multi-primary-color display operation can be performed without changing the drivers.

In addition, the display device 100 of this preferred embodiment uses yellow and cyan as additional primary colors and therefore can increase the transmittance of a single pixel compared to a three-primary-color display device. Also, by substituting color filters for the multiple primary colors without changing the arrangement of thin-film transistors (TFTs) and other components, a multi-primary-color display panel 200 can be fabricated without significantly changing the manufacturing process of a normal three-primary-color display panel.

It should be noted that a CRT TV monitor that conducts an impulse display operation in principle normally uses an interlaced signal as it is to get the display operation done. When an ordinary interlaced signal is used, one frame of the video is presented by switching odd- and even-numbered fields every 1/60 seconds. As for a flat-panel display (FPD) such as an LCD TV monitor or a PDP that conducts a hold display operation in principle, if an interlaced signal were used as it is, then the image presented on the screen would flicker. That is why an FPD is not suited to the interlace driving technique. For that reason, an FPD normally conducts a display operation by converting an interlaced signal into a progressive signal (which is called an "I/P conversion"). Such an I/P converter is often included in an image processing chip and would increase the overall cost. On the other hand, the display device 100 of this preferred embodiment uses the signal converter 300 in place of such an I/P converter, thus preventing the substantial increase in cost eventually. On top of that, since video substantially having high resolution can be presented without increasing the nominal resolution of a multi-primary-color display panel, the decrease in aperture ratio can be minimized, too.

The first and second red subpixels Ra and Rb preferably have a dominant wavelength of 615 nm to 635 nm, the green subpixel G preferably has a dominant wavelength of 520 nm to 550 nm, and the blue subpixel B preferably has a dominant wavelength of 470 nm or less. Also, the yellow subpixel Ye preferably has a dominant wavelength of 565 nm to 580 nm and the cyan subpixel C preferably has a dominant wavelength of 475 nm to 500 nm.

Next, the polarities of respective subpixels in the display device 100 of this preferred embodiment will be described. As used herein, the "polarity" means the direction of an electric field between a subpixel electrode and the counter electrode. In the following description, the "first polarity" refers to a situation where the potential is higher at the subpixel electrode than at the counter electrode and the electric field is directed from the subpixel electrode toward the counter electrode. On the other hand, the "second polarity" refers to a situation where the potential is lower at the subpixel electrode than at the counter electrode and the electric field is directed from the counter electrode toward the subpixel electrode.

If the same image continued to be presented for a long time while a DC voltage component is still left in the voltage applied to a pixel, then that image that has been presented for such a long time would remain on the screen even when the images to present are changed after that. As a result, a so-called "residual image" is produced. To prevent such a residual image from being produced, a liquid crystal display device inverts the polarity. Normally, the polarity is inverted by a driver (not shown) on a pixel-by-pixel basis while a write operation is being performed on a pixel.

Figures 10A, 10B, 10C:
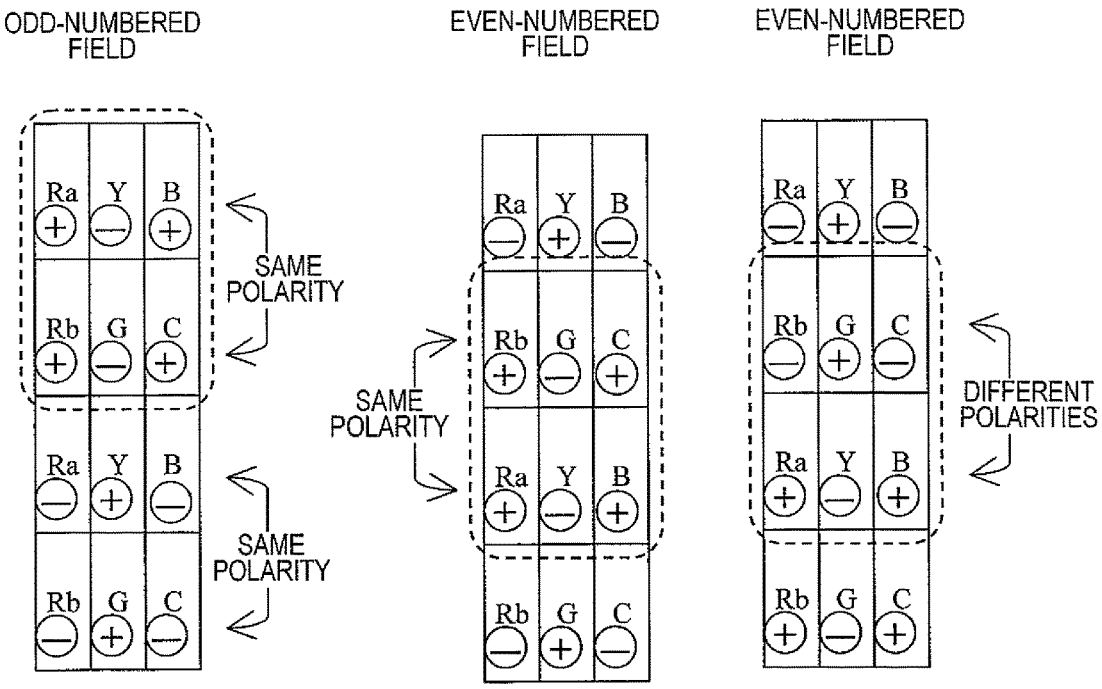

Hereinafter, it will be described with reference to FIGS. 10A-10C how respective subpixels change their polarities in odd- and even-numbered fields. Specifically, FIG. 10A shows the polarities of respective subpixels in an odd-numbered field. FIG. 10B shows the polarities of respective subpixels in a situation where two rows of subpixels, corresponding to a single pixel on which a write operation is performed, have the same set of polarities in an even-numbered field. On the other hand, FIG. 10C shows the polarities of respective subpixels in a situation where two rows of subpixels, corresponding to a single pixel on which a write operation is performed, have mutually different sets of polarities in an even-numbered field. In FIGS. 10A-10C, the first polarity is represented by the positive sign "+" while the second polarity is represented by the negative sign "−".

As shown in FIG. 10A, in an odd-numbered field, the first and second rows of subpixels corresponding to a pixel on the first row of the video signal have the same set of polarities and the third and fourth rows of subpixels corresponding to a pixel on the third row of the video signal also have the same set of polarities. Also, looking at subpixels on the same column, it can be seen that the polarity of each subpixel on the second row is different from that of its adjacent subpixel on the third row. In this manner, in an odd-numbered field, two rows of subpixels corresponding to a single pixel on which a write operation is going to be performed have the same set of polarities, the $(2w-1)^{th}$ and $2w^{th}$ rows of subpixels have the same set of polarities, but the $2w^{th}$ and $(2w+1)^{th}$ rows of subpixels have mutually different sets of polarities.

If the two rows of subpixels corresponding to a single pixel on which a write operation is going to be performed have the same set of polarities in the next even-numbered field, then the second and third rows of subpixels corresponding to a pixel on the second row of the video signal will have the same set of polarities and the fourth and fifth rows of subpixels corresponding to a pixel on the fourth row of the video signal will also have the same set of polarities as shown in FIG. 10B. If the two rows of subpixels corresponding to a single pixel had the same set of polarities even in an even-numbered field, then the even-numbered rows (e.g., the second and fourth rows) of subpixels would not have their sets of polarities changed from theirs in the odd-numbered field as can be seen by comparing FIGS. 10A and 10B to each other. As a result, the residual image would be produced on those even-numbered rows of subpixels.

On the other hand, if the second row of subpixels have the same set of polarities as the first row of subpixels and if the third row of subpixels have a different set of polarities from the second row of subpixels so that the second and third rows of subpixels corresponding to a pixel on the second row of the video signal have mutually different sets of polarities as shown in FIG. 10C, then the polarities of the subpixels on the second row will invert from theirs in the odd-numbered field. In this manner, by making the $(2u-1)^{th}$ and $2u^{th}$ rows (where u is a natural number falling within the range of one through M−1) of subpixels have the same set of polarities and also making the $2u^{th}$ and $(2u+1)^{th}$ rows of subpixels have mutually different sets of polarities even in an even-numbered field, the residual image will be prevented from producing on the subpixels.

As can be seen from FIGS. 10A through 10C, every pair of subpixels that is adjacent to each other in the row direction has mutually different polarities in any field and there are two adjacent rows of subpixels, of which the electric fields applied to the liquid crystal layer have mutually different directions. As a result, flicker can be reduced.

In the example illustrated in FIGS. 10A-10C, the subpixels change their polarities every second row in the column direction. However, the present invention is in no way limited to it. The subpixels may change their polarities every row, too.

Also, in the example described above, the interlaced signal is preferably a signal compliant with the interlace driving technique. However, the present invention is in no way limited to it. The interlaced signal may also be obtained by decimating a signal compliant with the progressive driving technique.

Furthermore, in the example described above, the color of a pixel on the first row of the input signal is represented by the first and second rows of subpixels of the multi-primary-color display panel 200 and that of a pixel on the second row of the input signal is represented by the second and third rows of subpixels of the multi-primary-color display panel 200. However, the present invention is in no way limited to it. The color of a pixel on the first row of the input signal does not have to be represented by the first and second rows of subpixels of the multi-primary-color display panel 200.

Moreover, in the example described above, the luminance values of the first row of subpixels in an even-numbered field are the same as their values in an odd-numbered field. However, the present invention is in no way limited to it. The luminance values of the first row of subpixels in an even-numbered field may be different from their values in an odd-numbered field. For example, the luminance values of the first row of subpixels in an even-numbered field may be either luminance values with the lowest grayscale or determined by the combination of pixels on the first and second rows of the video signal.

Furthermore, in the example described above, the first and second red subpixels Ra and Rb have the same property, and therefore, the first and second red subpixels Ra and Rb derived from the same pixel of the video signal (e.g., red subpixels Ra and Rb on the first and second rows of an odd-numbered field) have the same luminance value (e.g., $Ra_1=Rb_1$). However, the present invention is in no way limited to it. By controlling the luminance values of the respective red subpixels Ra and Rb independently of each other, the viewing angle dependence of the γ characteristic, which varies depending on whether an image on the screen is viewed straight or obliquely, can be reduced.

As a technique for reducing the viewing angle dependence of the γ characteristic, a method called "multi-pixel drive" was proposed in Japanese Patent Applications Laid-Open Publications Nos. 2004-62146 and 2004-78157. According to this technique, each single subpixel is divided into two regions and mutually different voltages are applied to those two regions, thereby reducing the viewing angle dependence of the γ characteristic. If a configuration for controlling the first and second red subpixels Ra and Rb independently of each other is adopted, mutually different voltage should be able to be applied to the respective liquid crystal layers of the first and second red subpixels Ra and Rb. As a result, just like the multi-pixel drive disclosed in Japanese Patent Applications Laid-Open Publications Nos. 2004-62146 and 2004-78157, the effect of reducing the viewing angle dependence of the γ characteristic can be achieved.

Furthermore, in the example described above, the first and second red subpixels Ra and Rb have the same property. However, the present invention is in no way limited to it. The first and second red subpixels Ra and Rb may also have mutually different properties.

Preferred Embodiment 2

Hereinafter, a second preferred embodiment of a display device according to the present invention will be described. The display device of this preferred embodiment has the similar configuration as the counterpart of the first preferred embodiment that has already been described with reference to FIGS. 1 and 5, except that the video signal is a progressive signal compliant with the progressive driving technique. Thus, the description of common features between this and the first preferred embodiments will be omitted herein to avoid redundancies. Just like the signal converter 300 shown in FIG. 5, the display device 100 of this preferred embodiment performs a multi-primary-color conversion on a value of the video signal representing the color of a pixel and then converts the vertical resolution thereof.

First of all, it will be described with reference to FIG. 11 how the luminances change in respective subpixels of the display device 100 of this preferred embodiment. In the progressive signal, values representing the colors of pixels are shown sequentially from the first row through the $2M^{th}$ row.

Figure 11:
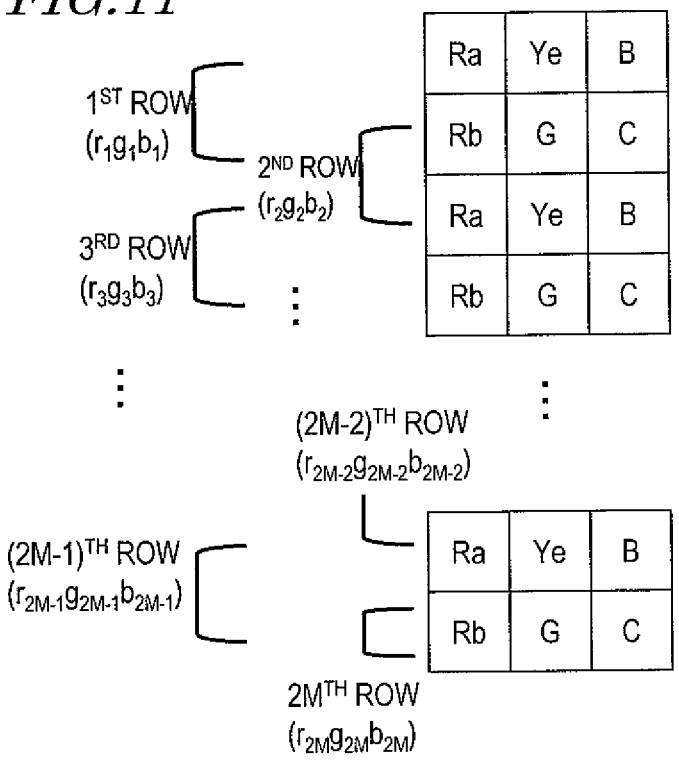
FIG. 11 is a schematic representation showing correspondence between pixels in a video signal and subpixels of a multi-primary-color display panel in a display device as a second preferred embodiment of the present invention.

FIG. 11 shows correspondence between respective pixels of the video signal and respective subpixels of the multi-primary-color display panel 200. As shown in FIG. 11, even when the video signal is a progressive signal, a pixel on the first row of the video signal also corresponds to the first and second rows of subpixels of the multi-primary-color signal and a pixel on the second row of the video signal also corresponds to the second and third rows of subpixels of the multi-primary-color signal.

However, since the video signal is a progressive signal in the display device 100 of this preferred embodiment, each scan line is selected only once in a frame (which is a half as often as in the display device of the first preferred embodiment to be driven by the interlace driving technique) to write the display signal voltage. For that reason, the luminance of each subpixel is determined on a frame-by-frame basis.

Figure 12:
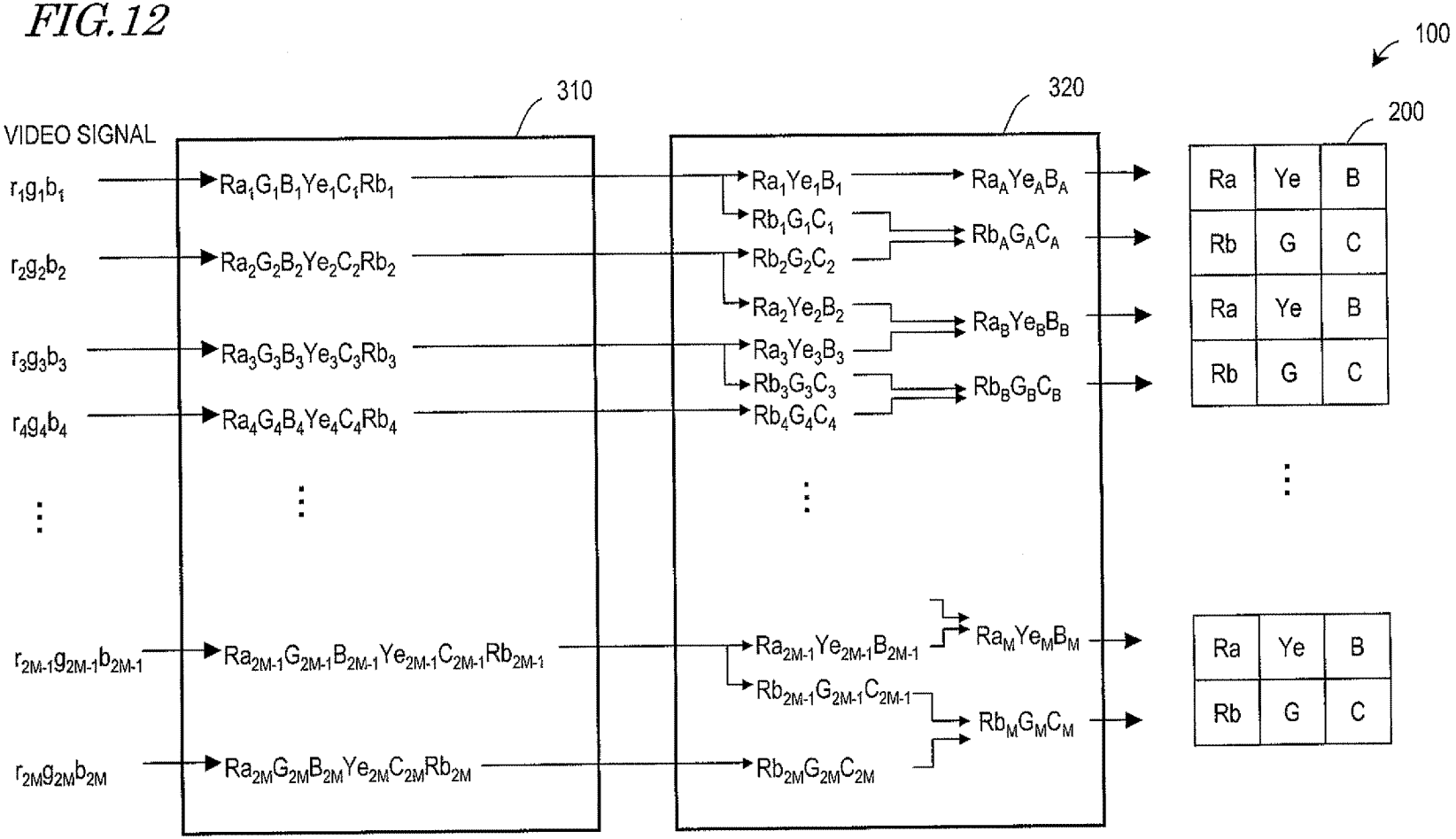
FIG. 12 is a schematic representation showing the luminance values of respective subpixels in the display device of the second preferred embodiment of the present invention.

FIG. 12 is a schematic representation showing the luminances of respective subpixels in the multi-primary-color display panel 200 of the display device 100 of this preferred embodiment. In FIG. 12, a value $r_x g_x b_x$ represents the color of a pixel on the $x^{th}$ row of the video signal, and the values $r_x$, $g_x$ and $b_x$ represent the luminance values (or luminance levels) of red, green and blue of the pixel on the $x^{th}$ row. Specifically, in FIG. 12, the value $r_1 g_1 b_1$ represents the color of a pixel on the first row of the video signal, the value $r_2 g_2 b_2$ represents the color of a pixel on the second row of the video signal, and the value $r_{2M} g_{2M} b_{2M}$ represents the color of a pixel on the $2M^{th}$ row of the video signal.

As shown in FIG. 12, the multi-primary-color converter 310 obtains a value $Ra_x G_x B_x Ye_x C_x Rb_x$ based on the value $r_x g_x b_x$ representing the color of a pixel on the $x^{th}$ row. Specifically, the multi-primary-color converter 310 obtains a value $Ra_1 G_1 B_1 Ye_1 C_1 Rb_1$ based on a value $r_1 g_1 b_1$ representing the color of a pixel on the first row of the video signal and also obtains a value $Ra_2 G_2 B_2 Ye_2 C_2 Rb_2$ based on a value $r_2 g_2 b_2$ representing the color of a pixel on the second row. In the same way, the multi-primary-color converter 310 obtains a value $Ra_{2M} G_{2M} B_{2M} Ye_{2M} C_{2M} Rb_{2M}$ based on a value $r_{2M} g_{2M} b_{2M}$ representing the color of a pixel on the $2M^{th}$ row.

The resolution converter 320 obtains the luminance value of each subpixel based on the values of its associated pixels that are adjacent to each other in the column direction, thereby converting the vertical resolution. Specifically, the resolution converter 320 determines the value corresponding to the luminance of the red subpixel on the second row to be $Rb_A$ based on $Rb_1$ and $Rb_2$. For example, the resolution converter 320 may obtain the value $Rb_A$ by calculating the average of $Rb_1$ and $Rb_2$ as shown in the following Equation (1) and determines the luminance value of the subpixel on the first row to be $Rb_A$.

$$Rb_A = \frac{Rb_1 + Rb_2}{2} \tag{1}$$

In the same way, the resolution converter 320 determines the luminance value of the green subpixel on the second row to be $G_A$ that has been obtained based on $G_1$ and $G_2$ and also determines the luminance value of the cyan subpixel on the second row to be $C_A$ that has been obtained based on $C_1$ and $C_2$. Also, the resolution converter 320 determines the luminance values of the first red, yellow and blue subpixels on the third row to be $Ra_B$, $Ye_B$ and $B_B$ based on $Ra_2$ and $Ra_3$, $Ye_2$ and $Ye_3$, and $B_2$ and $B_3$, respectively.

It should be noted that the luminance values of the first red, yellow and blue subpixel on the first row are determined to be values $Ra_1$, $Ye_1$ and $B_1$, respectively, which have been obtained by subjecting the value $r_1 g_1 b_1$ representing the color of a pixel on the first row to a multi-primary-color conversion. Also, the luminance values of the subpixels on the $2M^{th}$ row are determined to be $Rb_{2M} G_{2M} C_{2M}$ based on the values of pixels on the $(2M-1)^{th}$ and $2M^{th}$ rows of the video signal.

As described above, the display device 100 of this preferred embodiment determines the luminances of subpixels based on a result of a multi-primary-color conversion that has been carried out on values of the video signal representing the colors of adjacent pixels, thereby substantially increasing the vertical resolution of the multi-primary-color display panel 200 and getting a display operation done with high resolution. On top of that, by inputting a multi-primary-color signal to a driver (not shown) that drives signal lines and scan lines, a display operation can be carried out in multiple primary colors without changing the drivers.

In the preferred embodiment described above, the average of two values that have been subjected to a multi-primary-color conversion is calculated. However, the present invention is in no way limited to it. Calculations may also be carried out by a predetermined equation such as the following Equation (2). For example, the luminance value of the second red subpixel on the second row may be calculated as $Rb_A$ by the following Equation (2):

$$Rb_A = (Rb_1 + Rb_2) \times \left( \frac{\mathrm{ABS}(Rb_1 - Rb_2)}{2} + \frac{1}{2} \right) \tag{2}$$

where ABS ( ) is a function for calculating the absolute value of ( ). If $Rb_1$ and $Rb_2$ are values that are approximately equal to each other, a value that is almost equal to the average of $Rb_1$ and $Rb_2$ is obtained as a result of the calculation by Equation (2). On the other hand, if there is a big difference between $Rb_1$ and $Rb_2$, a value that is close to the larger one of the two will be obtained.

As described above, even if the progressive driving technique is adopted, the display device 100 of this preferred embodiment can still substantially increase the vertical resolution while a display operation is conducted in multiple primary colors. In addition, even when the progressive driving technique is adopted, the residual image will be prevented from producing on subpixels by inverting the polarity of a subpixel on a frame-by-frame basis.

In the preferred embodiments described above, the signal converter 300 performs a multi-primary-color conversion and then converts the vertical resolution. That is why before the vertical resolution conversion is carried out, the values of all six types of subpixels have already been obtained for every row, and the resolution converter 320 can make reference to a huge amount of data to perform its processing. As a result, the effect of increasing the vertical resolution substantially should be achieved.

Preferred Embodiment 3

In the display device of the second preferred embodiment just described, the resolution converter 320 performs the same type of calculations on every type of subpixel. However, the present invention is in no way limited to it.

Hereinafter, a third preferred embodiment of a display device according to the present invention will be described. The display device 100 of this preferred embodiment has the similar configuration as the counterpart of the second preferred embodiment that has already been described with reference to FIGS. 11 and 12, except that a multi-primary-color conversion is carried out based on a result of a vertical resolution conversion. Thus, the description of common features between this and the first and second preferred embodiments will be omitted herein to avoid redundancies.

As described above, if the first and second red subpixels Ra and Rb have the same property, then the value $Ra_1$ gets equal to the value $Rb_1$ and each of the first and second red subpixels Ra and Rb could be regarded as a same red subpixel. That is why it can be said that a red subpixel is included in every row of subpixels. In other words, the multi-primary-color display panel 200 can be said as having a number of red subpixels corresponding to the vertical resolution of the video signal. In that case, the values $Ra_1$ and $Rb_1$ of the red subpixels may be determined differently from the values of the other subpixels.

Figure 13:
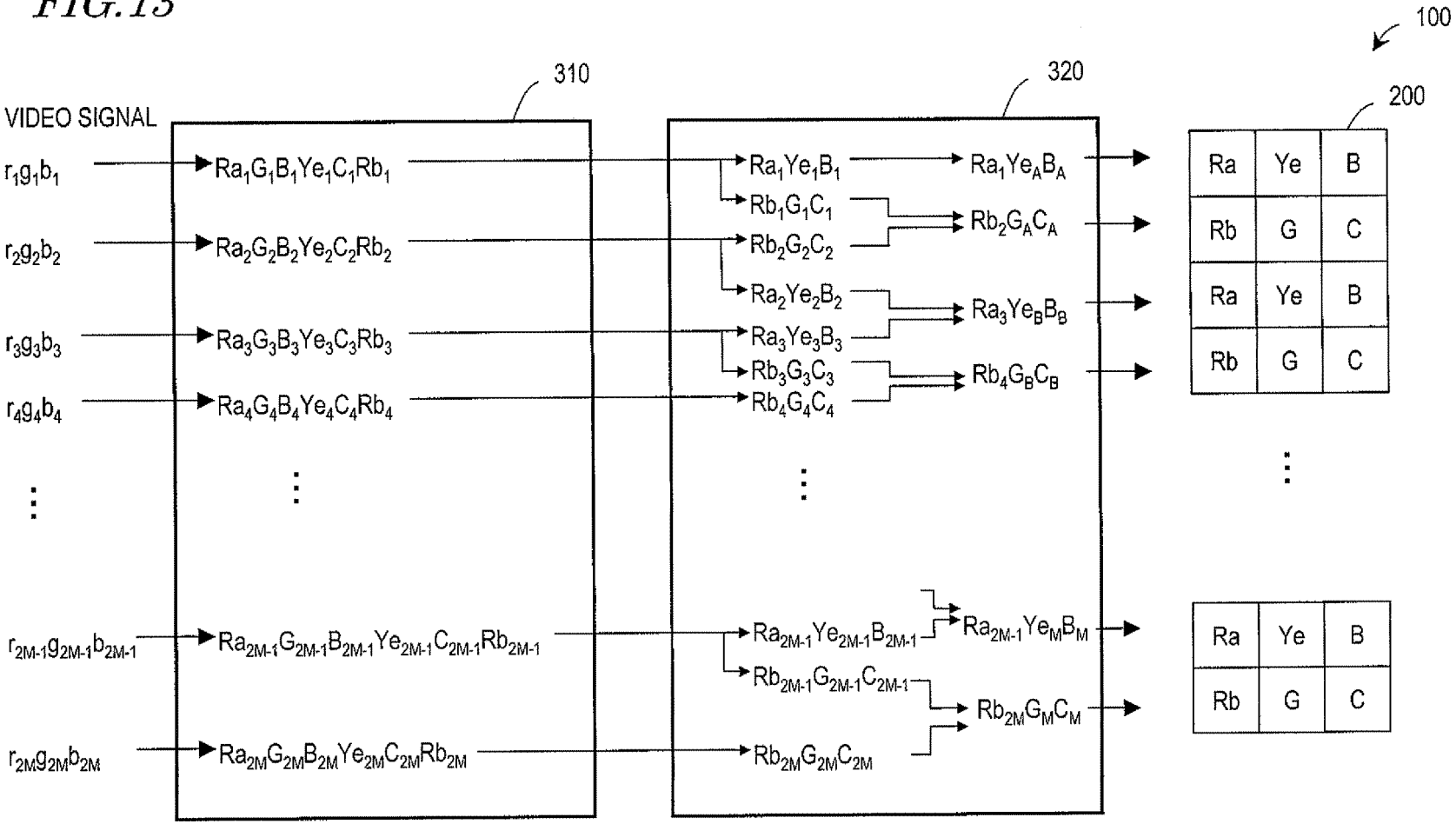
FIG. 13 is a schematic representation showing the luminance values of respective subpixels in a display device as a third preferred embodiment of the present invention.

Specifically, as shown in FIG. 13, the resolution converter 320 in the display device 100 of this preferred embodiment may determine $Ra_A$ and $Rb_A$ shown in FIG. 12 to be $Ra_1$ ($=Rb_1$) and $Ra_2$ ($=Rb_2$), respectively, without carrying out the calculations of Equations (1) and (2). As a result, the input signal is directly reflected on the red subpixels, and therefore, the color red of the input signal can be reproduced with high fidelity without changing the resolutions.

Preferred Embodiment 4

Hereinafter, a fourth preferred embodiment of a display device according to the present invention will be described. The display device of this preferred embodiment has the similar configuration as the counterpart of the second preferred embodiment that has already been described with reference to FIGS. 11 and 12, except that a multi-primary-color conversion is carried out based on a result of a vertical resolution conversion. Thus, the description of common features between this and the first and second preferred embodiments will be omitted herein to avoid redundancies.

Figure 14:
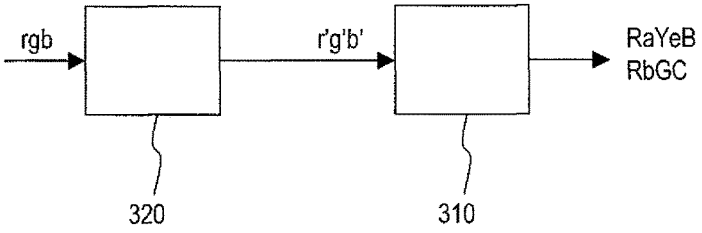
FIG. 14 is a block diagram illustrating a configuration for a signal converter for a display device as a fourth preferred embodiment of the present invention.

FIG. 14 illustrates a configuration for a signal converter 300 for the display device of this preferred embodiment. As shown in FIG. 14, the signal converter 300 also includes the resolution converter 320 and the multi-primary-color converter 310 just like the signal converter shown in FIG. 5. However, unlike the signal converter shown in FIG. 5, the resolution converter 320 converts the vertical resolution first, and then the multi-primary-color converter 310 performs a multi-primary-color conversion.

Figure 15:
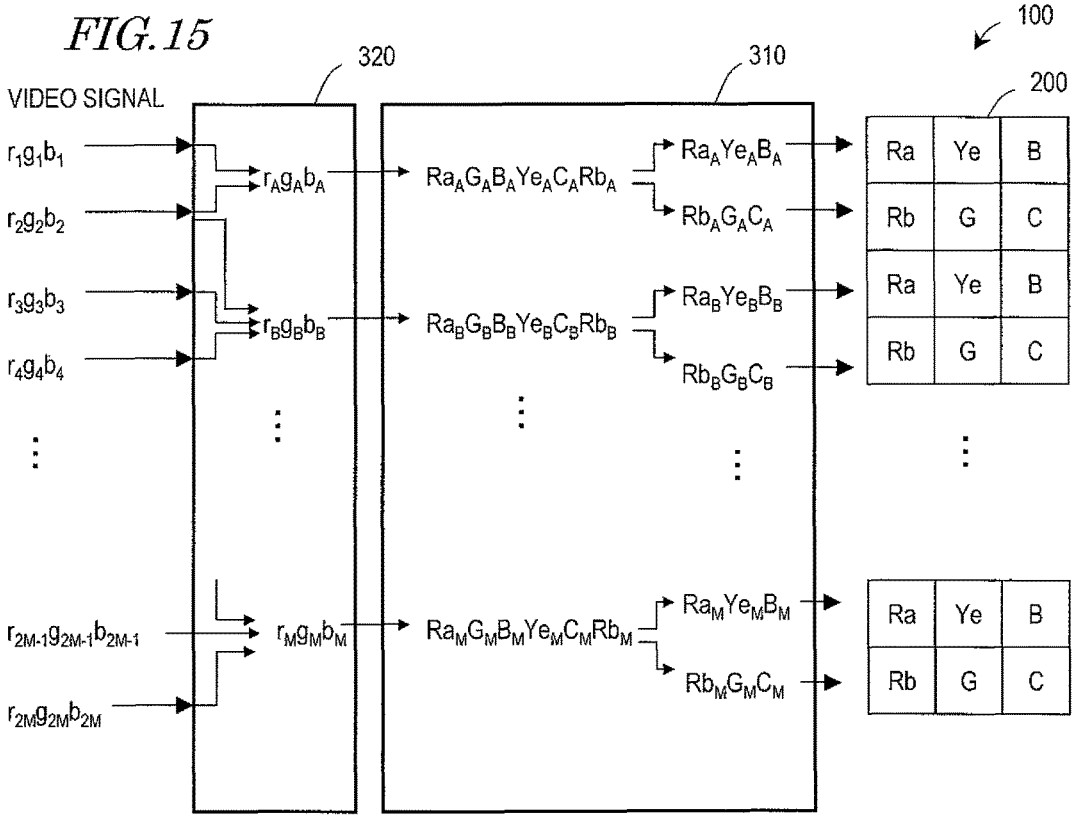
FIG. 15 is a schematic representation showing the luminance values of respective subpixels in the display device of the fourth preferred embodiment of the present invention.

First of all, it will be described with reference to FIG. 15 how the luminances change in respective subpixels of the display device 100 of this preferred embodiment. In the progressive signal, values representing the colors of pixels are shown sequentially from the first row through the $2M^{th}$ row as described above.

In the display device 100 of this preferred embodiment, the resolution converter 320 converts the vertical resolution first. That is to say, the resolution converter 320 obtains a value $r_xg_xb_x$, representing the color of a pixel on a single row corresponding to two rows of subpixels in the multi-primary-color display panel 200, based on the values of the video signal representing the colors of pixels on at least two adjacent rows.

Next, the multi-primary-color converter 310 performs a multi-primary-color conversion on the value $r_xg_xb_x$ and obtains a value $Ra_xG_xB_xYe_xC_xRb_x$, thereby determining the luminance values of the first red, yellow and blue subpixels associated to be $Ra_x$, $Ye_x$ and $B_x$ and the luminance values of the second red, green and cyan subpixels associated to be $Rb_x$, $G_x$ and $C_x$, respectively.

Specifically, to obtain the values corresponding to luminances of the first and second rows of subpixels of the multi-primary-color signal, the resolution converter 320 makes reference to the values of the video signal representing the colors of pixels on two rows. And to obtain the values corresponding to luminances of the third and remaining rows of subpixels, the resolution converter 320 refers to the values of the video signal representing the colors of pixels on three rows.

More specifically, the resolution converter 320 obtains a value $r_Ag_Ab_A$ based on the values $r_1g_1b_1$ and $r_2g_2b_2$ representing the colors of pixels on the first and second rows of the video signal. Then, the multi-primary-color converter 310 performs a multi-primary-color conversion on the value $r_Ag_Ab_A$, thereby obtaining a value $Ra_AG_AB_AYe_AC_ARb_A$, where the value $Ra_AYe_AB_A$ may be equal to the value $Ra_1Ye_1B_1$ that has already been described for the second preferred embodiment and the value $Rb_AG_AC_A$ may be the average of the values $Rb_1G_1C_1$ and $Rb_2G_2C_2$ that have already been described for the second preferred embodiment. As a result, the luminance values of the first red, yellow and blue subpixels on the first row are determined to be the values $Ra_A$, $Ye_A$ and $B_A$ and the luminance values of the second red, green and cyan subpixels on the second row are determined to be the values $Rb_A$, $G_A$ and $C_A$, respectively.

Also, to obtain the values corresponding to luminances of subpixels on the third and remaining rows, the resolution converter 320 determines a value $r_wg_wb_w$ based on the values $r_{2w-2}g_{2w-2}b_{2w-2}$, $r_{2w-1}g_{2w-1}b_{2w-1}$, and $r_{2w}g_{2w}b_{2w}$ representing the colors of pixels on three rows of the video signal, i.e., the $(2w-2)^{th}$, $(2w-1)^{th}$ and $2w^{th}$ rows (where w is a natural number falling within the range of two through M). Then, the multi-primary-color converter 310 performs a multi-primary-color conversion on the value $r_wg_wb_w$, thereby obtaining a value $Ra_wG_wB_wYe_wC_wRb_w$, and determines the luminances values of the first red, yellow and blue subpixels on the $(2w-1)^{th}$ row to be the values $Ra_w$, $Ye_w$ and $B_w$ and the luminance values of the second red, green and cyan subpixels on the 2 $w^{th}$ row to be the values $Rb_w$, $G_w$ and $C_w$, respectively.

For example, the luminance values of the first red, yellow and blue subpixels on the third row and those of the second red, green and cyan subpixels on the fourth row are determined in the following manner. The resolution converter 320 obtains a value $r_Bg_Bb_B$ based on the values $r_2g_2b_2$, $r_3g_3b_3$ and $r_4g_4b_4$ representing the colors of pixels on the second, third and fourth rows of the video signal. Then, the multi-primary-color converter 310 performs a multi-primary-color conversion on the value $r_Bg_Bb_B$, thereby obtaining a value $Ra_BG_BB_BYe_BC_BRb_B$, where the values $Ra_B$, $Ye_B$ and $B_B$ may be the average of the values $Ra_2$ and $Ra_3$, $Ye_2$ and $Ye_3$, and $B_2$ and $B_3$ that have already been described for the second preferred embodiment and the values $Rb_B$, $G_B$ and $C_B$ may be the average of the values $Rb_3$ and $Rb_4$, $G_3$ and $G_4$, and $C_3$ and $C_4$ that have already been described for the second preferred embodiment. In this manner, the multi-primary-color converter 310 determines the luminance values of the first red, yellow and blue subpixels on the third row to be $Ra_B$, $Ye_B$ and $B_B$ and the luminance values of the second red, green and cyan subpixels on the fourth row to be $Rb_B$, $G_B$ and $C_B$, respectively.

As described above, in the display device 100 of this preferred embodiment, the signal converter 300 converts the vertical resolution first, and then performs a multi-primary-color conversion. That is to say, the multi-primary-color converter 310 processes values that have already gone through the vertical resolution conversion, and therefore, the number of times the multi-primary-color converter 310 has to perform the multi-primary-color conversion can be halved. As a result, the burden on the multi-primary-color converter 310 can be lightened.

Optionally, the display device of any of the second through fourth preferred embodiments may finely adjust the luminances of the first and second red subpixels Ra and Rb that are adjacent to each other in view of the viewing angle dependence of the γ characteristic as already described for the first preferred embodiment.

In the foregoing description, the video signal is compliant with the BT. 709 standard and the luminance values r, g and b of the video signal fall within the range of zero to one. However, the present invention is in no way limited to it. As for a video signal compliant with the xvYCC standard, for example, no range of values that the video signal can have is defined. In that case, the range of the luminance values r, g and b may be arbitrarily defined to be from −0.05 through 1.33, for example, and the values r, g and b are uniquely set to be obtained by subjecting 355 grayscale values of the $-65^{th}$ grayscale through the $290^{th}$ grayscale to an inverse γ correction. According to such settings, if any of r, g and b is a negative value, the multi-primary-color display panel 200 can represent colors outside of the color reproduction range in a situation where r, g and b fall within the range of zero to one.

Also, in the foregoing description, the values r, g and b of the video signal are preferably luminance values (or luminance levels) of the three primary colors. However, the present invention is in no way limited to it. The values r, g and b may also be so-called grayscale values yet to be subjected to the inverse gamma correction. It should be noted that if the values r, g and b are grayscale values, the values of the multi-primary-color signal are also grayscale values, not luminance values.

Furthermore, the video signal represents the colors of pixels by color coordinates RGB. However, the present invention is in no way limited to it. The video signal may also represent the colors of pixels by any other set of color coordinates such as XYZ.

As shown in FIG. 3, in the multi-primary-color display panel 200 of the display device 100 of the first through third preferred embodiments described above, multiple sets of subpixels in a first combination, each comprised of the first red subpixel Ra, a yellow subpixel Ye and a blue subpixel B, and multiple sets of subpixels in a second combination, each comprised of the second red subpixel Rb, a green subpixel G and a cyan subpixel C, are arranged alternately. As disclosed in Japanese Patent Application No. 2005-274510, such an arrangement will achieve the following advantages.

First of all, since the first and second red subpixels Ra and Rb are arranged back to back, it is possible to prevent the bumpiness when a red line is displayed. In addition, since a green subpixel G and a yellow subpixel Ye that have higher Y values than the other subpixels are arranged back to back so as to be interposed between the other subpixels within the same pixel, the edge coloring problem can be overcome.

On top of that, since the first and second red subpixels Ra and Rb, yellow subpixel Ye and blue subpixel B are arranged with no other subpixel interposed between them, it is possible to prevent the bumpiness when a yellow line is displayed. Furthermore, since the cyan subpixel C, green subpixel G and blue subpixel B are arranged with no other subpixel interposed between them, it is possible to prevent the bumpiness when a cyan line is displayed.

However, the subpixels do not always have to be arranged that way but may be arranged differently from the ones shown in FIG. 3. Also, the subpixels included in each set of subpixels in the first combination do not have to be the first red subpixel, a yellow subpixel and a blue subpixel, and the subpixels included in each set of subpixels in the second combination do not have to be the second red subpixel, a green subpixel and a cyan subpixel, either.

Furthermore, in the foregoing description, the second red subpixel Rb is preferably made in the same way, and have the same hue and same chroma, as the first red subpixel Ra. However, the present invention is in no way limited to it. The second red subpixel Rb may also be made so as to have different hue and chroma from the first red subpixel Ra. Alternatively, just like a normal multi-primary-color display panel, a display operation may also be conducted in six primary colors using red, green and blue that are called the "three primary colors of light" and yellow, cyan and magenta that are called the "three primary colors of colors".

Also, in the foregoing description, the multi-primary-color display panel 200 preferably has six types of subpixels (i.e., N=6 and L=3). However, the present invention is in no way limited to it. The multi-primary-color display panel 200 may have only four types of subpixels. For example, the multi-primary-color display panel 200 may have red, green, blue and white subpixels.

As can be seen, the present invention is applicable to any multi-primary-color display panel 200 as long as the panel 200 has N types of subpixels (where N=2×L and L is a natural number that is equal to or greater than two). In that case, the signal converter 300 associates a value of the video signal representing the color of a pixel at the intersection between the $p^{th}$ row and the $q^{th}$ column with values of the multi-primary-color signal corresponding to the luminances of subpixels on $(p-1)^{th}$ and $p^{th}$ rows and on $\{L\times(q-1)+1\}^{th}$ through $(L\times q)^{th}$ columns. The signal converter 300 also associates a value of the video signal representing the color of a pixel at an intersection between the $(p+1)^{th}$ row and the $q^{th}$ column with values of the multi-primary-color signal corresponding to the luminances of subpixels on the $p^{th}$ and $(p+1)^{th}$ rows and on the $\{L\times(q-1)+1\}^{th}$ through $(L\times q)^{th}$ columns.

Preferred Embodiment 5

In the foregoing description, six subpixels of the multi-primary-color display panel preferably form a single pixel. However, the present invention is in no way limited to it.

Hereinafter, a fifth preferred embodiment of a display device according to the present invention will be described with reference to FIGS. 16 through 19. The display device of this preferred embodiment has the similar configuration as the counterpart of the first through fourth preferred embodiments, except that four subpixels of the multi-primary-color display panel form a single pixel. Thus, the description of common features between this and the first through fourth preferred embodiments will be omitted herein to avoid redundancies.

Figure 16:
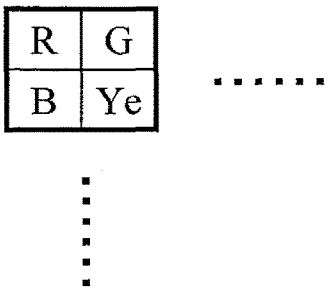
FIG. 16 is a schematic representation illustrating the arrangement of subpixels in a display device as a fifth preferred embodiment of the present invention.

As shown in FIG. 16, in the multi-primary-color display panel 200 of the display device 100 of this preferred embodiment, a single pixel is made up of a red subpixel and a green subpixel included in a set of subpixels in a first combination and a blue subpixel and a yellow subpixel included in a set of subpixels in a second combination. And these four subpixels are arranged in two columns and two rows.

Figure 17A:
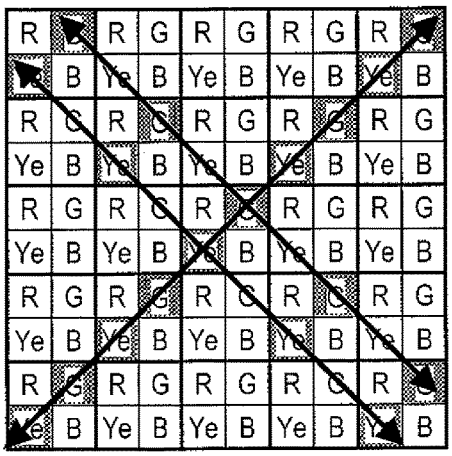
FIGS. 17A and 17B are schematic representations illustrating arrangements of subpixels.
Figure 17B:
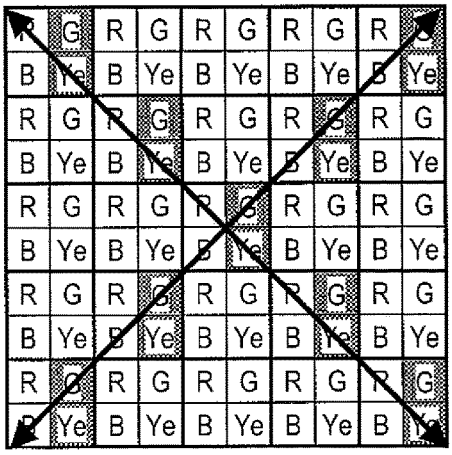

Hereinafter, this arrangement of subpixels will be analyzed. If the yellow and green subpixels, which have relatively high luminances among the four subpixels, were arranged diagonally, then diagonals that run from the upper left corner toward the lower right corner would look bolder than a diagonal that run from the lower left corner toward the upper right corner as shown in FIG. 17A. That is to say, these two types of diagonals would look with different degrees of boldness. On the other hand, if the yellow and green subpixels, which have relatively high luminances among the four subpixels, are arranged adjacent to each other, then the two types of diagonals will look with approximately the same degree of boldness as shown in FIG. 17B. For that reason, the yellow and green subpixels are preferably arranged adjacent to each other.

Also, as red and green subpixels have mutually opponent colors and do not mix together easily, the red and green subpixels are preferably arranged adjacent to each other. Likewise, as blue and yellow subpixels have mutually opponent colors and do not mix together easily, the blue and yellow subpixels are also preferably arranged adjacent to each other. For these reasons, either the arrangement of subpixels shown in FIG. 16 or an arrangement of subpixels, defined by interchanging the green and blue subpixels with each other in the arrangement shown in FIG. 16, is preferred.

Figure 18:
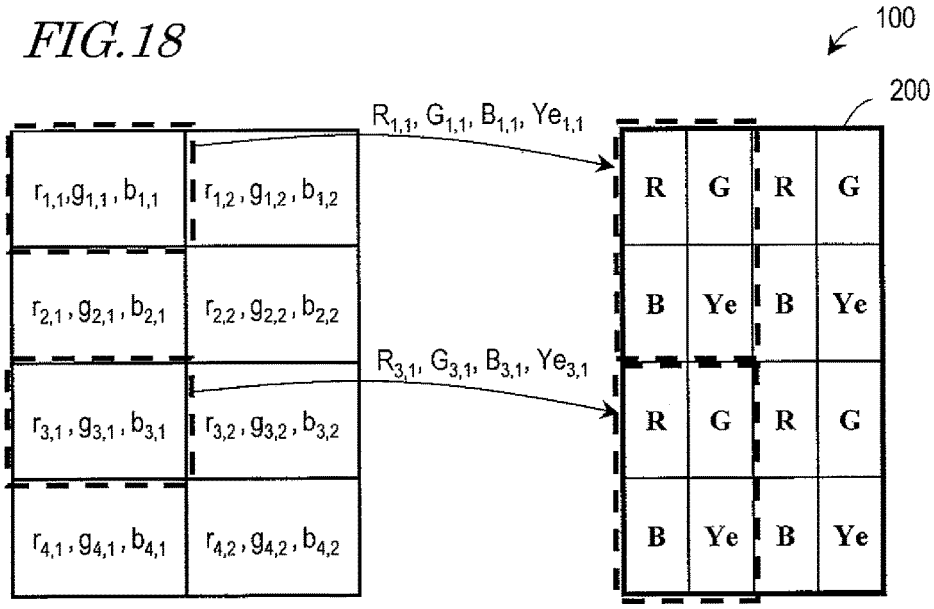
FIG. 18 is a schematic representation showing correspondence between pixels in a video signal and subpixels of a multi-primary-color display panel in the display device of the fifth preferred embodiment of the present invention.

FIG. 18 shows correspondence between each pixel of the video signal and subpixels of the multi-primary-color display panel 200. In the multi-primary-color display panel 200, each subpixel has a constant aspect ratio, e.g., two to one in this example.

A value rgb of the video signal representing the color of a single pixel is converted into RGBYe by multi-primary-color conversion. In FIG. 18, a value $r_{1,1}g_{1,1}b_{1,1}$ of the video signal representing the color of a pixel at the intersection between the first row and first column is converted into values $R_{1,1}$, $G_{1,1}$, $B_{1,1}$, and $Ye_{1,1}$, which are associated with subpixels located at the respective intersections between the first row and first column, the first row and second column, the second row and first column, and the second row and second column of the multi-primary-color display panel 200. In this manner, a value of the video signal representing the color of a single pixel is associated with four subpixels of the multi-primary-color signal (or multi-primary-color display panel).

Figure 19A:
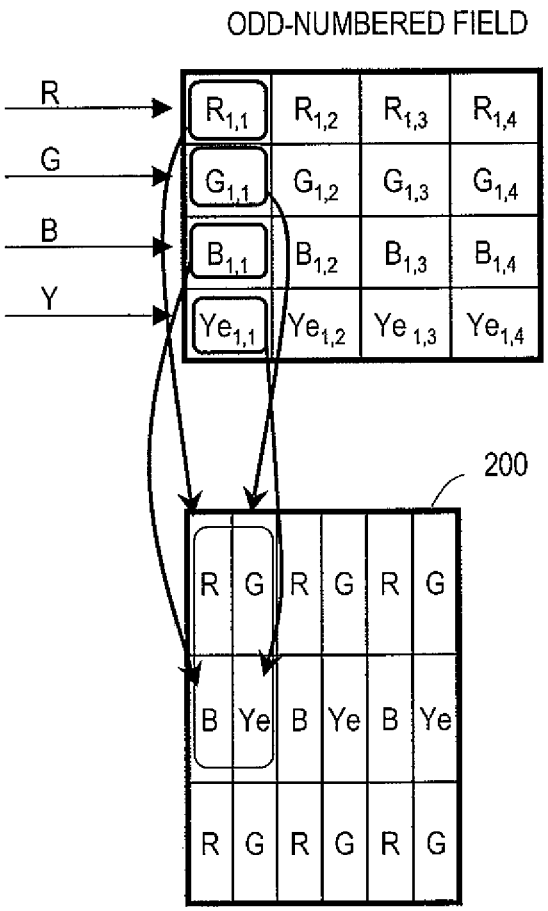
FIGS. 19A and 19B are schematic representations showing correspondence between pixels in an odd-numbered field of a video signal and subpixels of a multi-primary-color display panel, and correspondence between pixels in an even-numbered field of the video signal and subpixels of the display panel in the display device of the fifth preferred embodiment of the present invention.

Hereinafter, the correspondence between a pixel of the video signal and subpixels of the multi-primary-color display panel 200 will be described with reference to FIGS. 19A and 19B. In this example, the video signal is an interlaced signal. FIG. 19A is a schematic representation showing the correspondence between the values obtained by subjecting a value of the video signal representing the color of a pixel in an odd-numbered field to a multi-primary-color conversion and subpixels of the multi-primary-color display panel 200 in the display device of this preferred embodiment. On the other hand, FIG. 19B is a schematic representation showing the correspondence between the values obtained by subjecting a value of the video signal representing the color of a pixel in an even-numbered field to a multi-primary-color conversion and subpixels of the multi-primary-color display panel 200.

In FIG. 19A, the values $R_{1,1}$, $G_{1,1}$, $B_{1,1}$ and $Ye_{1,1}$ are values obtained by subjecting a value $r_{1,1}g_{1,1}b_{1,1}$ of the video signal representing the color of a pixel located at the intersection between the first row and the first column to a multi-primary-color conversion, while the values $R_{1,2}$, $G_{1,2}$, $B_{1,2}$ and $Ye_{1,2}$ are values obtained by subjecting a value $r_{1,2}g_{1,2}b_{1,2}$ of the video signal representing the color of a pixel located at the intersection between the first row and second column to a multi-primary-color conversion. Likewise, in FIG. 19B, the values $R_{2,1}$, $G_{2,1}$, $B_{2,1}$ and $Ye_{2,1}$ are values obtained by subjecting a value $r_{2,1}g_{2,1}b_{2,1}$ of the video signal representing the color of a pixel located at the intersection between the second row and first column to a multi-primary-color conversion, while the values $R_{2,2}$, $G_{2,2}$, $B_{2,2}$ and $Ye_{2,2}$ are values obtained by subjecting a value $r_{2,2}g_{2,2}b_{2,2}$ of the video signal representing the color of a pixel located at the intersection between the second row and second column to a multi-primary-color conversion.

As shown in FIG. 19A, in an odd-numbered field, the values $R_{1,1}$, $G_{1,1}$, $B_{1,1}$ and $Ye_{1,1}$ are associated with the red subpixel at the intersection between the first row and first column, the green subpixel at the intersection between the first row and second column, the blue subpixel at the intersection between the second row and first column, and the yellow subpixel at the intersection between the second row and second column, respectively. Likewise, the values $R_{1,2}$, $G_{1,2}$, $B_{1,2}$ and $Ye_{1,2}$ are associated with the red subpixel at the intersection between the first row and third column, the green subpixel at the intersection between the first row and fourth column, the blue subpixel at the intersection between the second row and third column, and the yellow subpixel at the intersection between the second row and fourth column, respectively. Speaking more generally, values $R_{2u-1,y}$, $G_{2u-1,y}$, $B_{2u-1,y}$ and $Ye_{2u-1,y}$ are associated with the red subpixel at the intersection between the $(2u-1)^{th}$ row and $(2y-1)^{th}$ column, the green subpixel at the intersection between the $(2u-1)^{th}$ row and $2y^{th}$ column, the blue subpixel at the intersection between the $2u^{th}$ row and $(2y-1)^{th}$ column, and the yellow subpixel at the intersection between the $2u^{th}$ row and $2y^{th}$ column, respectively.

Figure 19B:
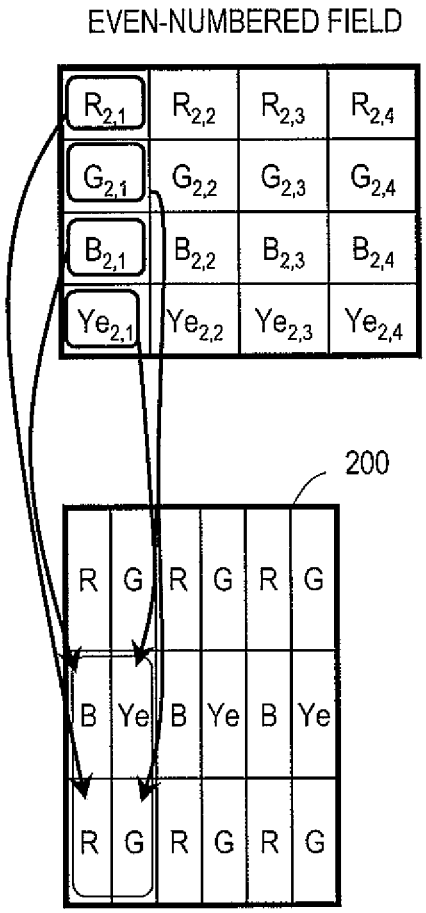

As shown in FIG. 19B, in an even-numbered field, the values $R_{2,1}$, $G_{2,1}$, $B_{2,1}$ and $Ye_{2,1}$ are associated with the blue subpixel at the intersection between the second row and first column, the yellow subpixel at the intersection between the second row and second column, the red subpixel at the intersection between the third row and first column, and the green subpixel at the intersection between the third row and second column, respectively. Likewise, the values $R_{2,2}$, $G_{2,2}$, $B_{2,2}$ and $Ye_{2,2}$ are associated with the blue subpixel at the intersection between the second row and third column, the yellow subpixel at the intersection between the second row and fourth column, the red subpixel at the intersection between the third row and third column, and the green subpixel at the intersection between the third row and fourth column, respectively. Speaking more generally, values $R_{2v,y}$, $G_{2v,y}$, $B_{2v,y}$ and $Ye_{2v,y}$ are associated with the blue subpixel at the intersection between the $2v^{th}$ row and $(2y-1)^{th}$ column, the yellow subpixel at the intersection between the $2v^{th}$ row and $2y^{th}$ column, the red subpixel at the intersection between the $(2v+1)^{th}$ row and $(2y-1)^{th}$ column, and the green subpixel at the intersection between the $(2v+1)^{th}$ row and $2y^{th}$ column, respectively.

In the display device 100 of this preferred embodiment, a value of the video signal representing the color of a pixel on a $p^{th}$ row is also associated with red (R), green (G), blue (B) and yellow (Ye) subpixels that are arranged on the $(s-1)^{th}$ and $s^{th}$ rows, and a value of the video signal representing the color of a pixel on a $(p+1)^{th}$ row is also associated with red (R), green (G), blue (B) and yellow (Ye) subpixels that are arranged on the $s^{th}$ and $(s+1)^{th}$ rows. As described above, the display device 100 conducts a display operation using multiple subpixels, which are not quite the same spatially, as a unit of display on a field-by-field basis, thereby preventing a substantial decrease in vertical resolution even when the number of colors used is increased.

Preferred Embodiment 6

The display device of the fifth preferred embodiment described above preferably is driven by the interlace driving technique. However, the present invention is in no way limited to it. The display device may also be driven by the progressive driving technique.

Hereinafter, a sixth preferred embodiment of a display device according to the present invention will be described. The display device of this preferred embodiment is driven by the progressive driving technique.

Figure 20:
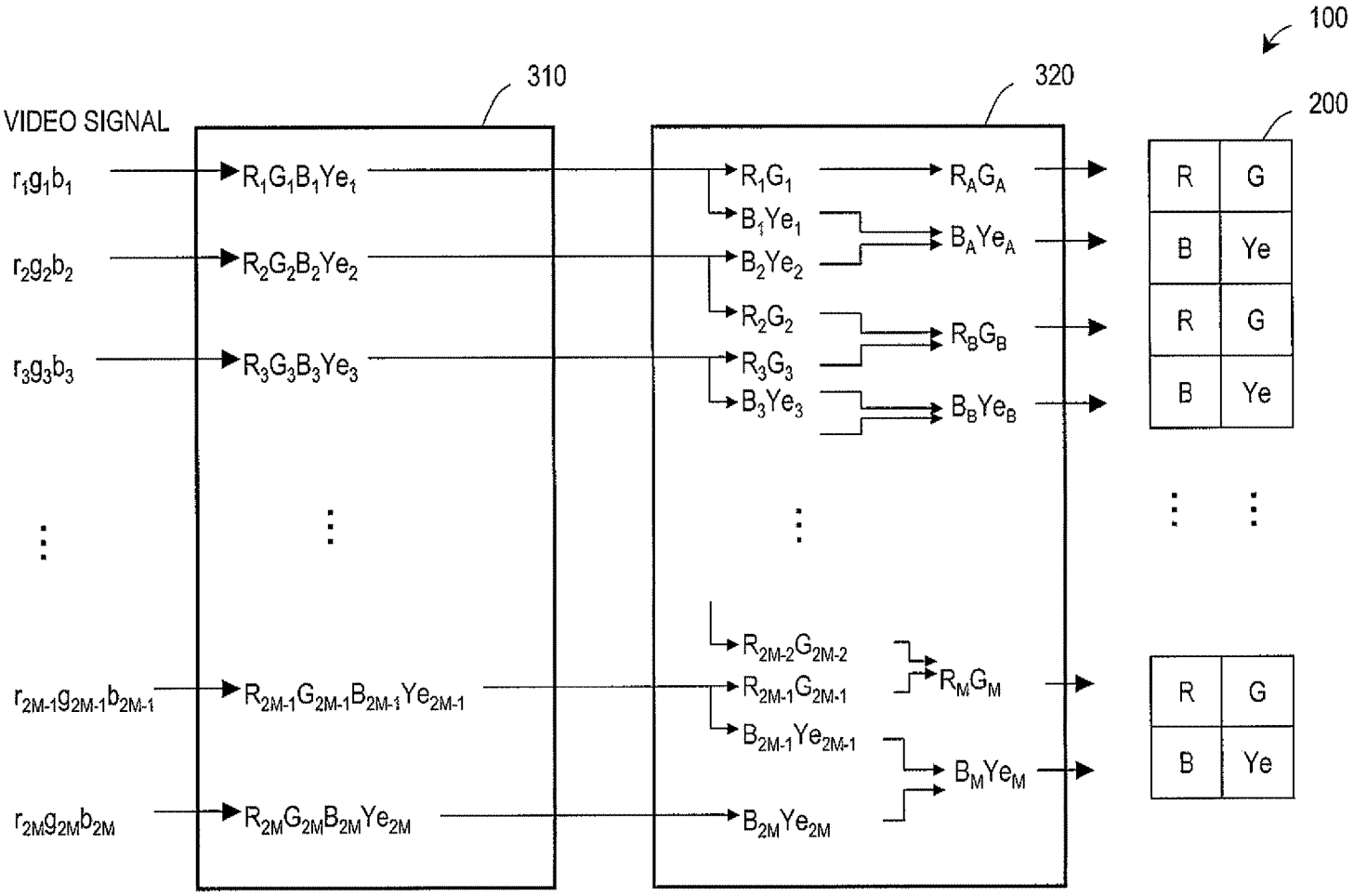
FIG. 20 is a schematic representation showing correspondence between pixels in a video signal and subpixels of a multi-primary-color display panel in a display device as a sixth preferred embodiment of the present invention.

FIG. 20 is a schematic representation showing the luminances of respective subpixels in the multi-primary-color display panel 200 of the display device 100 of this preferred embodiment. The arrangement of subpixels in the multi-primary-color display panel 200 of the display device 100 is the same as that of the display device of the fifth preferred embodiment that has just been described with reference to FIG. 16, and the description of their common features will be omitted herein to avoid redundancies. Also, in this example, a single column of pixels in the video signal corresponds to two consecutive columns of subpixels in the multi-primary-color display panel 200. That is why description about the columns will be omitted herein to avoid complicating the description excessively.

In FIG. 20, a value $r_x g_x b_x$ represents the color of a pixel on the $x^{th}$ row of the video signal, and the values $r_x$, $g_x$ and $b_x$ represent the luminance values (or luminance levels) of red, green and blue of the pixel on the $x^{th}$ row. Specifically, the value $r_1 g_1 b_1$ represents the color of a pixel on the first row of the video signal, the value $r_2 g_2 b_2$ represents the color of a pixel on the second row of the video signal, and the value $r_{2M} g_{2M} b_{2M}$ represents the color of a pixel on the $2M^{th}$ row of the video signal.

The multi-primary-color converter 310 obtains a value $R_x G_x B_x Ye_x$ based on the value $r_x g_x b_x$ representing the color of a pixel on the $x^{th}$ row. Specifically, the multi-primary-color converter 310 obtains a value $R_1 G_1 B_1 Ye_1$ based on a value $r_1 g_1 b_1$ representing the color of a pixel on the first row of the video signal and also obtains a value $R_2 G_2 B_2 Ye_2$ based on a value $r_2 g_2 b_2$ representing the color of a pixel on the second row. In the same way, the multi-primary-color converter 310 obtains a value $R_{2M} G_{2M} B_{2M} Ye_{2M}$ based on a value $r_{2M} g_{2M} b_{2M}$ representing the color of a pixel on the $2M^{th}$ row.

The resolution converter 320 determines the value $B_A$ corresponding to the luminance of the blue subpixel on the second row based on the values $B_1$ and $B_2$. For example, the resolution converter 320 set the average value of $B_1$ and $B_2$ to the value $B_A$. Also, the resolution converter 320 determines the luminance value $Ye_A$ of the yellow subpixel on the second row based on the values $Ye_1$ and $Ye_2$. In the same way, the resolution converter 320 determines the luminance values $R_B$ and $G_B$ of the red and green subpixels on the third row based on the values $R_2$ and $R_3$ and the values $G_2$ and $G_3$, respectively.

The resolution converter 320 determines the luminance values $B_M$ and $Ye_M$ of the blue and yellow subpixels on the $2M^{th}$ row of the multi-primary-color display panel 200 based on the values of pixels on the $(2M-1)^{th}$ and $2M^{th}$ rows of the video signal. Also, the resolution converter 320 determines the luminance values $R_A$ and $G_A$ of the red and green subpixels on the first row to be the values $R_1$ and $G_1$ that have been obtained by subjecting the value $r_1 g_1 b_1$ representing the color of a pixel on the first row to multi-primary-color conversion.

As described above, the display device 100 of this preferred embodiment converts the vertical resolution and determines the luminances of subpixels based on a result of a multi-primary-color conversion that has been carried out on values of the video signal representing the colors of pixels that are adjacent to each other in the column direction, thereby increasing the vertical resolution of the multi-primary-color display panel 200 substantially. Also, by supplying a multi-primary-color signal to a driver (not shown) that drives signal lines and scan lines, a display operation can be conducted in multiple primary colors without changing the drivers.

Preferred Embodiment 7

In the foregoing description, the number of columns of pixels in the multi-primary-color display panel (or multi-primary-color signal) is preferably equal to that of columns of pixels in the video signal and the resolution converter converts only the vertical resolution. However, the present invention is in no way limited to it. The number of columns of pixels in the multi-primary-color display panel (or multi-primary-color signal), as well as the number of rows thereof, may be smaller than that of columns of pixels in the video signal and the resolution converter may convert not just the vertical resolution but also horizontal resolution as well.

Hereinafter, a seventh preferred embodiment of a display device according to the present invention will be described. The display device of this preferred embodiment has the similar configuration as the counterpart of the fifth preferred embodiment described above, except that the horizontal resolution of the multi-primary-color display panel is nominally lower than that of the video signal. That is why as already described with reference to FIG. 16, the subpixels arranged in two columns and two rows in the multi-primary-color display panel of the display device of this preferred embodiment form a single pixel. That is why the description of their common features will be omitted herein. In this preferred embodiment, the length and width of each subpixel are equal to each other, and each pixel has an aspect ratio of one to one.

Figure 21A:
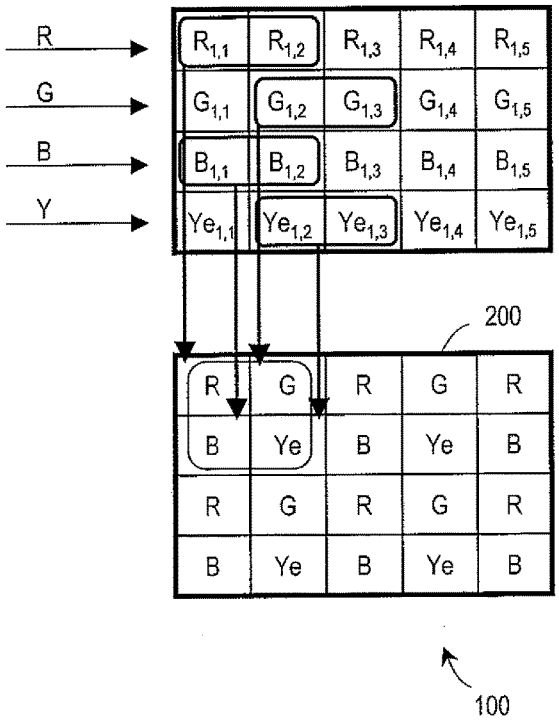
FIGS. 21A and 21B are schematic representations showing correspondence between pixels in an odd-numbered field of a video signal and subpixels of a multi-primary-color display panel, and correspondence between pixels in an even-numbered field of the video signal and subpixels of the display panel in a display device as a seventh preferred embodiment of the present invention.
Figure 21B:
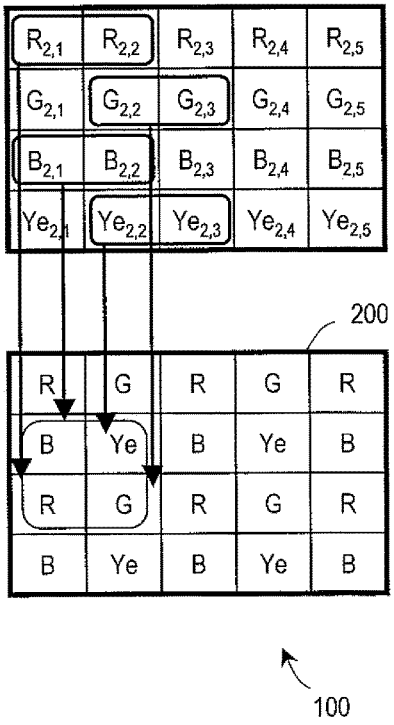

FIG. 21A is a schematic representation showing the correspondence between the values $R_{x,y}$, $G_{x,y}$, $B_{x,y}$ and $Ye_{x,y}$ obtained by subjecting a value $r_{x,y}g_{x,y}b_{x,y}$ of the video signal representing the color of a pixel at the intersection between the $x^{th}$ row and the $y^{th}$ column in an odd-numbered field to a multi-primary-color conversion and subpixels of the multi-primary-color display panel. On the other hand, FIG. 21B is a schematic representation showing the correspondence between the values $R_{x,y}$, $G_{x,y}$, $B_{x,y}$ and $Ye_{x,y}$ obtained by subjecting a value $r_{x,y}g_{x,y}b_{x,y}$ of the video signal representing the color of a pixel at the intersection between the $x^{th}$ row and the $y^{th}$ column in an even-numbered field to a multi-primary-color conversion and subpixels of the multi-primary-color display panel.

Considering FIG. 21A first, in the multi-primary-color display panel 200, one of the subpixels included in a first combination and one of the subpixels included in a second combination are alternately arranged a number of times in the column direction. FIG. 21A schematically illustrates a portion of the multi-primary-color display panel 200. Specifically, on the first column of the multi-primary-color display panel 200, arranged alternately are M red subpixels of the first combination and M blue subpixels of the second combination. On the second column of the multi-primary-color display panel 200, arranged alternately are M green subpixels of the first combination and M yellow subpixels of the second combination.

In the row direction, on the other hand, H pairs of subpixels in either the first or second combination are arranged in this multi-primary-color display panel 200. That is why this multi-primary-color display panel 200 has a horizontal resolution of H. Specifically, on the first row of the multi-primary-color display panel 200, H pairs of subpixels in the first combination (i.e., red and green subpixels) are arranged periodically. On the second row of the multi-primary-color display panel 200, H pairs of subpixels in the second combination (i.e., blue and yellow subpixels) are arranged periodically.

In this case, the video signal has a vertical resolution of 2M and a horizontal resolution of 2H. In an odd-numbered field, the red subpixel (R) at the intersection between the first row and first column of the multi-primary-color display panel 200 has a luminance that has been obtained based on values $R_{1,1}$ and $R_{1,2}$, and the blue subpixel (B) at the intersection between the second row and first column of the multi-primary-color display panel 200 has a luminance that has been obtained based on values $B_{1,1}$ and $B_{1,2}$. Also, the green subpixel (G) at the intersection between the first row and second column of the multi-primary-color display panel 200 has a luminance that has been obtained based on values $G_{1,2}$ and $G_{1,3}$ and the yellow subpixel (Ye) at the intersection between the second row and second column of the multi-primary-color display panel 200 has a luminance that has been obtained based on values $Ye_{1,2}$ and $Ye_{1,3}$.

In this manner, a subpixel at the intersection between the $(s-1)^{th}$ row and the $t^{th}$ column and a subpixel at the intersection between the $s^{th}$ row and the $t^{th}$ column of the multi-primary-color display panel 200 have luminance values that have been obtained based on the values of the video signal representing the colors of a pixel at the intersection between the $p^{th}$ row and the $q^{th}$ column and a pixel at the intersection between the $p^{th}$ row and the $(q+1)^{th}$ column. Also, a subpixel at the intersection between the $(s-1)^{th}$ row and the $(t+1)^{th}$ column and a subpixel at the intersection between the $s^{th}$ row and the $(t+1)^{th}$ column of the multi-primary-color display panel 200 have luminance values that have been obtained based on the values representing the colors of a pixel at the intersection between the $p^{th}$ row and the $(q+1)^{th}$ column and a pixel at the intersection between the $p^{th}$ row and the $(q+2)^{th}$ column.

Next considering FIG. 21B, in an even-numbered field, the blue subpixel (B) at the intersection between the second row and first column of the multi-primary-color display panel 200 has a luminance that has been obtained based on values $B_{2,1}$ and $B_{2,2}$, and the red subpixel (R) at the intersection between the third row and first column of the multi-primary-color display panel 200 has a luminance that has been obtained based on values $R_{2,1}$ and $R_{2,2}$. Also, the yellow subpixel (Ye) at the intersection between the second row and second column of the multi-primary-color display panel 200 has a luminance that has been obtained based on values $Ye_{2,2}$ and $Ye_{2,3}$ and the green subpixel (G) at the intersection between the third row and second column of the multi-primary-color display panel 200 has a luminance that has been obtained based on values $G_{2,2}$ and $G_{2,3}$.

In this manner, a subpixel at the intersection between the $s^{th}$ row and the $t^{th}$ column and a subpixel at the intersection between the $(s+1)^{th}$ row and the $t^{th}$ column of the multi-primary-color display panel 200 have luminance values that have been obtained based on the values representing the colors of a pixel at the intersection between the $(p+1)^{th}$ row and the $q^{th}$ column and a pixel at the intersection between the $(p+1)^{th}$ row and the $(q+1)^{th}$ column. Also, a subpixel at the intersection between the $s^{th}$ row and the $(t+1)^{th}$ column and a subpixel at the intersection between the $(s+1)^{th}$ row and the $(t+1)^{th}$ column of the multi-primary-color display panel 200 have luminance values that have been obtained based on the values representing the colors of a pixel at the intersection between the $(p+1)^{th}$ row and the $(q+1)^{th}$ column and a pixel at the intersection between the $(p+1)^{th}$ row and the $(q+2)^{th}$ column.

As described above, in the multi-primary-color display panel of the display device of this preferred embodiment, each set of subpixels arranged in two columns and two rows forms a single pixel and each single subpixel has a luminance value that has been obtained based on the values representing the colors of two pixels that are adjacent to each other in the column direction. Thus, the multi-primary-color display panel that has a nominal vertical resolution of M can conduct a display operation in accordance with a video signal with a vertical resolution of 2M. As a result, a substantial decrease in resolution can be prevented even when a display operation is conducted in an increased number of primary colors. On top of that, even though the display device 100 is driven by the interlace driving technique, the horizontal resolution can still be converted by making calculations based on the values of the video signal representing the colors of two pixels that are adjacent to each other in the row direction.

Figure 22:
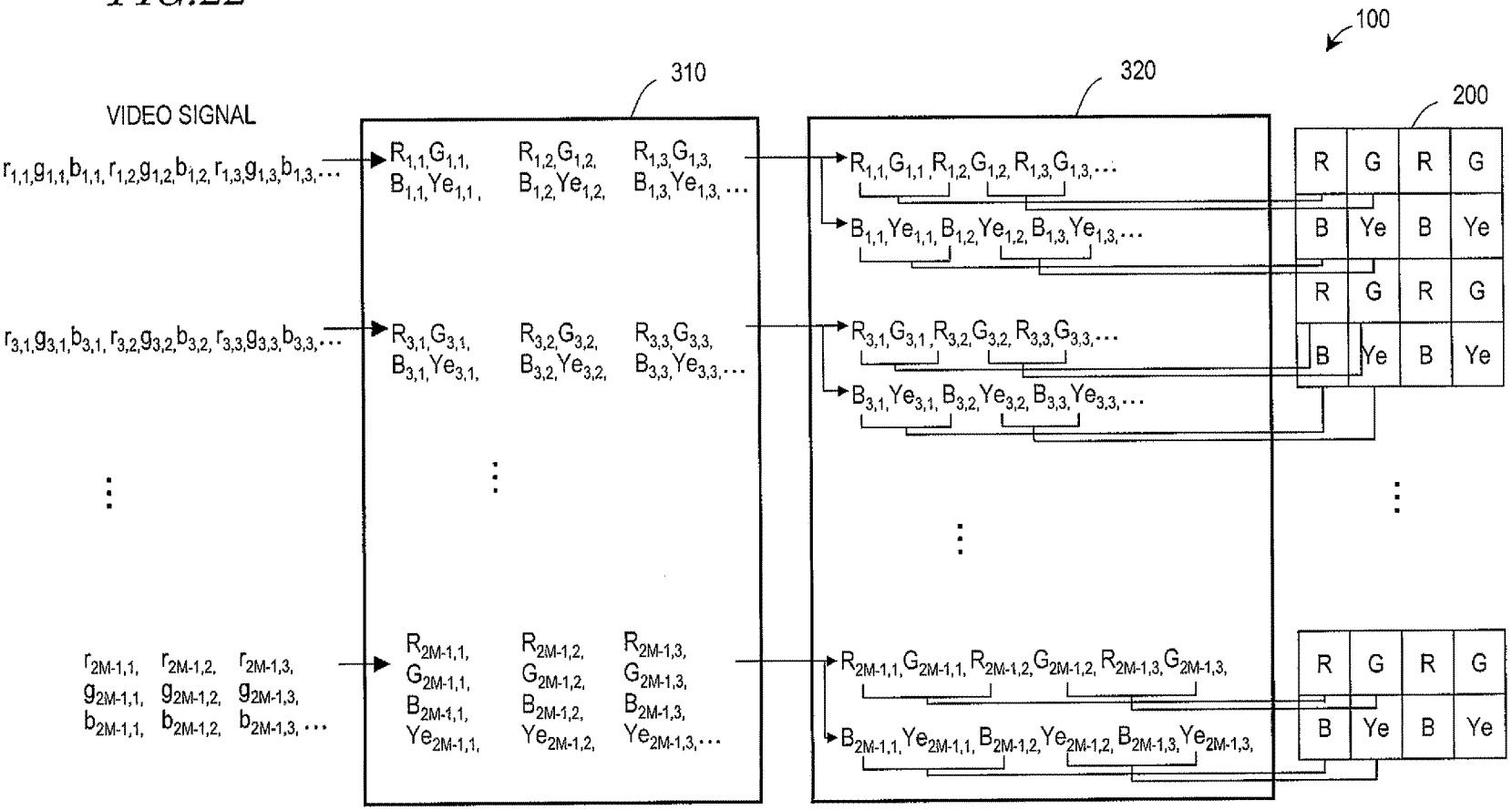
FIG. 22 is a schematic representation showing correspondence between pixels in an odd-numbered field of a video signal and subpixels of a multi-primary-color display panel in the display device of the seventh preferred embodiment of the present invention.
Figure 23:
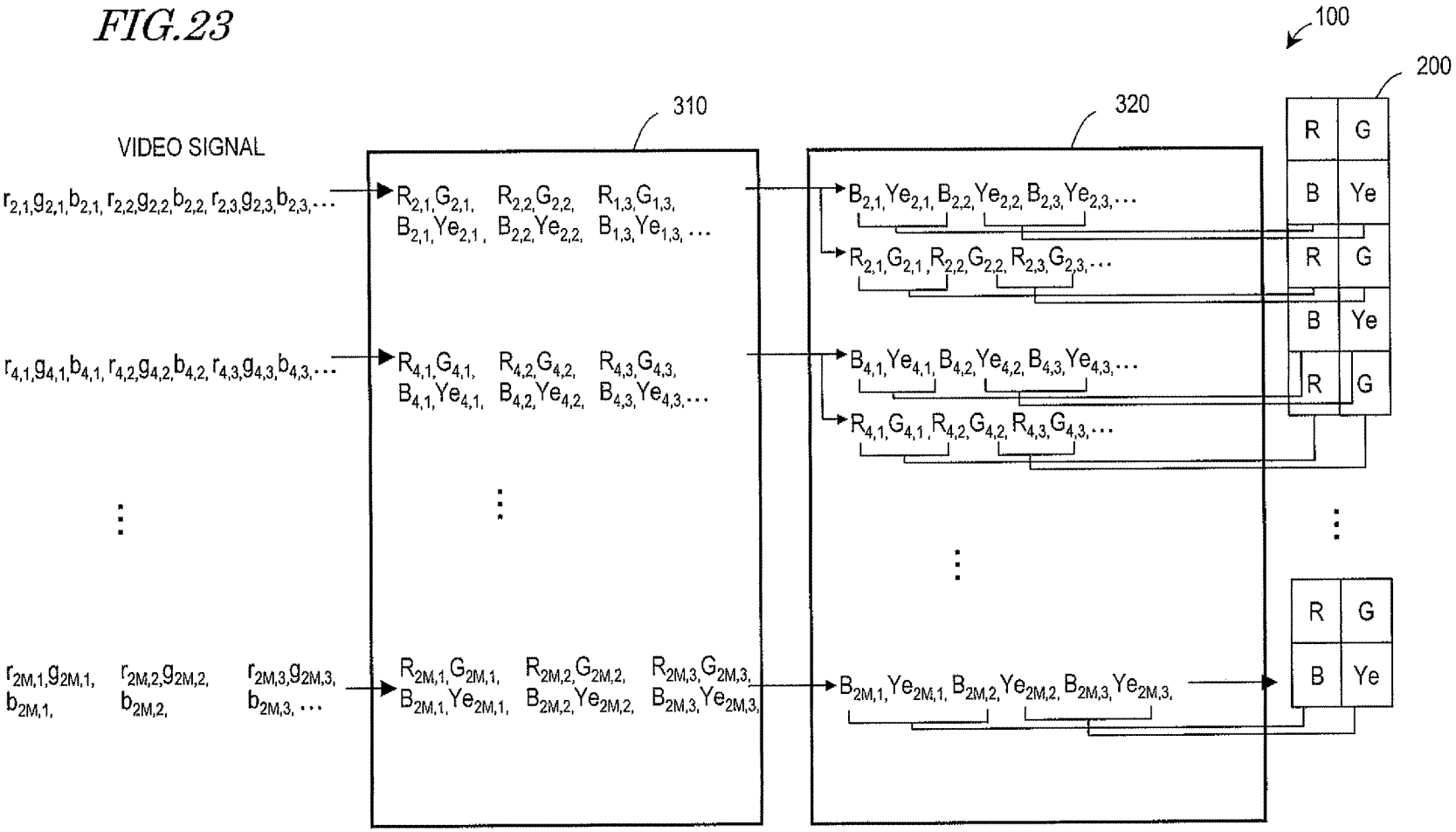
FIG. 23 is a schematic representation showing correspondence between pixels in an even-numbered field of a video signal and subpixels of a multi-primary-color display panel in the display device of the seventh preferred embodiment of the present invention.

Hereinafter, it will be described with reference to FIGS. 22 and 23 how the luminance values of respective subpixels vary in the display device 100 of this preferred embodiment. In this example, the display device 100 preferably is driven by the interlace driving technique.

First of all, the luminance values of respective subpixels of the multi-primary-color display panel 200 in an odd-numbered field will be described with reference to FIG. 22. A value $r_{x,y}g_{x,y}b_{x,y}$ represents the color of a pixel at the intersection between the $x^{th}$ row and the $y^{th}$ column in the video signal. The values $r_{x,y}$, $g_{x,y}$ and $b_{x,y}$ are the respective luminance values (or luminance levels) of red, green and blue of a pixel at the intersection between the $x^{th}$ row and $y^{th}$ column. Specifically, a value $r_{1,1}g_{1,1}b_{1,1}$ represents the color of a pixel at the intersection between the first row and first column in the video signal. A value $r_{1,2}g_{1,2}b_{1,2}$ represents the color of a pixel at the intersection between the first row and second column in the video signal. A value $r_{3,1}g_{3,1}b_{3,1}$ represents the color of a pixel at the intersection between the third row and first column in the video signal. And a value $r_{2M-1,1}g_{2M-1,1}b_{2M-1,1}$ represents the color of a pixel at the intersection between the $(2M-1)^{th}$ row and first column. In this manner, a value $r_{2u-1,y}g_{2u-1,y}b_{2u-1,y}$ (where u is a natural number falling within the range of one through M) represents the color of a pixel on an odd-numbered row in the video signal.

The multi-primary-color converter 310 obtains a value $R_{1,1}G_{1,1}B_{1,1}Ye_{1,1}$ based on the luminance value $r_{1,1}g_{1,1}b_{1,1}$ and also obtains a value $R_{1,2}G_{1,2}B_{1,2}Ye_{1,2}$ based on the luminance value $r_{1,2}g_{1,2}b_{1,2}$. In the same way, the multi-primary-color converter 310 obtains a value $R_{3,1}G_{3,1}B_{3,1}Ye_{3,1}$ based on the luminance value $r_{3,1}g_{3,1}b_{3,1}$ of the video signal and also obtains a value $R_{3,2}G_{3,2}B_{3,2}Ye_{3,2}$ based on the luminance value $r_{3,2}g_{3,2}b_{3,2}$. In this manner, the multi-primary-color converter 310 obtains a value $R_{2u-1,y}G_{2u-1,y}B_{2u-1,y}Ye_{2u-1,y}$ based on a value $r_{2u-1,y}g_{2u-1,y}b_{2u-1,y}$. To get the multi-primary-color conversion done, the multi-primary-color converter 310 may consult a lookup table, carry out calculations by a predetermined mathematical equation, or perform both of these in combination.

The resolution converter 320 determines the luminance value of the red subpixel at the intersection between the first row and first column of the multi-primary-color display panel 200 based on the values $R_{1,1}$ and $R_{1,2}$ and also determines the luminance value of the green subpixel at the intersection between the first row and second column of the multi-primary-color display panel 200 based on the values $G_{1,2}$ and $G_{1,3}$. Likewise, the resolution converter 320 determines the luminance value of the blue subpixel at the intersection between the second row and first column of the multi-primary-color display panel 200 based on the values $B_{1,1}$ and $B_{1,2}$ and also determines the luminance value of the yellow subpixel at the intersection between the second row and second column of the multi-primary-color display panel 200 based on the values $Ye_{1,2}$ and $Ye_{1,3}$. In the same way, the resolution converter 320 determines the luminance value of the red subpixel at the intersection between the third row and first column of the multi-primary-color display panel 200 based on the values $R_{3,1}$ and $R_{3,2}$ and also determines the luminance value of the green subpixel at the intersection between the third row and second column based on the values $G_{3,2}$ and $G_{3,3}$.

The values R', G', B' and Ye' of red, green, blue and yellow subpixels in the multi-primary-color display panel 200 can be respectively represented as:

$$R'_{2u-1,2h-1}=f(R_{2u-1,2h-1},R_{2u-1,2h})$$

$$G'_{2u-1,2h}=f(G_{2u-1,2h},G_{2u-1,2h+1})$$

$$B'_{2u,2h-1}=f(B_{2u-1,2h-1},B_{2u-1,2h}) \text{ and}$$

$$Ye'_{2u,2h}=f(Ye_{2u-1,2h},Ye_{2u-1,2h+1})$$

where f is a function. For example, f may be a function for calculating the average (i.e., the arithmetic mean) of variables. Alternatively, f may also be a function for dividing the product of independent variables by the number of the independent variables. In this manner, the resolution converter 320 determines the luminance values of a subpixel at the intersection between the $(2u-1)^{th}$ row and $y^{th}$ column and a subpixel at the intersection between the $2u^{th}$ row and $y^{th}$ column of the multi-primary-color signal based on values $R_{2u-1,y}G_{2u-1,y}B_{2u-1,y}Ye_{2u-1,y}$ and $R_{2u-1,y+1}G_{2u-1,y+1}B_{2u-1,y+1}Ye_{2u-1,y+1}$ in an odd-numbered field.

Next, the luminance values of respective subpixels of the multi-primary-color display panel 200 in an even-numbered field will be described with reference to FIG. 23. A value $r_{2v,y}g_{2v,y}b_{2v,y}$ (where v is a natural number falling within the range of one through M−1) represents the color of a pixel on an even-numbered row in the video signal.

The multi-primary-color converter 310 obtains a value $R_{2,1}G_{2,1}B_{2,1}Ye_{2,1}$ based on the luminance value $r_{2,1}g_{2,1}b_{2,1}$ and also obtains a value $R_{2,2}G_{2,2}B_{2,2}Ye_{2,2}$ based on the luminance value $r_{2,2}g_{2,2}b_{2,2}$. In the same way, the multi-primary-color converter 310 obtains a value $R_{4,1}G_{4,1}B_{4,1}Ye_{4,1}$ based on the luminance value $r_{4,1}g_{4,1}b_{4,1}$ of the video signal and also obtains a value $R_{4,2}G_{4,2}B_{4,2}Ye_{4,2}$ based on the luminance value $r_{4,2}g_{4,2}b_{4,2}$. In this manner, the multi-primary-color converter 310 obtains a value $R_{2v,y}G_{2v,y}B_{2v,y}Ye_{2v,y}$ based on a value $r_{2v,y}g_{2v,y}b_{2v,y}$.

The resolution converter 320 determines the luminance value of the blue subpixel at the intersection between the second row and first column of the multi-primary-color display panel 200 based on the values $B_{2,1}$ and $B_{2,2}$ and also determines the luminance value of the yellow subpixel at the intersection between the second row and second column of the multi-primary-color display panel 200 based on the values $Ye_{2,2}$ and $Ye_{2,3}$. Likewise, the resolution converter 320 determines the luminance value of the red subpixel at the intersection between the third row and first column of the multi-primary-color display panel 200 based on the values $R_{2,1}$ and $R_{2,2}$ and also determines the luminance value of the green subpixel at the intersection between the third row and second column of the multi-primary-color display panel 200 based on the values $G_{2,2}$ and $G_{2,3}$. In the same way, the resolution converter 320 determines the luminance value of the blue subpixel at the intersection between the fourth row and first column of the multi-primary-color display panel 200 based on the values $B_{4,1}$ and $B_{4,2}$ and also determines the luminance value of the yellow subpixel at the intersection between the fourth row and second column based on the values $Ye_{4,2}$ and $Ye_{4,3}$. Furthermore, the resolution converter 320 determines the luminance value of the red subpixel at the intersection between the fifth row and first column of the multi-primary-color display panel 200 based on the values $R_{4,1}$ and $R_{4,2}$ and also determines the luminance value of the green subpixel at the intersection between the fifth row and second column based on the values $G_{4,2}$ and $G_{4,3}$. These values may be respectively represented by:

$$R'_{2v+1,2h-1}=f(R_{2v,2h-1},R_{2v,2h})$$

$$G'_{2v+1,2h}=f(G_{2v,2h},G_{2v+1,2h+1})$$

$$B'_{2v,2h-1}=f(B_{2v,2h-1},B_{2v,2h}) \text{ and}$$

$$Ye'_{2v,2h}=f(Ye_{2v+1,2h},Ye_{2v+1,2h+1})$$

where f is a function. In this manner, the resolution converter 320 determines the luminance values of a subpixel at the intersection between the $2v^{th}$ row and $y^{th}$ column and a subpixel at the intersection between the $(2v+1)^{th}$ row and $y^{th}$ column of the multi-primary-color signal based on values $R_{2v,y}G_{2v,y}B_{2v,y}Ye_{2v,y}$ and $R_{2v,y+1}G_{2v,y+1}B_{2v,y+1}Ye_{2v,y+1}$ in an even-numbered field.

As described above, the resolution converter 320 generates a multi-primary-color signal that has vertical and horizontal resolutions that are twice as high as those of the video signal, and the multi-primary-color display panel 200 presents video using a video signal, of which the resolution is four times as high as the nominal one. Generally speaking, it is difficult to present high resolution video on the monitor screen of a cellphone due to the limit of its screen size. However, by using the display device 100 of this preferred embodiment as the monitor screen of a cellphone, even if the multi-primary-color display panel is a QVGA with 320×240 pixels, VGA-grade video with a resolution comparable to 640×480 pixels can be presented.

In the foregoing description, the display is preferably driven by the interlace driving technique. However, the present invention is in no way limited to it. The display device may also be driven by the progressive driving technique.

Figure 24:
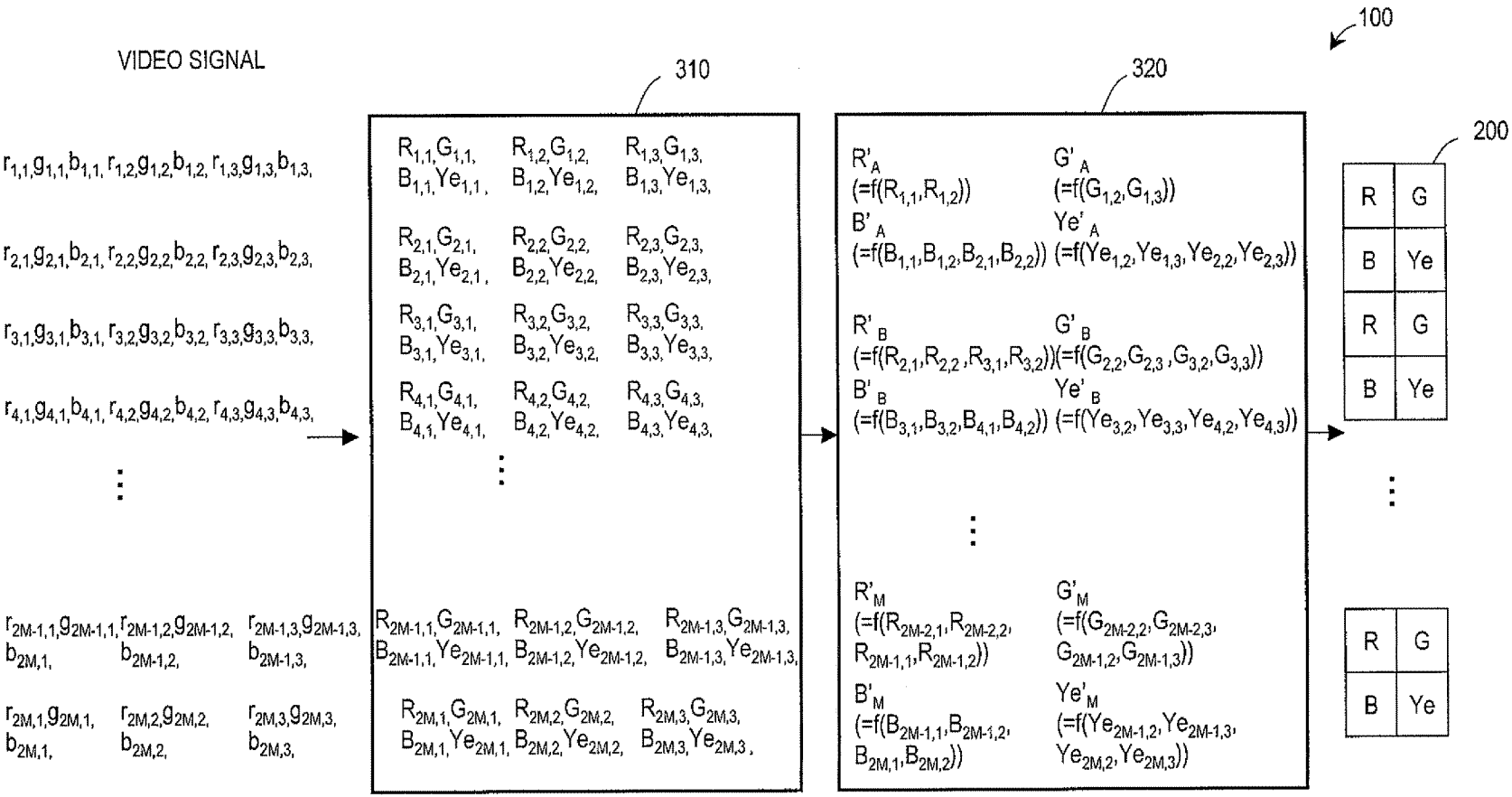
FIG. 24 is a schematic representation showing correspondence between pixels in a video signal and subpixels of a multi-primary-color display panel in a display device as a modified example of the seventh preferred embodiment of the present invention.

Hereinafter, a display device 100 to be driven by the progressive driving technique will be described with reference to FIG. 24. The multi-primary-color converter 310 of the display device 100 obtains a value $R_{x,y}G_{x,y}B_{x,y}Ye_{x,y}$ based on a value $r_{x,y}g_{x,y}b_{x,y}$ representing the color of a pixel at the intersection between the $x^{th}$ row and $y^{th}$ column. Specifically, the multi-primary-color converter 310 obtains a value $R_{1,1}G_{1,1}B_{1,1}Ye_{1,1}$ based on a value $r_{1,1}g_{1,1}b_{1,1}$ representing the color of a pixel at the intersection between the first row and first column in the video signal, and also obtains a value $R_{1,2}G_{1,2}B_{1,2}Ye_{1,2}$ based on a value $r_{1,2}g_{1,2}b_{1,2}$ representing the color of a pixel at the intersection between the first row and second column. In the same way, the multi-primary-color converter 310 obtains a value $R_{3,1}G_{3,1}B_{3,1}Ye_{3,1}$ based on a value $r_{3,1}g_{3,1}b_{3,1}$ representing the color of a pixel at the intersection between the third row and first column in the video signal, and also obtains a value $R_{2M,1}G_{2M,1}B_{2M,1}Ye_{2M,1}$ based on a value $r_{2M,1}g_{2M,1}b_{2M,1}$ representing the color of a pixel at the intersection between the $2M^{th}$ row and first column.

The resolution converter 320 converts the resolution by obtaining the luminance value of each subpixel based on the values of its associated adjacent pixels in the row and column directions. Specifically, the resolution converter 320 determines a value $B'_A$ corresponding to the luminance of the blue subpixel at the intersection between the second row and first column based on values $B_{1,1}$, $B_{1,2}$, $B_{2,1}$ and $B_{2,2}$. For example, the resolution converter 320 may determine $B_A$ to be the average of these four values $B_{1,1}$, $B_{1,2}$, $B_{2,1}$ and $B_{2,2}$. Also, the resolution converter 320 determines a value $Ye'_A$ corresponding to the luminance of the yellow subpixel at the intersection between the second row and second column based on values $Ye_{1,2}$, $Ye_{1,3}$, $Ye_{2,2}$ and $Ye_{2,3}$. In the same way, the resolution converter 320 determines a value $R'_B$ corresponding to the luminance of the red subpixel at the intersection between the third row and first column based on values $R_{2,1}$, $R_{2,2}$, $R_{3,1}$ and $R_{3,2}$ and also determines a value $G'_B$ corresponding to the luminance of the green subpixel at the intersection between the third row and second column based on values $G_{2,2}$, $G_{2,3}$, $G_{3,2}$ and $G_{3,3}$. These values are represented by:

$$R'_{2w+1,2h-1}=f(R_{2w,2h-1},R_{2w,2h},R_{2w+1,2h-1},R_{2w+1,2h})$$

$$G'_{2w+1,2h}=f(G_{2w,2h},G_{2w,2h+1},G_{2w+1,2h},G_{2w+1,2h+1})$$

$$B'_{2w,2h-1}=f(B_{2w+1,2h-1},B_{2w+1,2h},B_{2w+2,2h-1},B_{2w+2,2h})$$

and $$Ye'_{2w,2h}=f(Ye_{2w+1,2h},Ye_{2w+1,2h+1},Ye_{2w+2,2h},Ye_{2w+2,2h+1})$$

It should be noted that the luminance value $B'_M$ of the blue subpixel at the intersection between the $2M^{th}$ row and first column is determined based on values $B_{2M-1,1}$, $B_{2M-1,2}$, $B_{2M,1}$ and $B_{2M,2}$. The luminance value $Ye'_M$ of the yellow subpixel at the intersection between the $2M^{th}$ row and second column is determined based on values $Ye_{2M-1,2}$, $Ye_{2M-1,3}$, $Ye_{2M,2}$ and $Ye_{2M,3}$. The luminance value $R'_A$ of the red subpixel at the intersection between the first row and first column is determined based on values $R_{1,1}$ and $R_{1,2}$. And the luminance value $G'_A$ of the green subpixel at the intersection between the first row and second column is determined based on values $G_{1,2}$ and $G_{1,3}$.

As described above, the display device 100 of this preferred embodiment determines the luminances of subpixels based on a result of a multi-primary-color conversion that has been carried out on values of the video signal representing the colors of pixels that are adjacent in the column and row directions, thereby substantially increasing the vertical and horizontal resolutions of the multi-primary-color display panel 200 and getting a display operation done with high resolutions. On top of that, by inputting a multi-primary-color signal to a driver (not shown) that drives signal lines and scan lines, a display operation can be carried out in multiple primary colors without changing the drivers.

In the foregoing description, the luminance value of a subpixel located at the intersection between the $s^{th}$ row and $t^{th}$ column of the multi-primary-color display panel is determined based on four pixels of the video signal (i.e., the pixels located at the intersections between the $p^{th}$ row and $q^{th}$ column, between the $p^{th}$ row and $(q+1)^{th}$ column, between the $(p+1)^{th}$ row and $q^{th}$ column and between the $(p+_1)^{th}$ row and $(q+1)^{th}$ column, respectively). However, the present invention is in no way limited to it. Furthermore, in the foregoing description, approximately half or more of the values that have gone through the multi-primary-color conversion is used. However, the present invention is in no way limited to it. Only a portion of those values that have gone through the multi-primary-color conversion may be used as well.

Figure 25:
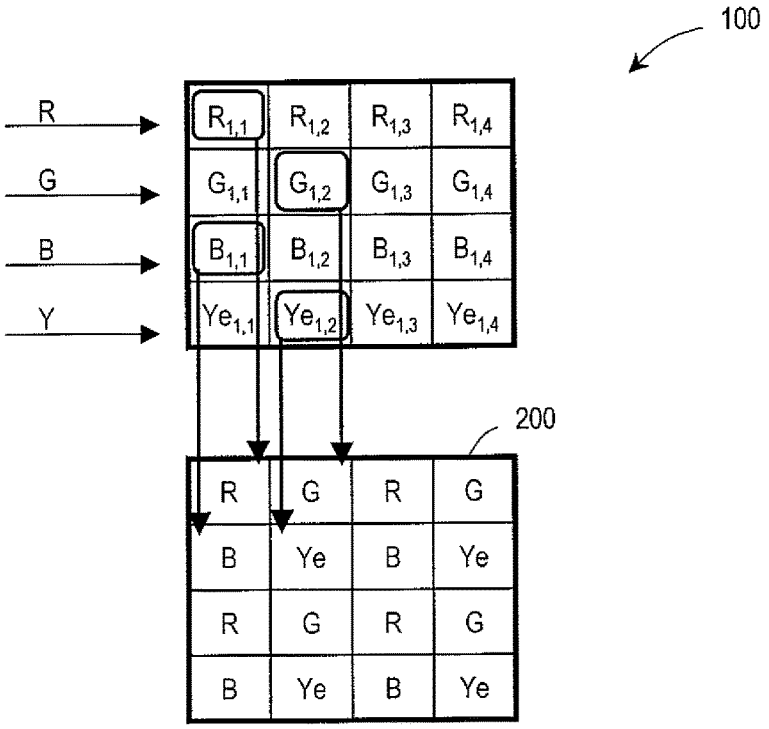
FIG. 25 is a schematic representation showing correspondence between pixels in an odd-numbered field of a video signal and subpixels of a multi-primary-color display panel in a display device as another modified example of the seventh preferred embodiment of the present invention.

Hereinafter, a modified example of the display device as the seventh preferred embodiment of the present invention will be described with reference to FIG. 25. In the following example, the display device preferably is driven by the interlace driving technique.

In an odd-numbered field, the red subpixel (R) located at the intersection between the first row and first column of the multi-primary-color display panel 200 has a luminance corresponding to a value $R_{1,1}$ and the blue subpixel (B) located at the intersection between the second row and first column of the multi-primary-color display panel 200 has a luminance corresponding to a value $B_{1,1}$. Also, the green subpixel (G) located at the intersection between the first row and second column of the multi-primary-color display panel 200 has a luminance corresponding to a value $G_{1,2}$ and the yellow subpixel (Ye) located at the intersection between the second row and second column of the multi-primary-color display panel 200 has a luminance corresponding to a value $Ye_{1,2}$.

In this manner, the subpixels located at the intersection between the $(s-1)^{th}$ row and $t^{th}$ column and between the $s^{th}$ row and $t^{th}$ column of the multi-primary-color display panel 200 may have luminance values that have been obtained based on a value representing the color of a pixel at the intersection between the $p^{th}$ row and $q^{th}$ column. Also, the subpixels located at the intersection between the $(s-1)^{th}$ row and $(t+1)^{th}$ column and between the $s^{th}$ row and $(t+1)^{th}$ column of the multi-primary-color display panel 200 may have luminance values that have been obtained based on a value representing the color of a pixel at the intersection between the $p^{th}$ row and $(q+1)^{th}$ column. In that case, the display device 100 can increase the resolution of the multi-primary-color display panel 200 substantially without performing any particular calculations after the multi-primary-color conversion is done.

In the foregoing description, a single subpixel of the multi-primary-color display panel is associated with at most 2L pixels of the video signal. However, the present invention is in no way limited to it. A single subpixel of the multi-primary-color display panel may be associated with more than 2L pixels of the video signal. Also, in the foregoing description, values $R_{x,y}$, $G_{x,y}$, $B_{x,y}$ and $Ye_{x,y}$ obtained by subjecting a value representing the color of a single pixel of the video signal to multi-primary-color conversion are associated with a single subpixel of the multi-primary-color display panel. However, the present invention is in no way limited to it, either. The values $R_{x,y}$, $G_{x,y}$, $B_{x,y}$ and $Ye_{x,y}$ obtained by subjecting a value representing the color of a single pixel of the video signal to multi-primary-color conversion may be associated with two or more subpixels of the multi-primary-color display panel.

Figure 26:
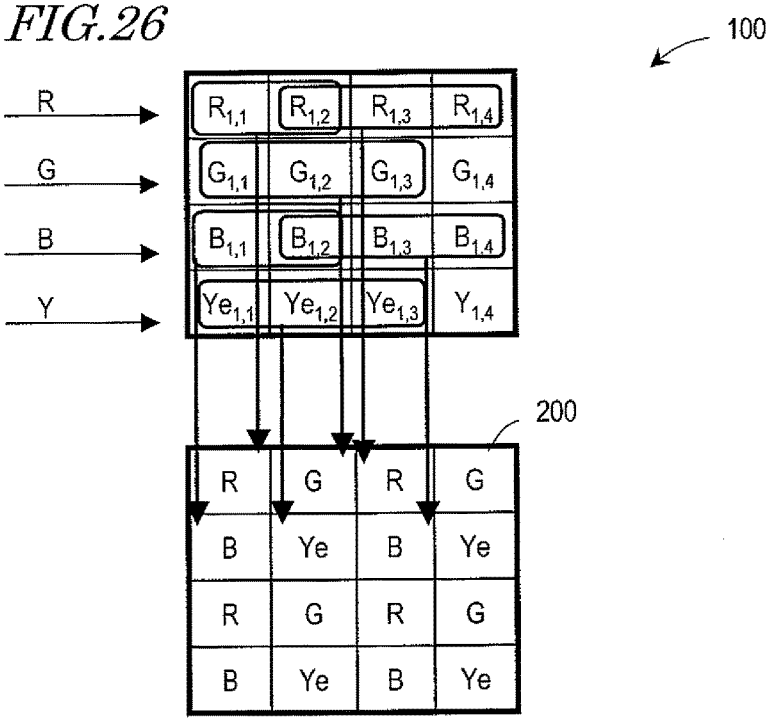
FIG. 26 is a schematic representation showing correspondence between pixels in an odd-numbered field of a video signal and subpixels of a multi-primary-color display panel in a display device as still another modified example of the seventh preferred embodiment of the present invention.

Hereinafter, another modified example of the display device as the seventh preferred embodiment of the present invention will be described with reference to FIG. 26.

In an odd-numbered field, the green subpixel (G) located at the intersection between the first row and second column of the multi-primary-color display panel 200 has a luminance value that has been obtained based on values $G_{1,1}$, $G_{1,2}$ and $G_{1,3}$. The yellow subpixel (Ye) located at the intersection between the second row and second column of the multi-primary-color display panel 200 has a luminance value that has been obtained based on values $Ye_{1,1}$, $Ye_{1,2}$ and $Ye_{1,3}$. The red subpixel (R) located at the intersection between the first row and third column of the multi-primary-color display panel 200 has a luminance value that has been obtained based on values $R_{1,2}$, $R_{1,3}$ and $R_{1,4}$. And the blue subpixel (B) located at the intersection between the second row and third column of the multi-primary-color display panel 200 has a luminance value that has been obtained based on values $B_{2,2}$, $B_{2,3}$ and $B_{2,4}$. In this case, the luminance of each subpixel is preferably weighted such that the central one of the three values has the greatest coefficient. Then, a display operation can be conducted smoothly. Alternatively, the luminance of each subpixel may also be the arithmetic mean of its associated three values.

In presenting mostly natural pictures, the colors of adjacent pixels often vary continuously, and therefore, the grayscales often vary smoothly, too. In that case, an image, of which the colors vary continuously, can be reproduced with rather good fidelity even without adding weights, such as the arithmetic mean.

On the other hand, in presenting characters, tables and so on, the grayscales sometimes change significantly between adjacent pixels. That is why if the luminances of pixels in line were not weighted but simply averaged, then the resultant image could possibly be blurred or the grayscale levels could be reversed between adjacent pixels. For example, if the arithmetic mean of $(G_{1,2n-1}, G_{1,2n}, G_{1,2n+1}, G_{1,2n+2})=(50, 100, 50, 100)$ is calculated, then $$G_{1,2n}=f(G_{1,2n-1},G_{1,2n},G_{1,2n+1})=66 \text{ and}$$

$$G_{1,2n+1}=f(G_{1,2n},G_{1,2n+1},G_{1,2n+2})=83$$

In that case, although $G_{1,2n}>G_{1,2n+1}$ should originally be satisfied, $G_{1,2n}<G_{1,2n+1}$ is now satisfied, which means that the grayscale levels have been reversed. That is why in that case, the coefficients are preferably weighted rather than calculating the arithmetic mean. Alternatively, either weighting or calculating an arithmetic mean is selectively carried out according to the intended application.

As described above, a single subpixel of the multi-primary-color display panel 200 may have a luminance value that has been obtained based on values representing the colors of three pixels of the video signal. Specifically, subpixels located at the intersection between the $(s-1)^{th}$ row and $(t+1)^{th}$ column and the intersection between the $s^{th}$ row and $(t+1)^{th}$ column of the multi-primary-color display panel 200 may have luminance values that have been obtained based on values representing the colors of pixels at the intersections between the $p^{th}$ row and $q^{th}$ column, between the $p^{th}$ row and $(q+1)^{th}$ column, and between the $p^{th}$ row and $(q+2)^{th}$ column. Also, subpixels located at the intersection between the $(s-1)^{th}$ row and $(t+2)^{th}$ column and the intersection between the $s^{th}$ row and $(t+_2)^{th}$ column of the multi-primary-color display panel 200 may have luminance values that have been obtained based on values representing the colors of pixels at the intersections between the $p^{th}$ row and $(q+1)^{th}$ column, between the $p^{th}$ row and $(q+2)^{th}$ column, and between the $p^{th}$ row and $(q+3)^{th}$ column.

Preferred Embodiment 8

In the display device of the seventh preferred embodiment described above, subpixels that are arranged in two columns and two rows in the multi-primary-color display panel PREFERABLY form a single pixel. However, the present invention is in no way limited to it.

Hereinafter, an eighth preferred embodiment of a display device according to the present invention will be described. As already described with reference to FIG. 3, subpixels that are arranged in three columns and two rows in the multi-primary-color display panel 200 of the display device 100 of this preferred embodiment form a single pixel. In the display device 100 of this preferred embodiment, at least one of the three columns of subpixels associated with the $q^{th}$ column of pixels of the video signal is also associated with the $(q+1)^{th}$ column of pixels of the video signal. For example, one of the three columns of subpixels associated with the $q^{th}$ column of pixels of the video signal is also associated with the $(q+1)^{th}$ column of pixels.

Hereinafter, the correspondence between pixels of the video signal and subpixels of the multi-primary-color display panel in the display device of this preferred embodiment will be described with reference to FIG. 27, in which shown are only a certain row of pixels in a field of the video signal and their associated subpixels of the multi-primary-color display panel 200. However, the description of the other rows is omitted herein to avoid complicating the description excessively. A value $Ra_1G_1B_1Ye_1C_1Rb_1$ is obtained by subjecting a value $r_1g_1b_1$ representing the colors of pixels on the first column of the video signal to multi-primary-color conversion. Likewise, values $Ra_2G_2B_2Ye_2C_2Rb_2$, $Ra_3G_3B_3Ye_3C_3Rb_3$, and $Ra_4G_4B_4Ye_4C_4Rb_4$ are obtained respectively by subjecting values $r_2g_2b_2$, $r_3g_3b_3$ and $r_4g_4b_4$ representing the colors of pixels on the second, third and fourth columns of the video signal to multi-primary-color conversion.

Figures 27A, 27B, 27C:
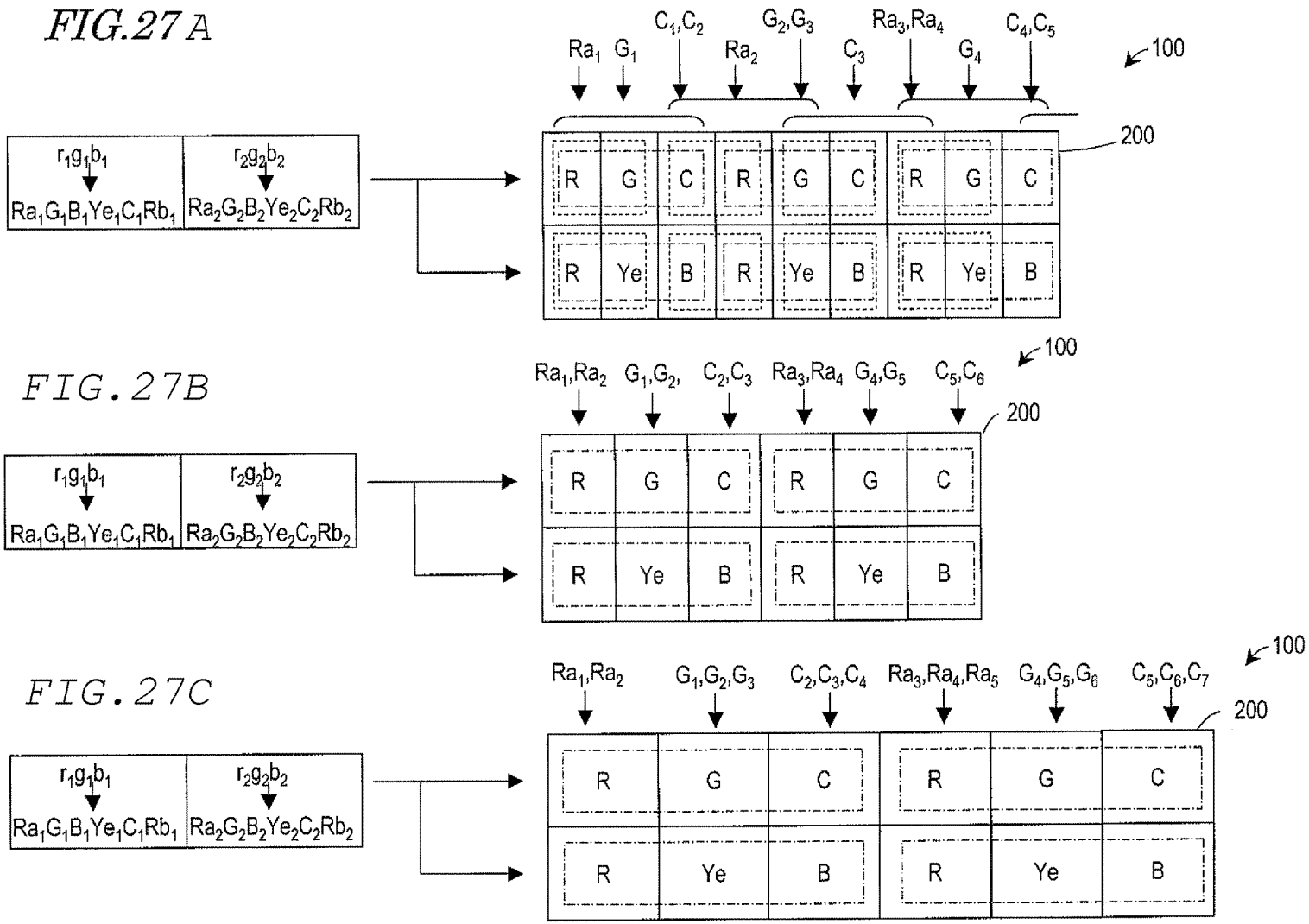
FIGS. 27A, 27B and 27C are schematic representations showing correspondence between pixels in a video signal and subpixels of a multi-primary-color display panel in a display device as an eighth preferred embodiment of the present invention.

As shown in FIG. 27A, the red subpixel on the first column of the multi-primary-color display panel 200 has a luminance corresponding to $Ra_1$. The green subpixel on the second column of the multi-primary-color display panel 200 has a luminance corresponding to $G_1$. The cyan subpixel on the third column of the multi-primary-color display panel 200 has a luminance value that has been obtained based on $C_1$ and $C_2$. The red subpixel on the fourth column of the multi-primary-color display panel 200 has a luminance corresponding to $Ra_2$. The green subpixel on the fifth column of the multi-primary-color display panel 200 has a luminance value that has been obtained based on $G_2$ and $G_3$. And the cyan subpixel on the sixth column of the multi-primary-color display panel 200 has a luminance corresponding to $C_3$. In this manner, every subpixel on each odd-numbered column of the multi-primary-color display panel 200 but a corner subpixel is associated with pixels on two columns of the video signal. Consequently, the substantial horizontal resolution of the multi-primary-color display panel 200 can be approximately 1.5 times as high as the nominal one.

In the example described above, one of the three columns of subpixels associated with the $q^{th}$ column of pixels of the video signal is also associated with the $(q+1)^{th}$ column of pixels of the video signal. However, the present invention is in no way limited to it. Two of the three columns of subpixels of the multi-primary-color display panel associated with the $q^{th}$ column of pixels of the video signal may also be associated with the $(q+1)^{th}$ column of pixels.

Hereinafter, correspondence between pixels of the video signal and subpixels of the multi-primary-color display panel in the display device of this preferred embodiment will be further described with reference to FIGS. 27*b* and 27C.

As shown in FIG. 27B, the red subpixel on the first column of the multi-primary-color display panel 200 is associated with values $Ra_1$ and $Ra_2$. The green subpixel on the second column of the multi-primary-color display panel 200 is associated with values $G_1$ and $G_2$. The cyan subpixel on the third column of the multi-primary-color display panel 200 is associated with values $C_2$ and $C_3$. The red subpixel on the fourth column of the multi-primary-color display panel 200 is associated with values $Ra_3$ and $Ra_4$. The green subpixel on the fifth column of the multi-primary-color display panel 200 is associated with values $G_4$ and $G_5$. And the cyan subpixel on the sixth column of the multi-primary-color display panel 200 is associated with values $C_5$ and $C_6$.

In this manner, every subpixel on each column of the multi-primary-color display panel 200 is associated with pixels on two columns of the video signal. One of the two subpixels associated with the pixel at the intersection between the $p^{th}$ row and $q^{th}$ column in the video signal is also associated with two pixels at the intersections between the $p^{th}$ row and $q^{th}$ column and between the $p^{th}$ row and $(q+1)^{th}$ column in the video signal. As a result, the substantial horizontal resolution of the multi-primary-color display panel 200 can be approximately twice as high as the nominal one.

As shown in FIG. 27C, the red subpixel on the first column of the multi-primary-color display panel 200 is associated with values $Ra_1$ and $Ra_2$. The green subpixel on the second column of the multi-primary-color display panel 200 is associated with values $G_1$, $G_2$ and $G_3$. The cyan subpixel on the third column of the multi-primary-color display panel 200 is associated with values $C_1$, $C_2$ and $C_3$. The red subpixel on the fourth column of the multi-primary-color display panel 200 is associated with values $Ra_3$, $Ra_4$ and $Ra_5$. The green subpixel on the fifth column of the multi-primary-color display panel 200 is associated with values $G_4$, $G_5$ and $G_6$. And the cyan subpixel on the sixth column of the multi-primary-color display panel 200 is associated with values $C_5$, $C_6$ and $C_7$.

In this manner, every subpixel on each column of the multi-primary-color display panel 200 but the corner subpixel is associated with pixels on three columns of the video signal. One of the three subpixels associated with the pixel at the intersection between the $p^{th}$ row and $q^{th}$ column in the video signal is also associated with two pixels at the intersections between the $p^{th}$ row and $q^{th}$ column and between the $p^{th}$ row and $(q+1)^{th}$ column in the video signal. As a result, the substantial horizontal resolution of the multi-primary-color display panel 200 can be approximately three times as high as the nominal one.

Figure 28:
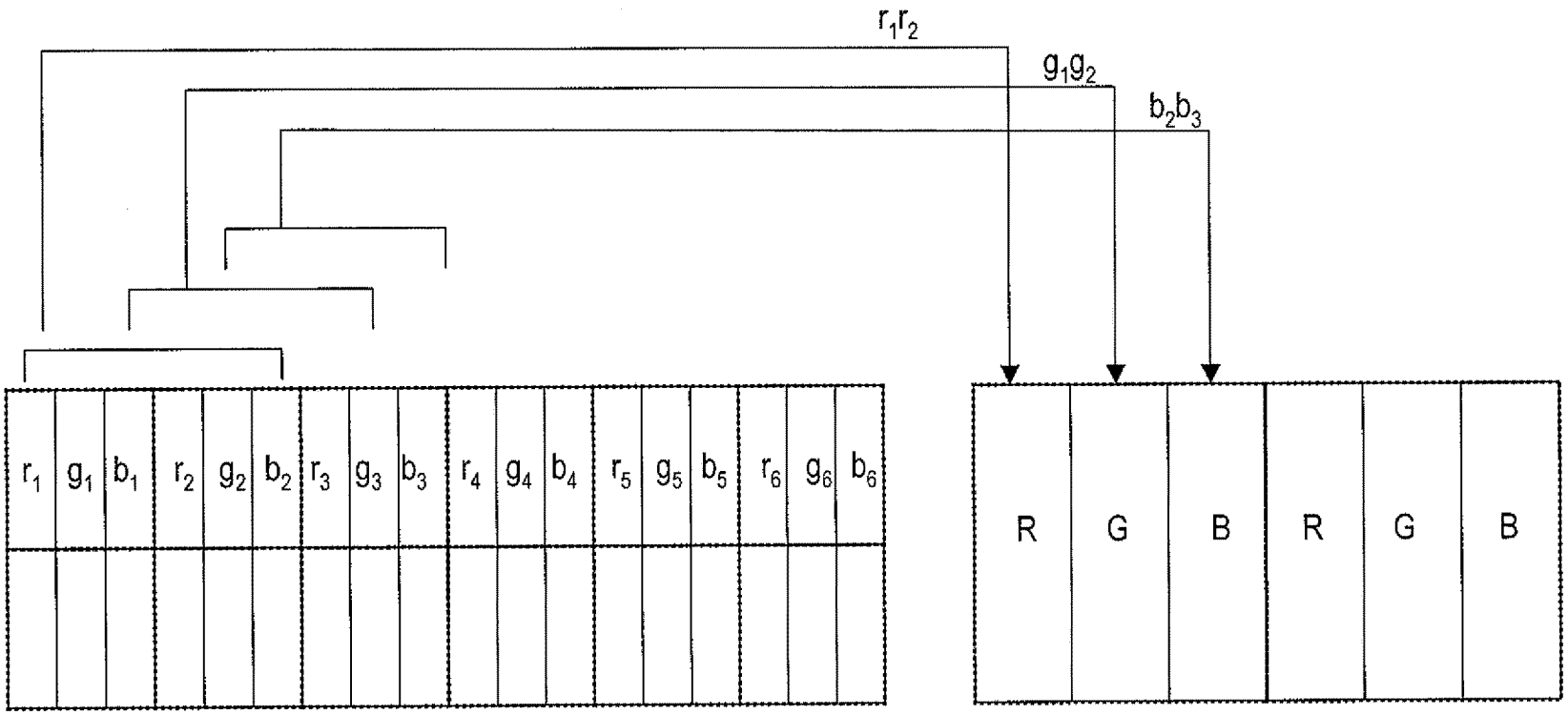
FIG. 28 is a schematic representation showing correspondence between pixels in a video signal and subpixels of a display panel in a comparative display device.
Figure 29A:
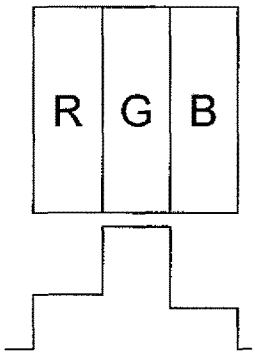
FIGS. 29A, 29B and 29C are schematic representations illustrating various arrangements of subpixels and shapes of the distributions of their luminance ratios in the comparative display device.
Figure 29B:
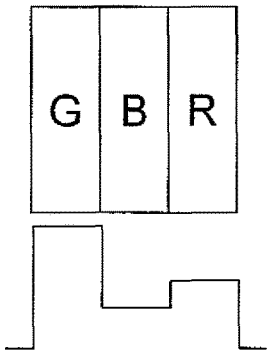
Figure 29C:
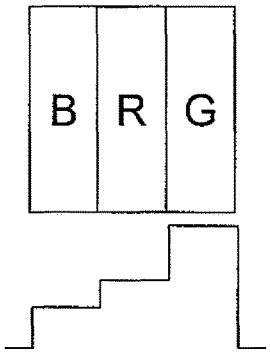

Hereinafter, the advantages of the display device 100 of this preferred embodiment will be described in comparison with a comparative display device. First of all, a comparative display device will be described with reference to FIGS. 28 and 29A-29C. Specifically, FIG. 28 is a schematic representation showing correspondence between pixels in a video signal and subpixels in the display panel of the comparative display device. Meanwhile, FIGS. 29A through 29C are schematic representations each illustrating a single pixel with a different arrangement of subpixels from the other pixels. The description of columns is also omitted herein to avoid complicating the description excessively.

In the comparative display device, each pixel of the display panel is comprised of three subpixels in red, green and blue. When the color white would be displayed (i.e., when the respective subpixels have the highest grayscale), the red, green and blue subpixels have luminance ratios of approximately 23%, 67% and 10%, which are expressed in percentages that have been rounded off to the nearest integer.

As shown in FIG. 28, in the comparative display device, the red subpixel (R) on the first column of the display panel is associated with values $r_1$ and $r_2$ that have been obtained by converting the values representing the colors of pixels on the first and second columns of the video signal. The green subpixel (G) on the second column of the display panel is associated with values g, and $g_2$ that have been obtained by converting the values representing the colors of pixels on the first and second columns of the video signal. And the blue subpixel (B) on the third column of the display panel is associated with values $b_2$ and $b_3$ that have been obtained by converting the values representing the colors of pixels on the second and third columns of the video signal. As can be seen, even in the comparative display device, the substantial horizontal resolution has also been increased and subpixels are cross-associated with multiple pixels, thus getting a display operation done smoothly.

However, the comparative display device sometimes cannot produce color mixture sufficiently. Suppose three consecutive columns have their highest grayscales. In that case, if subpixels on the first, second and third columns of a display panel have their maximum luminances (i.e., their highest grayscales), then the green subpixel located at the center of these three consecutive columns of subpixels has the highest luminance as shown in FIG. 29A. As a result, the color white can be displayed with good quality.

On the other hand, if subpixels on the second, third and fourth columns of a display panel have their maximum luminances (i.e., their highest grayscales), then the green and red subpixels located at both ends of the three consecutive columns of subpixels have higher luminances than the blue subpixel located at the center as shown in FIG. 29B. As a result, sometimes color mixture cannot be produced sufficiently and two lines may be visible in the column direction.

Furthermore, if subpixels on the third, fourth and fifth columns of a display panel have their maximum luminances (i.e., their highest grayscales), then the blue subpixel located on the leftmost one of the three consecutive columns of subpixels has the lowest luminance and the green subpixel located on the rightmost column has the highest luminance as shown in FIG. 29C. As a result, the luminance levels vary stepwise, the color mixture cannot be produced sufficiently, and the image may look unevenly colored in some cases.

Figure 30A:
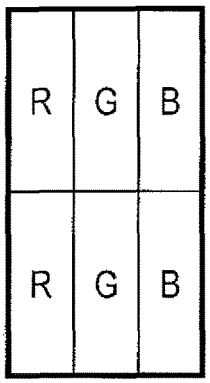
FIG. 30A is a schematic representation showing the arrangement of subpixels and their luminance ratios in a display panel for the comparative display device and FIGS. 30B and 30C are schematic representations showing the arrangements of subpixels and their luminance ratios in the multi-primary-color display panel for the display device of the eighth preferred embodiment.

As can be seen, the comparative display device cannot realize sufficiently high display quality even if the substantial horizontal resolution is increased. This is probably because the red, green and blue subpixels have so large luminance ratios that the distribution of luminances will change its shapes significantly according to each particular arrangement of subpixels. If the red, green and blue subpixels have luminance ratios of approximately 23%, 67% and 10% as described above, the greatest difference between the luminance ratios is 57% as shown in FIG. 30A. If the substantial horizontal resolution of a display panel with such a big difference between the luminance ratios were increased, then the distribution of luminances would change its shapes significantly due to the big difference between the luminance ratios and the display quality would be debased.

Regarding the correlation between the arrangement of subpixels and the display quality of the display device 100 of this preferred embodiment, in the multi-primary-color display panel 200 of the display device 100 of this preferred embodiment, the first red, second red, green, blue, yellow and cyan subpixels, included in two rows and three columns of subpixels that form a single pixel, have luminance ratios of approximately 8.5%, 8.5%, 24.5%, 42%, 10% and 6.5%, respectively.

Figure 30B:
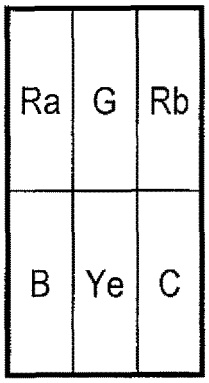
Figure 30C:
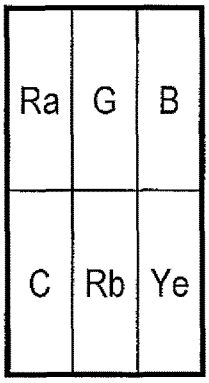
Figure 34A:
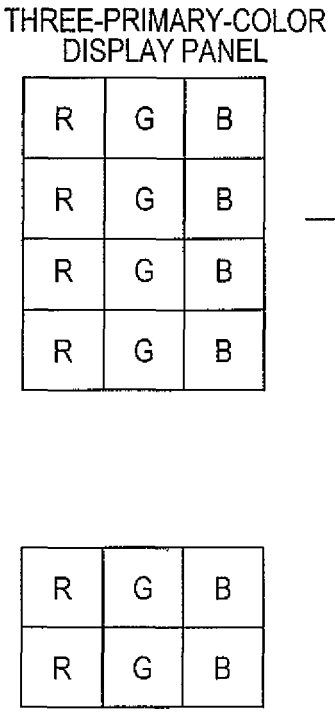
FIG. 34A is a schematic representation illustrating a normal three-primary-color display panel and FIG. 34B is a schematic representation illustrating a normal multi-primary-color display panel obtained by modifying the color filters of the three-primary-color display panel.
Figure 34B:
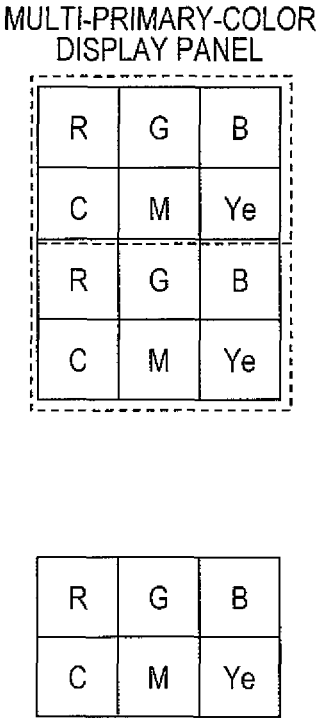

Suppose the first red, green and second red subpixels included in the first combination are arranged in this order, and blue, yellow and cyan subpixels included in the second combination are arranged in this order as shown in FIG. 30B. In that case, the sums of the luminance ratios of subpixels on the first, second, third columns become approximately 15%, 66.5% and 18.5%, respectively, and the biggest difference between the luminance ratios is about 52%. On the other hand, suppose the first red, green and blue subpixels included in the first combination are arranged in this order, and cyan, the second red, and yellow subpixels included in the second combination are arranged in this order as shown in FIG. 30C. In that case, the sums of the luminance ratios of subpixels on the first, second, third columns become approximately 18.5%, 33% and 48.5%, respectively, and the biggest difference between the luminance ratios is about 30%. In this manner, the biggest difference between the luminance ratios, and eventually the display quality, will vary according to the arrangement of subpixels.

FIG. 31A shows the combinations of subpixels in the column direction in a situation where a single pixel is made up of six subpixels, the sums of their luminance ratios, and the biggest differences between the luminance ratios. Just for your reference, the sums of the luminance ratios and the biggest difference between the luminance ratios in three-primary-color display devices, including the comparative display device, are shown in FIG. 31B.

As can be seen from FIG. 31A, the biggest difference between the luminance ratios in every combination is smaller than that of the three-primary-color display device, thus realizing good enough display quality. It should be noted that the biggest difference between the luminance ratios is preferably smaller than about 50% and more preferably smaller than about 35%.

In the example described above, the difference between the luminance ratios of respective subpixels is reduced along the columns of the arrangement of subpixels. However, the difference between the luminance ratios of respective subpixels is preferably reduced along the rows of the arrangement of subpixels, too. Take the combination with the biggest difference of 30 shown in FIG. 31A as an example.

Suppose the set in the first combination is comprised of RRYe and the set in the second combination is comprised of GCB. In that case, the sum of the luminance ratios of the subpixels in the first combination becomes about 59%, that of the luminance ratios of the subpixels in the second combination becomes about 41%, and their difference becomes about 18%. On the other hand, suppose the set in the first combination is comprised of RRB and the set in the second combination is comprised of GCYe. In that case, the sum of the luminance ratios of the subpixels in the first combination becomes about 23.5%, that of the luminance ratios of the subpixels in the second combination becomes about 76.5%, and their difference becomes about 53%. Thus, the former example is preferred to the latter. As can be seen, the difference between the luminance ratios of respective subpixels is preferably reduced not just in the column direction but also in the row direction as well.

In the foregoing description of the first through eighth preferred embodiments, the display device of the present invention preferably is a liquid crystal display device. However, the present invention is in no way limited to it. The present invention may also be implemented as any other type of display device that can conduct a display operation in multiple primary colors, which may be a cathode-ray tube (CRT), a plasma display panel (PDP), an organic EL (electroluminescence) display device, a surface-conduction electron-emitter display (SED) or a liquid crystal projector, to name a few.

It should be noted that the respective elements that are included in the signal converter 300 of the display device 100 according to the first through eighth preferred embodiments described above could be implemented as hardware components but could also be implemented by software programs either partially or even entirely. If those elements are implemented by software, a computer may be used as needed. In that case, the computer may include a CPU (central processing unit) for executing those various programs and a RAM (random access memory) functioning as a work area to execute those programs. And by getting those programs that perform the functions of the respective elements executed by the computer, those elements are implemented by the computer itself, so to speak.

Also, those programs may be either installed into the computer by way of a storage medium or downloaded into the computer over a telecommunications network. In the former case, the storage medium may be either removable from the computer or built in the computer. More specifically, the storage medium could be loaded either into the computer so that the computer can read the recorded program code directly or into a program reader that is connected as an external storage device to the computer. Examples of preferred storage media include: tapes such as magnetic tapes and cassette tapes; various types of disks including magnetic disks such as flexible disks and hard disks, magneto-optical disks such as MOs and MDs, and optical discs such as CD-ROMs, DVDs, and CD-Rs; cards such as IC cards (including memory cards) and optical cards; and various types of semiconductor memories such as mask ROMs, EPROMs (erasable programmable read-only memories), EEPROMs (electrically erasable programmable read-only memories) and flash ROMs. If the programs are supplied via a telecommunications network, those programs may be a carrier wave or data signals by which the program code is transmitted electronically.

The entire disclosures of Japanese Patent Applications Nos. 2006-280136 and 2007-236776, on which the present application claims priority, are hereby incorporated by reference.

The display device according to various preferred embodiments of the present invention can be used effectively as a PC monitor, a TV monitor, a projector, or a cellphone monitor, for example.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A display device comprising:

a multi-primary-color display panel including multiple display subpixels that are arranged in columns and rows, wherein in a series of L columns of subpixels of the multiple display subpixels, where L is a natural number that is equal to or greater than two, multiple sets of subpixels in the series of L columns of subpixels are provided in first and second different combinations and are arranged alternately, each of the multiple sets of subpixels in the series of L columns of subpixels including L subpixels that are arranged in a direction that is parallel with the rows of the multiple display subpixels; and a signal converter arranged and programmed to convert a video signal, having values that represent colors of pixels in a matrix pattern, into a multi-primary-color signal provided to drive the multiple display subpixels in the multi-primary-color display panel; wherein the signal converter is arranged and programmed to drive the multi-primary-color display panel with the multi-primary-color signal based on a value of the video signal representing a color of at least one of the pixels in the matrix pattern in a $p^{th}$ row of the matrix pattern, where p is any whole number, to generate, based on at least one of a look up table and a predetermined equation, values of the multi-primary-color signal that control luminances of subpixels of the multiple display subpixels positioned on $(s-1)^{th}$ and $s^{th}$ rows of the rows of the multiple display subpixels, where s is any whole number, and also based on a value of the video signal representing a color of at least one of the pixels in the matrix pattern in a $(p+1)^{th}$ row of the matrix pattern to generate, based on at least one of the look up table and the predetermined equation, values of the multi-primary-color signal that control luminances of subpixels of the multiple display subpixels positioned on the $s^{th}$ row and a $(s+1)^{th}$ row of the rows of the multiple display subpixels.

2. The display device of claim 1, wherein the multi-primary-color display panel has a different vertical resolution from the video signal, and the signal converter is arranged and programmed to perform multi-primary-color conversion and vertical resolution conversion on the values of the video signal representing colors of the pixels in the matrix pattern such that the values are input to drive the multi-primary-color display panel.

3. The display device of claim 2, wherein the video signal has a vertical resolution of 2M, where M is any whole number, that is equal to a total number of rows of the pixels in the matrix pattern, the multi-primary-color display panel has M sets of the subpixels in the series of L columns of subpixels in the first different combination and M sets of the subpixels in the series of L columns of subpixels in the second different combination that are arranged alternately in a direction that is parallel with the columns of the multiple display subpixels and also has a nominal vertical resolution of M, and the signal converter is arranged and programmed to convert the video signal with the vertical resolution of 2M into the multi-primary-color signal input to drive the multiple display subpixels in the multi-primary-color display panel, the multi-primary-color signal having the nominal vertical resolution of M.

4. The display device of claim 1, wherein in a certain one of the columns of the multiple display subpixels, one of the L subpixels included in a set of the multiple sets of subpixels in the first different combination and one of the L subpixels included in a set of the multiple sets of subpixels in the second different combination are arranged alternately in a direction that is parallel with the columns of the multiple display subpixels.

5. The display device of claim 1, wherein in a certain one of the rows of the multiple display subpixels, a set of the multiple sets of subpixels in either one of the first or second different combinations is arranged in the direction that is parallel with the rows of the multiple display subpixels.

6. The display device of claim 5, wherein the L subpixels in a certain one of the rows of the multiple display subpixels belong to a set of the multiple sets of subpixels in either one of the first or second different combinations, are arranged periodically in the direction that is parallel with the rows of the multiple display subpixels.

7. The display device of claim 5, wherein the video signal has a horizontal resolution of 2H, H being any whole number, that is equal to a total number of columns of the pixels in the matrix pattern, in a certain one of the rows of the multiple display subpixels, a set of 2H subpixels of the multiple sets of subpixels in either one of the first or second different combinations is arranged in the direction that is parallel with the rows of the multiple display subpixels, and a value of the video signal representing colors of a specific column of the columns of the pixels in the matrix pattern is used to generate, based on at least one of the look up table and the predetermined equation, values of the multi-primary-color signal that control luminances of the L columns of subpixels.

8. The display device of claim 7, wherein a value of the video signal representing a color of a pixel of the pixels in the matrix pattern at an intersection between the $p^{th}$ row of the matrix pattern and a $q^{th}$ column of the matrix pattern, q being any whole number, is used to generate, based on at least one of the look up table and the predetermined equation, values of the multi-primary-color signal that control luminances of a series of L subpixels of the multiple display subpixels in the $(s-1)^{th}$ row of the rows of the multiple display subpixels, including one subpixel of the series of L subpixels of the multiple display subpixels on the $(s-1)^{th}$ row at an intersection between the $(s-1)^{th}$ row and a $t^{th}$ column of the columns of the multiple display subpixels, t being any whole number, and another series of L subpixels of the multiple display subpixels in the $s^{th}$ row of the rows of the multiple display subpixels, including one subpixel of the series of L subpixels of the multiple display subpixels on the $s^{th}$ row at an intersection between the $s^{th}$ row and the $t^{th}$ column.

9. The display device of claim 8, wherein the value of the video signal representing the color of the pixel at the intersection between the $p^{th}$ row and the $q^{th}$ column of the matrix pattern is used to generate, based on at least one of the look up table and the predetermined equation, values of the multi-primary-color signal that control luminances of subpixels of the multiple display subpixels in $(p-1)^{th}$ and $p^{th}$ rows of the rows of the multiple display subpixels and on $\{L\times(q-1)+1\}^{th}$ through $(L\times q)^{th}$ columns of the columns of the multiple display subpixels, and wherein a value of the video signal representing the color of a pixel of the pixels in the matrix pattern at an intersection between the $(p+1)^{th}$ row and the $q^{th}$ column is used to generate, based on at least one of the look up table and the predetermined equation, values of the multi-primary-color signal that control the luminances of subpixels of the multiple display subpixels in the $p^{th}$ and $(p+1)^{th}$ rows and in the $\{L\times(q-1)+1\}^{th}$ through $(L\times q)^{th}$ columns.

10. The display device of claim 1, wherein at least one subpixel of the multiple display subpixels included in each of the multiple sets of the subpixels in the first different combination displays a same color as at least one subpixel of the multiple display subpixels included in each of the multiple sets of the subpixels in the second different combination.

11. The display device of claim 10, wherein

L is equal to 3, and each of the multiple sets of the subpixels in the first different combination includes a first red subpixel, a yellow subpixel, and a blue subpixel, and each of the multiple sets of the subpixels in the second different combination includes a second red subpixel, a green subpixel, and a cyan subpixel.

12. The display device of claim 5, wherein the video signal has a horizontal resolution of 2H, H being any whole number, that is equal to a total number of columns of the pixels in the matrix pattern, on a certain row of the rows of the multiple display subpixels, a set of H subpixels of the multiple sets of subpixels in either one the first or second different combinations is arranged in the direction that is parallel with the rows of the multiple display subpixels, the multi-primary-color display panel has a nominal horizontal resolution of H, and the signal converter is arranged and programmed to convert the video signal with the horizontal resolution of 2H into the multi-primary-color signal used to drive the multiple display subpixels in the multi-primary-color display panel, the multi-primary-color signal having the nominal horizontal resolution of H.

13. The display device of claim 12, wherein a value of the video signal representing a color of a pixel of the pixels in the matrix pattern at an intersection between the $p^{th}$ row of the matrix pattern and a $q^{th}$ column of the matrix pattern, q being any whole number, is used to generate, based on at least one of the look up table and the predetermined equation, values of the multi-primary-color signal that control luminances of subpixels in the $(s-1)^{th}$ row of the rows of the multiple display subpixels, including one subpixel of the subpixels in the $(s-1)^{th}$ row at an intersection between the $(s-1)^{th}$ row and a $t^{th}$ column of the columns of the multiple display subpixels, t being any whole number, and subpixels of the multiple display subpixels in the $s^{th}$ row of the rows of the multiple display subpixels, including one subpixel of the subpixels in the $s^{th}$ row at an intersection between the $s^{th}$ row and the $t^{th}$ column, and a value of the video signal representing the color of a pixel of the pixels in the matrix pattern at an intersection between a $(p+1)^{th}$ row of the matrix pattern and the $q^{th}$ column of the matrix pattern is used to generate, based on at least one of the look up table and the predetermined equation, values of the multi-primary-color signal that control luminances of subpixels on the $s^{th}$ row, including the one subpixel at the intersection between the $s^{th}$ row and the $t^{th}$ column, and subpixels of the multiple display subpixels on an $(s+1)^{th}$ row, including one subpixel of the subpixels in the $(s+1)^{th}$ row at an intersection between the $(s+1)^{th}$ row and the $t^{th}$ column.

14. The display device of claim 12, wherein a value of the video signal representing a color of a pixel of the pixels in the matrix pattern at an intersection between the $p^{th}$ row of the matrix pattern and a $q^{th}$ column of the matrix pattern, q being any whole number, is used to generate, based on at least one of the look up table and the predetermined equation, values of the multi-primary-color signal that control luminances of a series of L subpixels of the multiple display subpixels in an $(s-1)^{th}$ row of the rows of the multiple display subpixels and another series of L subpixels of the multiple display subpixels in an $s^{th}$ row of the rows of the multiple display subpixels, and a value of the video signal representing a color of a pixel of the pixels in the matrix pattern at an intersection between a $(p+1)^{th}$ row of the matrix pattern and the $q^{th}$ column is used to generate, based on at least one of the look up table and the predetermined equation, values of the multi-primary-color signal that control luminances of the series of L subpixels on the $s^{th}$ row and yet another series of L subpixels of the multiple display subpixels in an $(s+1)^{th}$ row of the rows of the multiple display subpixels.

15. The display device of claim 12, wherein a value of the video signal representing a color of a pixel of the pixels in the matrix pattern at an intersection between the $p^{th}$ row of the matrix pattern and a $q^{th}$ column of the matrix pattern, q being any whole number, is used to generate, based on at least one of the look up table and the predetermined equation, values of the multi-primary-color signal that control luminances of less than L subpixels of the multiple display subpixels in an $(s-1)^{th}$ row of the rows of the multiple display subpixels and less than L subpixels of the multiple display subpixels in an $s^{th}$ row of the rows of the multiple display subpixels, and a value of the video signal representing a color of a pixel in the matrix pattern at an intersection between the $(p+1)^{th}$ row of the matrix pattern and the $q^{th}$ column of the matrix pattern is used to generate, based on at least one of the look up table and the predetermined equation, values of the multi-primary-color signal that control luminances of the less than L subpixels in the $s^{th}$ row and less than L subpixels in an $(s+1)^{th}$ row of the rows of the multiple display subpixels.

16. The display device of claim 12, wherein a value of the video signal representing a color of a pixel of the pixels in the matrix pattern at an intersection between the $p^{th}$ row of the matrix pattern and a $q^{th}$ column of the matrix pattern, q being any whole number, is used to generate, based on at least one of the look up table and the predetermined equation, values of the multi-primary-color signal that control luminances of more than L subpixels of the multiple display subpixels in an $(s-1)^{th}$ row of the rows of the multiple display subpixels and more than L subpixels of the multiple display subpixels on an $s^{th}$ row of the rows of the multiple display subpixels, and a value of the video signal representing a color of a pixel at an intersection between a $(p+1)^{th}$ row of the matrix pattern and the $q^{th}$ column of the matrix pattern is used to generate, based on at least one of the look up table and the predetermined equation, values of the multi-primary-color signal that control luminances of the more than L subpixels on the $s^{th}$ row and more than L subpixels of the multiple display subpixels on an $(s+1)^{th}$ row of the rows of the multiple display subpixels.

17. The display device of claim 1, wherein the subpixels of the multiple display subpixels included in each of the multiple sets of subpixels in the first different combination represent a different color from the subpixels of the multiple display subpixels included in each of the multiple sets of subpixels in the second different combination.

18. The display device of claim 17, wherein

L is equal to 2, and each of the multiple sets of subpixels in the first different combination includes a red subpixel and a green subpixel, and each of the multiple sets of subpixels in the second different combination includes a blue subpixel and a yellow subpixel.

19. The display device of claim 1, wherein the video signal is an interlaced signal, in odd-numbered fields, the $(s-1)^{th}$ and the $s^{th}$ rows of the rows of the multiple display subpixels of the multi-primary-color display panel have luminances that are controlled by values of the video signal representing colors of pixels on the $p^{th}$ row of the matrix pattern, and in even-numbered fields, the $s^{th}$ and the $(s+1)^{th}$ rows of the rows of the multiple display subpixels of the multi-primary-color display panel have luminances that are controlled by values of the video signal representing colors of pixels on a $(p+1)^{th}$ row.

20. The display device of claim 19, wherein in each of the odd-numbered and even-numbered fields, $(2w-1)^{th}$ and $2w^{th}$ rows of the rows of the multiple display subpixels, w being any whole number, have a same polarity but $2w^{th}$ and $(2w+1)^{th}$ rows of the rows of the multiple display subpixels have mutually different polarities, and in each of the odd-numbered and even-numbered fields, subpixels of the multiple display subpixels that are adjacent to each other in the direction that is parallel with the rows of the multiple display subpixels have mutually different polarities.

21. The display device of claim 19, wherein each of the multiple display subpixels of the multi-primary-color display panel has its polarity inverted every field.

22. The display device of claim 1, wherein the video signal is a progressive signal, and the $s^{th}$ row of the rows of the multiple display subpixels of the multi-primary-color display panel exhibit luminances that have been obtained based on values of the video signal representing the colors of the pixels in the matrix pattern that are in the $p^{th}$ and the $(p+1)^{th}$ rows of the matrix pattern.

23. The display device of claim 22, wherein the signal converter is arranged and programmed to determine values of the multi-primary-color signal used to control luminances of the $s^{th}$ row of the rows of the multiple display subpixels using a result of a multi-primary-color conversion that has been performed on the values of the video signal representing the colors of the pixels in the matrix pattern in the $p^{th}$ and $(p+1)^{th}$ rows of the matrix pattern.

24. The display device of claim 23, wherein at least one of the subpixels of the multiple display subpixels included in each of the multiple sets of subpixels in the first different combination displays a same color as at least one of the subpixels of the multiple display subpixels included in each of the multiple sets of subpixels in the second different combination, and the signal converter is arranged and programmed to determine a value that controls a luminance of the at least one subpixel of the multiple display subpixels that displays the same color among subpixels on an $x^{th}$ row of the rows of the multiple display subpixels, x being any whole number, using a result of a multi-primary-color conversion that has been performed on a value of the video signal representing colors of pixels in the matrix pattern in an $x^{th}$ row of the matrix pattern.

25. The display device of claim 22, wherein the signal converter is arranged and programmed to obtain a value representing colors of a single row of pixels in the matrix pattern, comprised of two rows of the rows of the multiple display subpixels in the multi-primary-color display panel, using values of the video signal representing colors of at least two rows of pixels in the matrix pattern that are adjacent to each other in a direction that is parallel with columns of the matrix pattern, and also using the value representing the colors of the single row of pixels in the matrix pattern, to perform a multi-primary-color conversion, the multi-primary-color conversion being used to generate, based on at least one of the look up table and the predetermined equation, values of the multi-primary-color signal that control luminances of subpixels of the two rows of the rows of the multiple display subpixels.

26. The display device of claim 25, wherein the signal converter is arranged and programmed to obtain a value representing colors of a single row of pixels in the matrix pattern, comprised of $(2w-1)^{th}$ and $2w^{th}$ rows of the rows of the multiple display subpixels in the multi-primary-color display panel, w being any whole number, using values of the video signal representing colors of $(2w-2)^{th}$, $(2w-1)^{th}$ and $2w^{th}$ rows of pixels in the matrix pattern, and to subject the value representing the colors of the single row of pixels in the matrix pattern to a multi-primary-color conversion, the multi-primary-color conversion being used to generate, based on at least one of the look up table and the predetermined equation, values of the multi-primary-color signal that controls luminances of subpixels of the $(2w-1)^{th}$ and $2w^{th}$ rows of the rows of the multiple display subpixels.

* * * * *